US010464331B2

(12) United States Patent
Naito et al.

(10) Patent No.: US 10,464,331 B2
(45) Date of Patent: Nov. 5, 2019

(54) LIQUID CONTAINER

(71) Applicant: Seiko Epson Corporation, Tokyo (JP)

(72) Inventors: Naoki Naito, Ikeda-machi (JP); Yuji Aoki, Hara-mura (JP); Kazuyuki Hirata, Matsumoto (JP); Hiroshi Nose, Shiojiri (JP); Keita Ichihara, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/030,539

(22) Filed: Jul. 9, 2018

(65) Prior Publication Data

US 2019/0016147 A1 Jan. 17, 2019

(30) Foreign Application Priority Data

Jul. 12, 2017 (JP) ..... 2017-136097
Jul. 12, 2017 (JP) ..... 2017-136100
(Continued)

(51) Int. Cl.
*B41J 2/175* (2006.01)
*B41J 2/19* (2006.01)
*B41J 29/13* (2006.01)

(52) U.S. Cl.
CPC ..... *B41J 2/17553* (2013.01); *B41J 2/1752* (2013.01); *B41J 2/1753* (2013.01);
(Continued)

(58) Field of Classification Search
CPC ..... B41J 2/17553; B41J 2/1752; B41J 2/19; B41J 2/17563; B41J 2/17546;
(Continued)

(56) References Cited

U.S. PATENT DOCUMENTS 6,412,929 B1 7/2002 Chen
8,820,902 B2 9/2014 Iwamuro et al.
(Continued)

FOREIGN PATENT DOCUMENTS

CN 202507678 U 10/2012
EP 2 383 121 A1 11/2011
(Continued)

*Primary Examiner* — Bradley W Thies
(74) *Attorney, Agent, or Firm* — Foley & Lardner LLP

(57) ABSTRACT

The liquid container includes: a container main body including a containment chamber containing a liquid and has some walls including a front-end wall, a rear-end wall, and an upper-surface wall; a liquid outlet connected to a liquid-consuming device to flow out the liquid from the containment chamber to the liquid-consuming device; a liquid inlet on the upper-surface wall at a position closer to the rear-end wall and accepts injection of the liquid from outside of the container main body into the containment chamber; and a visual recognition portion that is provided on the rear-end wall and is see-through so that a position of a liquid surface of the liquid in the containment chamber is recognizable. The rear-end wall has scale marks as indexes of an amount of the liquid in the containment chamber on an outer wall surface and an inner wall surface.

18 Claims, 39 Drawing Sheets

(30) Foreign Application Priority Data

Jul. 12, 2017 (JP) ..... 2017-136101
Jul. 12, 2017 (JP) ..... 2017-136104
Jul. 12, 2017 (JP) ..... 2017-136106

(52) U.S. Cl.
CPC ..... *B41J 2/17509* (2013.01); *B41J 2/17513* (2013.01); *B41J 2/17523* (2013.01); *B41J 2/17546* (2013.01); *B41J 2/17563* (2013.01); *B41J 2/17566* (2013.01); *B41J 2/19* (2013.01); *B41J 29/13* (2013.01); *B41J 2002/17573* (2013.01)

(58) Field of Classification Search
CPC ..... B41J 2/1753; B41J 2/17523; B41J 29/13; B41J 2/17566; B41J 2/17513; B41J 2/17509; B41J 2002/17573
See application file for complete search history.

(56) References Cited

U.S. PATENT DOCUMENTS

| | | | |
|---|---|---|---|
| 8,974,038 | B2 | 3/2015 | Iwamuro et al. |
| 9,126,414 | B2 | 9/2015 | Iwamuro et al. |
| 9,186,883 | B2 | 11/2015 | Ono et al. |
| 9,216,585 | B2 | 12/2015 | Iwamuro et al. |
| 9,259,936 | B2 | 2/2016 | Iwamuro et al. |
| 9,387,683 | B2 | 7/2016 | Iwamuro et al. |
| 9,586,405 | B2 | 3/2017 | Iwamuro et al. |
| 9,662,898 | B2 | 5/2017 | Iwamuro et al. |
| 2009/0079803 | A1 | 3/2009 | Mimura |
| 2014/0043408 | A1 | 2/2014 | Kudo et al. |
| 2015/0145931 | A1 | 5/2015 | Iwamuro et al. |
| 2015/0306882 | A1 | 10/2015 | Kudo et al. |
| 2016/0052286 | A1 | 2/2016 | Kimura et al. |
| 2016/0159099 | A1 | 6/2016 | Kudo et al. |
| 2016/0288516 | A1 | 10/2016 | Naito et al. |
| 2017/0028735 | A1 | 2/2017 | Kimura et al. |
| 2017/0182813 | A1 | 6/2017 | Suzuki et al. |
| 2018/0170064 | A1* | 6/2018 | Higuchi ..... B41J 2/01 |

FOREIGN PATENT DOCUMENTS

| | | | |
|---|---|---|---|
| JP | 2009-078460 | A | 4/2009 |
| JP | 2014-046531 | A | 3/2014 |
| JP | 2014-046624 | A | 3/2014 |
| JP | 2014-046626 | A | 3/2014 |
| JP | 2014-054824 | A | 3/2014 |
| JP | 2014-061692 | A | 4/2014 |
| JP | 2014-061693 | A | 4/2014 |
| JP | 2014-094547 | A | 5/2014 |
| JP | 2015-047830 | A | 3/2015 |
| JP | 2016-022726 | A | 2/2016 |
| JP | 2016-193616 | A | 11/2016 |
| JP | 2017-007304 | A | 1/2017 |
| JP | 2017-081124 | A | 5/2017 |
| JP | 2017-113969 | A | 6/2017 |

* cited by examiner

LIQUID CONTAINER

The present application is based on, and claims priority from JP Application Serial Number 2017-136100, filed Jul. 12, 2017; Japanese Application Serial Number 2017-136101, filed Jul. 12, 2017; Japanese Application Serial Number 2017-136104, filed Jul. 12, 2017; Japanese Application Serial Number 2017-136106, filed Jul. 12, 2017; and Japanese Application Serial Number 2017-136097, filed Jul. 12, 2017; the disclosures of all of which are hereby incorporated by reference herein in their entirety.

BACKGROUND

1. Technical Field

The present disclosure relates to a liquid container.

2. Related Art

As a form of a liquid-consuming device, an ink-jet printer, hereinafter, simply called "printer", there known. The printer consumes an ink as a liquid to execute a printing process. The printer generally has an ink cartridge, hereinafter simply called "cartridge", attached thereto as a liquid container that contains an ink to be supplied to the printer. For example, see JP A-2016-22726. Such a cartridge may have scale marks for the user to visually recognize the ink level in the cartridge and an injection port as a liquid inlet that accepts the injection of the ink by the user.

The cartridge described in JP A-2016-22726 has scale marks on the wall surface below the ink injection port. For example, see FIG. 13 of JP A-2016-22726. Accordingly, at the injection of the ink into the injection port, the ink spilling out of the injection port may adheres to the scale marks to decrease the visibility of the scale marks. In addition, when the scale marks are provided on the outer wall surface, the scale marks may become worn and deteriorated in visibility. With deterioration in the visibility of the scale marks, it may be difficult for the user to check the ink level in the cartridge. This problem is not limited to the cartridge of an ink-jet printer but is common among liquid containers that contain a liquid to be supplied to liquid-consuming devices.

SUMMARY

As an aspect, a liquid container is provided. The liquid container in this aspect is configured to contain a liquid to be supplied to a liquid-consuming device consuming the liquid and to be inserted and loaded into the liquid-consuming device in an insertion direction crossing a direction of gravity. The liquid container in this aspect comprises: a container main body that includes a containment chamber containing the liquid and has a plurality of wall parts including a front-end wall part that is positioned on the insertion direction with respect to the containment chamber, a rear-end wall part that is opposite to the front-end wall part with the containment chamber therebetween in the insertion direction and faces the containment chamber, and an upper-surface wall part that crosses the front-end wall part and the rear-end wall part and is positioned above the containment chamber in a loaded state where the liquid container is loaded in the liquid-consuming device; a liquid outlet that is connected to the liquid-consuming device in the loaded state to flow out the liquid from the containment chamber to the liquid-consuming device; a liquid inlet that is provided on the upper-surface wall part at a position closer to the rear-end wall part than the front-end wall part and communicates with the containment chamber to accept injection of the liquid from outside of the container main body into the containment chamber; and a visual recognition portion that is provided on the rear-end wall part and is see-through so that a position of a liquid surface of the liquid contained in the containment chamber is visually recognizable from the outside of the container main body. The rear-end wall part has at least part of scale marks as indexes of an amount of the liquid contained in the containment chamber on an outer wall surface outside the containment chamber in the visual recognition portion and an inner wall surface of inside the containment chamber in the visual recognition portion.

According to the liquid container in this aspect, at least part of the scale marks are provided on both the inner wall surface and the outer wall surface. Thus, it is possible to prevent a situation where the user cannot check the liquid amount even if a defect of the scale marks in either the inner wall surface or the outer wall surface occur. Accordingly, it leads to prevent the confirmation of the amount of the liquid contained in the liquid container by the user from becoming difficult.

In the liquid container in the foregoing aspect, a liquid-receiving portion receiving the liquid spilling out of the liquid inlet may be provided on an outer wall surface of the upper-surface wall part as a concave portion around the liquid inlet.

According to the liquid container in this aspect, the liquid spilling out of the liquid inlet is received by the liquid-receiving portion. This prevents the liquid spilling out of the liquid inlet from moving to the visual recognition portion of the rear-end wall part and decreasing the visibility of the scale marks.

In the liquid container in the foregoing aspect, the liquid-receiving portion may have a liquid-receiving portion division wall dividing a space in the liquid-receiving portion into a plurality of sections.

According to the liquid container in this aspect, the liquid-receiving portion division wall makes the liquid flow in the liquid-receiving portion, so it prevents the liquid spill out of the liquid-receiving portion from being adhesion of the liquid spilling out of the liquid inlet so that the decrease of the visual recognition portion on the rear-end wall part can be suppressed.

The liquid container in the foregoing aspect further includes a lid member that is rotatably coupled to the upper-surface wall part and rotates relative to the upper-surface wall part to open or close the liquid inlet. The lid member may have a sealing surface that takes a state of covering the liquid inlet to close the liquid inlet and a state of separating from the liquid inlet to open the liquid inlet.

According to the liquid container in this aspect, the lid member prevents the liquid from spilling out of the liquid inlet. Accordingly, it is possible to prevent the liquid spilling out of the liquid inlet from adhering to the visual recognition portion on the rear-end wall part to deteriorate the visibility of the scale marks.

In the liquid container of the foregoing aspect, the upper-surface wall part may have an inlet peripheral wall portion surrounding a periphery of the liquid inlet and projecting upward, and the sealing surface may have a seal member to abut with an upper end surface of the inlet peripheral wall portion to seal the liquid inlet.

According to the liquid container in this aspect, the seal member in the lid member further suppresses leakage of the liquid from the liquid inlet. Therefore, it further suppresses reduction in the visibility of the scale marks by the liquid spilling out of the liquid inlet.

In the liquid container of the foregoing aspect, the upper-surface wall part may have a stopper portion to support the lid member in an inclined state with respect to the upper-surface wall part such that the liquid inlet is kept open.

According to the liquid container in this aspect, it is possible to prevent the lid member from interfering with the user's injection of the liquid into the liquid inlet. Accordingly, it is possible to prevent the user from accidentally spilling the liquid at the time of liquid injection and suppress reduction in the visibility of the scale marks due to the spilling liquid. In addition, since the lid member is inclined when the user close the liquid inlet, the user is able to lift the lid member easily by finger to rotate. This makes it easy for the user to close the liquid inlet.

In the liquid container of the foregoing aspect, the sealing surface may have a projection protruding from the sealing surface at an end on the upper-surface wall part, the projection may have a groove extended along a protrusion direction of the projection and the groove has a bottom on a rotation axis side of the lid member, and while the lid member is rotated toward the liquid inlet, the groove may enter a state where the liquid-receiving portion is positioned ahead of the groove in the protrusion direction.

According to the liquid container in this aspect, the liquid adhering to the sealing surface of the lid member lead to be moved along the groove in the projection and guided to the liquid-receiving portion. This suppresses the liquid on the sealing surface of the lid member from moving to the rear-end wall part and adhering to the visual recognition portion. So the visibility of the scale marks is suppressed to deteriorate.

In the liquid container of the foregoing aspect, the upper-surface wall part may have a convex wall portion protruding upwardly between the liquid inlet and the rear-end wall part.

According to the liquid container, the convex wall portion prevents the dispersion of liquid drops to the rear-end wall part when the user is injecting the liquid into the liquid inlet. Accordingly, it is possible to prevent the liquid from adhering to the rear-end wall part to deteriorate the visibility of the scale marks.

In the liquid container of the foregoing aspect, the lid member may have a sealing surface-side concave portion provided on the sealing surface to receive the convex wall portion when the lid member closes the liquid inlet and an outer surface convex portion where a user hangs finger to open or close the lid member, the outer surface convex portion is provided on an outer surface opposite to the sealing surface, and contains the sealing surface-side concave portion inside.

According to the liquid container in this aspect, the provision of the outer surface convex portion facilitates the user's smooth opening and closing of the lid member. In addition, using of the convex wall portion as a reference for positioning the lid member at the time of the closing the liquid inlet by the lid member makes easy for the user to open or close the lid member.

The liquid container of the foregoing aspect may have a first support concave portion provided at an upper end of the convex wall portion to receive and support part of a liquid injection instrument for use in injecting the liquid into the liquid inlet, and a second support concave portion provided at a corner between the rear-end wall part and the upper-surface wall part to receive and support part of the liquid injection instrument.

According to the liquid container, the liquid injection instrument is supported by the first support concave portion and the second support concave portion, which prevents the posture of the liquid injection instrument from becoming unstable to spill the liquid when the user is injecting the liquid into the liquid inlet. Accordingly, it further suppresses reduction in the visibility of the scale marks caused by the liquid spilling out of the liquid inlet.

In the liquid container of the foregoing aspect, the containment chamber may have an inner wall that droops from an upper surface to a bottom surface of the containment chamber on the insertion direction of the liquid inlet, and the inner wall may have a lower end positioned between the upper surface and the bottom surface of the containment chamber.

According to the liquid container in this aspect, it is allowed to move and guide the liquid injected from the liquid inlet along the inner wall to the bottom surface of the containment chamber. Accordingly, it is possible to prevent the liquid in the containment chamber from being foamed by the liquid injected from the liquid inlet and prevent the position of the liquid surface visually checked through the visual recognition portion from becoming unclear.

In the liquid container of the foregoing aspect, the inner wall may have two ends in a direction crossing both the insertion direction and a direction from the upper surface to the bottom surface of the containment chamber, the two ends of the inner wall may be coupled to the inner wall surface of the containment chamber, and the lower end of the inner wall may have an end convex portion projecting from a wall surface of the inner wall.

According to the liquid container in this aspect, the inner wall serves as a reinforcement rib in the containment chamber to enhance the strength of the liquid container. The end convex portion increases the coupling portion between the inner wall and the inner wall surface of the containment chamber. This enhances the fixity of the inner wall to the inner wall surface of the containment chamber, thereby further enhancing the function of the inner wall as reinforcement rib. The end convex portion is able to decrease the momentum of the liquid flowing along the inner wall by projecting from the wall surface of the inner wall to the opposite side of the insertion direction. Accordingly, the foaming of the liquid in the containment chamber due to injection of the liquid from the liquid inlet is suppressed, which prevents the position of the liquid surface via the visual recognition portion from becoming unclear. In addition, the liquid moving along the inner wall is suppressed from reaching the liquid surface on its momentum, thereby suppressing the occurrence of foaming the liquid at the time of operation of injecting the liquid to the liquid container. This suppresses reduction in the visibility of the scale marks caused by the adhesion of such liquid drops to the visual recognition portion.

In the liquid container of the foregoing aspect, the inner wall may have an upper end coupled to the upper surface, and the upper end of the inner wall may have a communication portion communicating two adjacent areas of the containment chamber divided by the inner wall therebetween.

According to the liquid container in this aspect, when the liquid is injected from the liquid inlet, the air in the containment chamber is allowed to be escaped from the liquid inlet through the communication portion. This further allows the smooth injection of the liquid into the liquid container and facilitates checking the position of the liquid surface through the visual recognition portion during the liquid injection.

In the liquid container of the foregoing aspect, the rear-end wall part may have a plurality of ribs on the inner wall surface, the plurality of ribs constitutes the scale marks and is aligned vertically in the loaded state.

According to the liquid container in this aspect, the surroundings of the ribs constituting the scale marks are immersed in the liquid contained in the containment chamber to enhance the visibility of the ribs from the outside of the containment chamber.

In the liquid container of the foregoing aspect, the scale marks may include a lower-limit scale mark indicating a lower limit of the amount of the liquid contained in the containment chamber, the lower-limit scale mark may be provided on both the outside wall surface and the inside wall surface of the rear-end wall part.

According to the liquid container in this aspect, it is possible to suppress reduction in the visibility of the scale marks indicating the lower-limit position to prevent the shortage of the liquid in the liquid container.

In the liquid container of the foregoing aspect, the container main body may have a bottom-surface wall part crossing both the front-end wall part and the rear-end wall part, the bottom-surface wall part may be opposed to the upper-surface wall part with the containment chamber therebetween, and the bottom-surface wall part may have a handhold portion on which a user places hand at the time of loading or unloading the liquid container into or from the liquid-consuming device.

According to the liquid container in this aspect, the handhold portion makes it easy to load or unload the liquid container into or from the liquid-consuming device. In addition, the provision of the handhold portion on the bottom-surface wall part suppresses the interference between the formation area of the visual recognition portion and the formation area of the handhold portion. Accordingly, even with the provision of the handhold portion, the formation area of the visual recognition portion is allowed to be provided larger to suppress reduction in the visibility of the visual recognition portion.

According to the liquid container of the foregoing aspect, the liquid-consuming device may be configured to be loaded with a plurality of the liquid containers so that the plurality of the liquid containers are aligned in a direction crossing the insertion direction, and each of the liquid containers may have a coupling portion at an end on the rear-end wall part, the coupling portion is configured to couple the liquid container in the loaded state and another liquid container loaded in the liquid-consuming device.

According to the liquid container in this aspect, it is prevented only some of the liquid containers from being drawn out of the liquid-consuming device.

In the liquid container of the foregoing aspect, the liquid-consuming device may include a key member that, when being attached to the liquid-consuming device, is enabled to drive the liquid-consuming device, and when being detached from the liquid-consuming device, is disabled to drive the liquid-consuming device, the coupling portion may be configured to release a coupling state of the liquid containers by detaching the key member from the liquid-consuming device.

According to the liquid container in this aspect, it is possible to prevent the liquid-consuming device from being driven accidentally when the liquid container is removed from the liquid-consuming device.

All the plurality of constituent elements in the aspects of the present disclosure described above are not essential. To solve some or all of the foregoing problems or to attain some or all of the advantageous effects described herein, some of the plurality of constituent elements may be changed, deleted, replaced by other new constituent elements, or partly deleted in limited contents as appropriate. In addition, to solve some or all of the foregoing problems or to attain some or all of the advantageous effects described herein, some or all of technical features included in the aspect of the present disclosure described above may be combined with some or all of technical features included in another aspect of the present disclosure described above to form one independent aspect of the present disclosure.

The present disclosure may be implemented in various aspects other than a liquid container. For example, the present disclosure may be implemented in such aspects as a liquid-consuming device including a liquid container, a liquid-consuming device suitably loaded with a liquid container, a container main body used for a liquid container, a method for allowing the user to visibly check the amount of the liquid in the liquid container, a scale mark structure indicating the amount of the liquid in the liquid container, and others.

BRIEF DESCRIPTION OF DRAWINGS

Embodiments of present disclosure will be described with reference to the accompanying drawings, wherein like numbers reference like elements.

DESCRIPTION OF EXEMPLARY EMBODIMENTS

A. First Embodiment

The configuration of a liquid-consuming device 500 loaded with a liquid container 10A according to a first embodiment will be described with reference to FIG. 1, and then the configuration of the liquid container 10A according to the first embodiment will be described with reference to FIGS. 2 to 26.

A1. Configuration of the Liquid-Consuming Device

Figure 1:
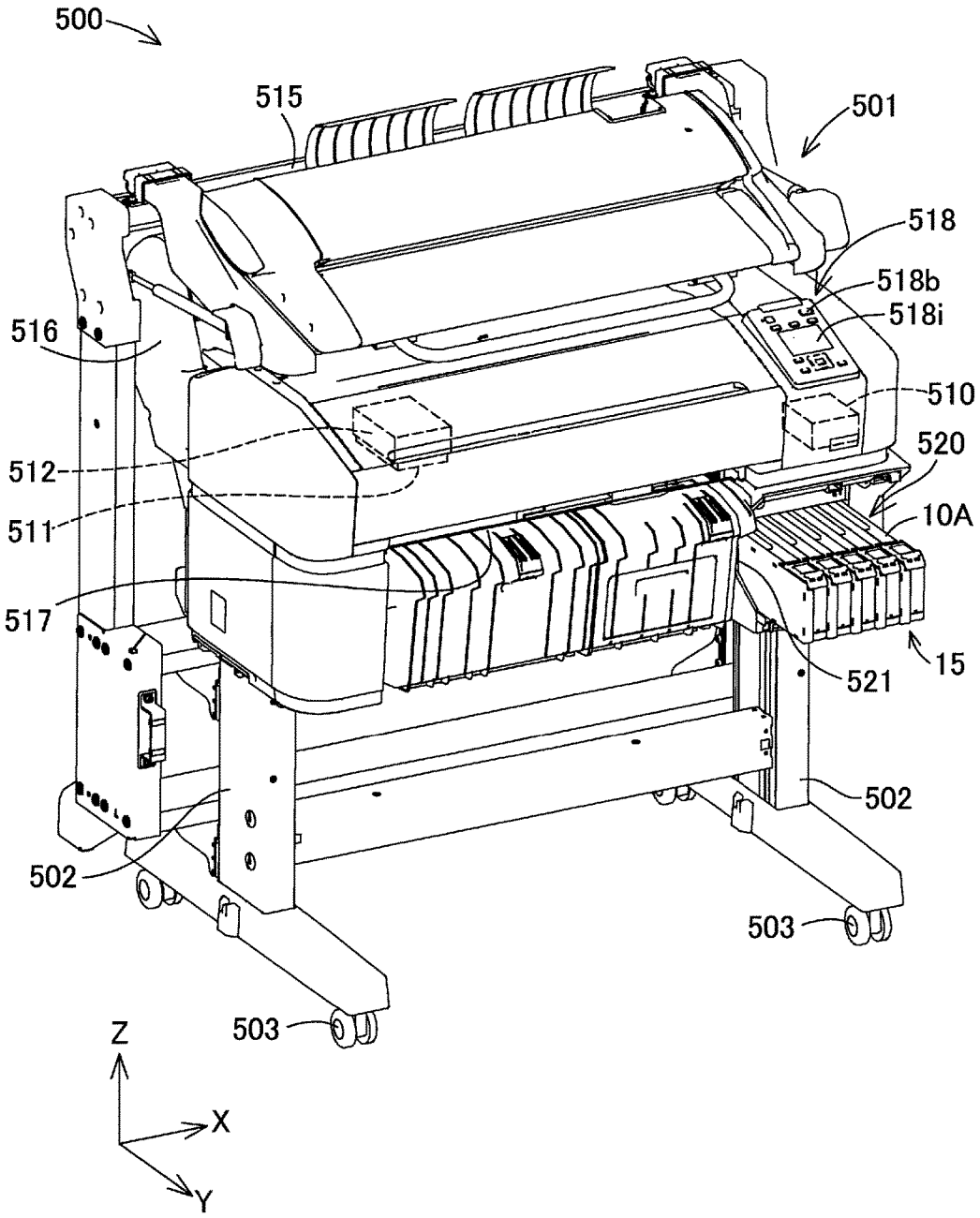
FIG. 1 is a schematic perspective view of a liquid-consuming device.

FIG. 1 is a schematic perspective view of the liquid-consuming device 500. FIG. 1 illustrates arrows X, Y, and Z that represent three directions orthogonal to one another. In correspondence with FIG. 1, other drawings referred to herein also illustrate the arrows X, Y, and Z as appropriate.

The directions represented by the arrows X, Y, and Z correspond to the position and posture of the liquid-consuming device 500 in a normal use condition. The "normal use condition" refers to the state in which the liquid-consuming device 500 is disposed on a horizontal plane to use. The following description is provided with reference to the posture of the liquid-consuming device 500 in the normal use condition. In the following description, the directions along the arrows X, Y, and Z will be respectively called "X direction", "Y direction", and "Z direction". Especially, for the X direction, the direction shown by the arrow X will be called "+X direction", and the opposite direction will be called "−X direction". For the Y and Z directions, similarly, the directions shown by the arrows Y and Z will be respectively called "+Y direction" and "+Z direction", and their opposite directions will be called "−Y direction" and "−Z direction".

The X, Y, and Z directions will be described in the order of the Z direction, the Y direction, and the X direction. The Z direction refers to a direction parallel to the direction of gravity. The −Z direction refers to the direction of gravity, and the +Z direction refers to the direction opposite to the direction of gravity. The direction concept terms like "up" or "down" used herein basically mean the upward or downward direction with respect to the direction of gravity. The Y direction refers to a direction parallel to a horizontal plane, which aligns with the front-back direction, that is, depth direction of the liquid-consuming device 500. The −Y direction refers to the direction from the front to rear sides of the liquid-consuming device 500 placed face-to-face with the user of the liquid-consuming device 500. The +Y direction refers to the direction from the rear to front sides of the liquid-consuming device 500. The X direction refers to a direction parallel to a horizontal plane, which aligns with the lateral direction, that is, width direction of the liquid-consuming device 500. The +X direction refers to the direction from the left to right sides of the liquid-consuming device 500 placed face-to-face with the user, and the −X direction refers to the direction from the right to left sides of the liquid-consuming device 500.

The liquid-consuming device 500 according to the first embodiment is an ink-jet printer. The liquid consumed by the liquid-consuming device 500 is an ink. The liquid-consuming device 500 discharges the ink toward a medium to record ink dots and form an image on the medium. The medium is printing paper, for example.

The liquid-consuming device 500 includes a device main body part 501 and leg parts 502. In the first embodiment, the device main body part 501 is shaped with the longitudinal side aligned with the X direction and is widest as seen in the X direction. The leg parts 502 are provided under the device main body part 501 to support horizontally the device main body part 501. The leg parts 502 are provided with wheels 503 to facilitate smooth movement of the liquid-consuming device 500.

The device main body part 501 has internally a controller 510, a head 511, and a carriage 512. In FIG. 1, the positions of the controller 510, the head 511, and the carriage 512 are shown by broken lines for the sake of convenience. The controller 510 controls driving of the individual components of the liquid-consuming device 500. The controller 510 is formed from a microcomputer at least including a central processing unit and a main memory unit. The controller 510 realize various functions by the central processing unit reading and executing various programs in the main memory unit. The controller 510 may be formed from a circuit instead of a microcomputer.

The head 511 sprays a liquid toward the surface of a medium, which is not illustrated in the figures, conveyed under the head 511. The head 511 has a liquid chamber that contains the liquid and a plurality of nozzles that are opened downward in the bottom surface of the liquid chamber, which is not illustrated in figures. The head 511 discharges the liquid from the nozzles under the control of the controller 510 by a publicly known method such as application of pressure to the liquid in the liquid chamber by a piezo element, for example.

The carriage 512 has the head 511 mounted on the lower surface and delivers the head 511 in a main operating direction under the control of the controller 510. In the first embodiment, the main scanning direction of the liquid-consuming device 500 aligns with the X direction. The device main body part 501 includes a guide shaft that guides the movement of the carriage 512, a motor that generates driving force to move the carriage 512, and a pulley that transfers the driving force to the carriage 512, as a driving mechanism for moving the carriage 512. The graphic representation and detailed description of these components are omitted.

The upper end of the device main body part 501 on the −Y direction side has an insertion port 515 for introducing a medium from the outside. The insertion port 515 is provided as a slit-like opening that extends in the X direction and opens in the +Z direction. A medium storage portion 516 is provided under the insertion port 515. The medium storage portion 516 stores a rolled medium different from the medium to be introduced from the insertion port 515, which is not illustrated in figures. The front surface of the device main body part 501 has an ejection port 517 into which the medium is ejected. The ejection port 517 is provided as a slit-like opening that extends in the X direction and opens in the +Y direction.

In the liquid-consuming device 500, the medium inserted from the insertion port 515 or the medium stored in the medium storage portion 516 is conveyed under the head 511 by a conveyor roller, which is not illustrated in figures, provided in the device main body part 501. The medium is conveyed in a region under the head 511 along the Y direction. In the first embodiment, a sub scanning direction of the liquid-consuming device 500 aligns with the Y direction. The medium passes through the region under the head 511 and is ejected through the ejection port 517.

In the liquid-consuming device 500, while conveying the medium in the region under the head 511 in the aforementioned sub scanning direction, the controller 510 reciprocates the head 511 in the main scanning direction and causes the head 511 to discharge ink drops from the head 511 based on print data at a predetermined timing. Accordingly, ink dots are recorded on the medium at positions determined based on the print data to form an image based on the print data.

An operating portion 518 is provided on the front surface of the device main body part 501. In the first embodiment, the operating portion 518 is provided at an end on the +X direction side. The operating portion 518 has a display portion **518*i* that displays information for the user and a plurality of operation buttons 518*b*** that accept user operations.

The device main body part 501 has a liquid supply portion 520. In the first embodiment, the liquid supply portion 520 is provided under the operating portion 518 so that the user operating the operating portion 518 easily accesses the liquid supply portion 520. The liquid supply portion 520 supplies the liquid to be discharged to the head 511. A plurality of liquid containers 10A are detachably attached to the liquid supply portion 520. FIG. 1 exemplifies the state in which five liquid containers 10A are loaded.

Figure 26:
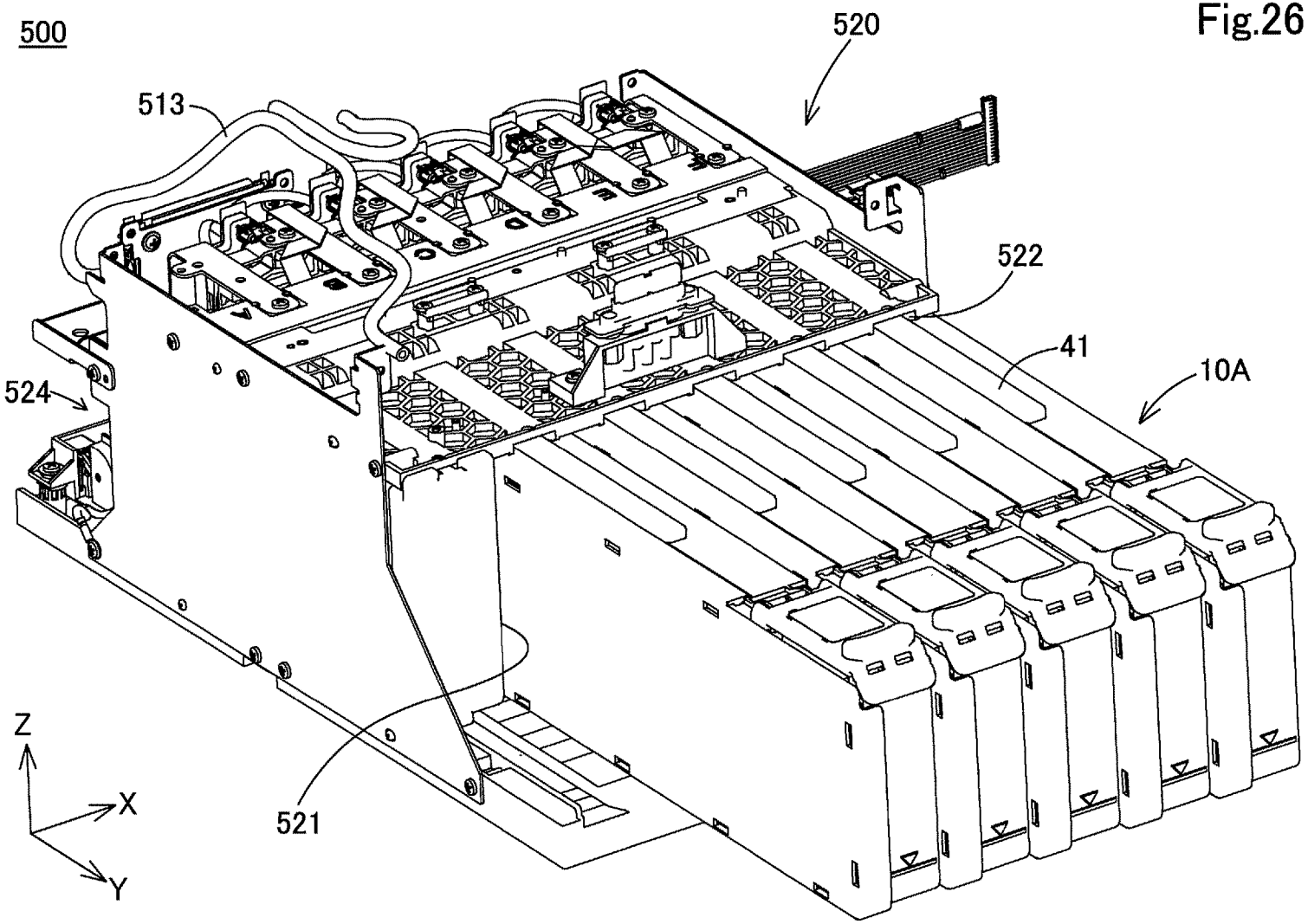
FIG. 26 is a schematic perspective view of a liquid supply portion loaded with a plurality of liquid containers.
Figure 27:
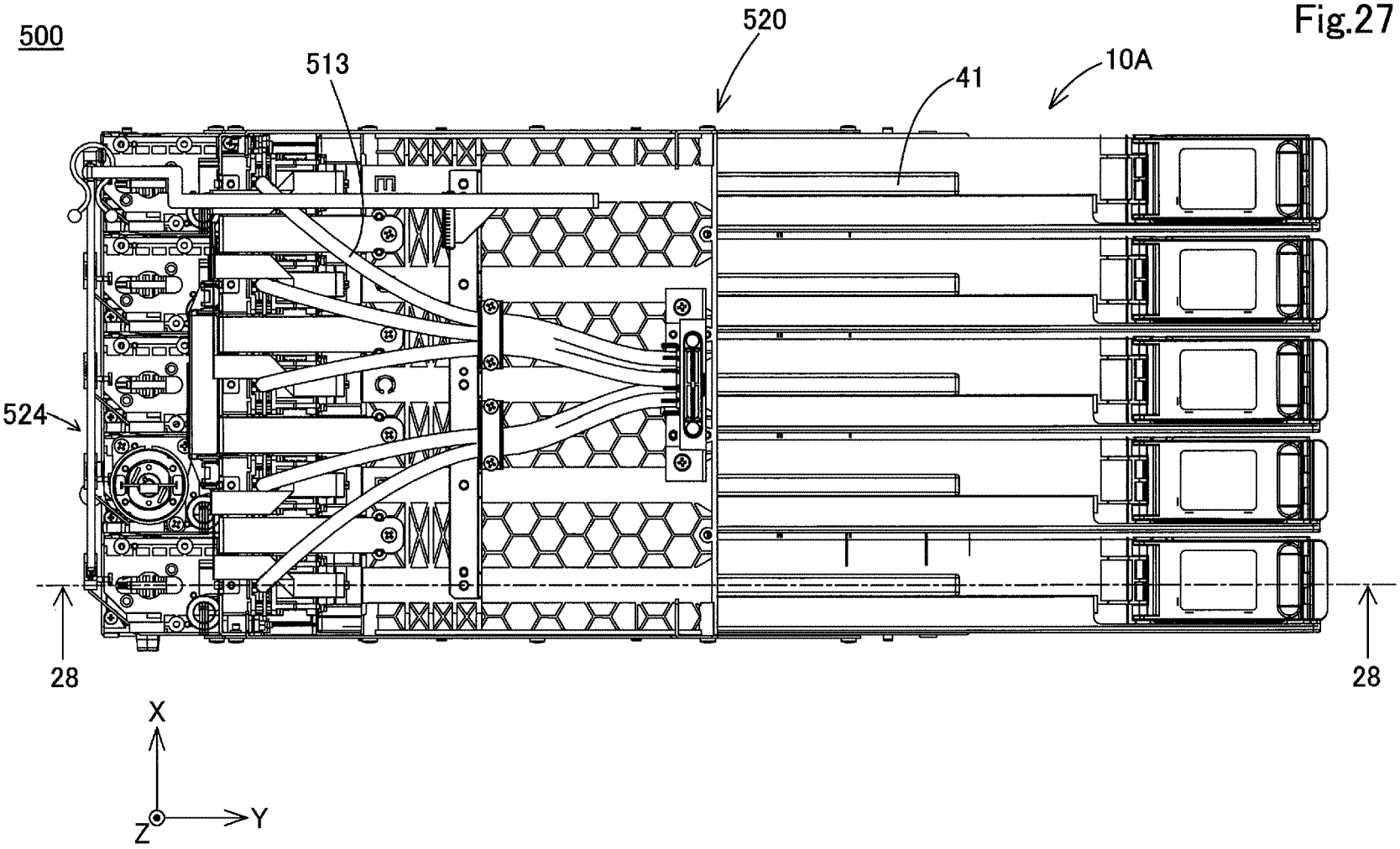
FIG. 27 is a schematic plane view of the liquid supply portion loaded with the plurality of liquid containers.
Figure 28:
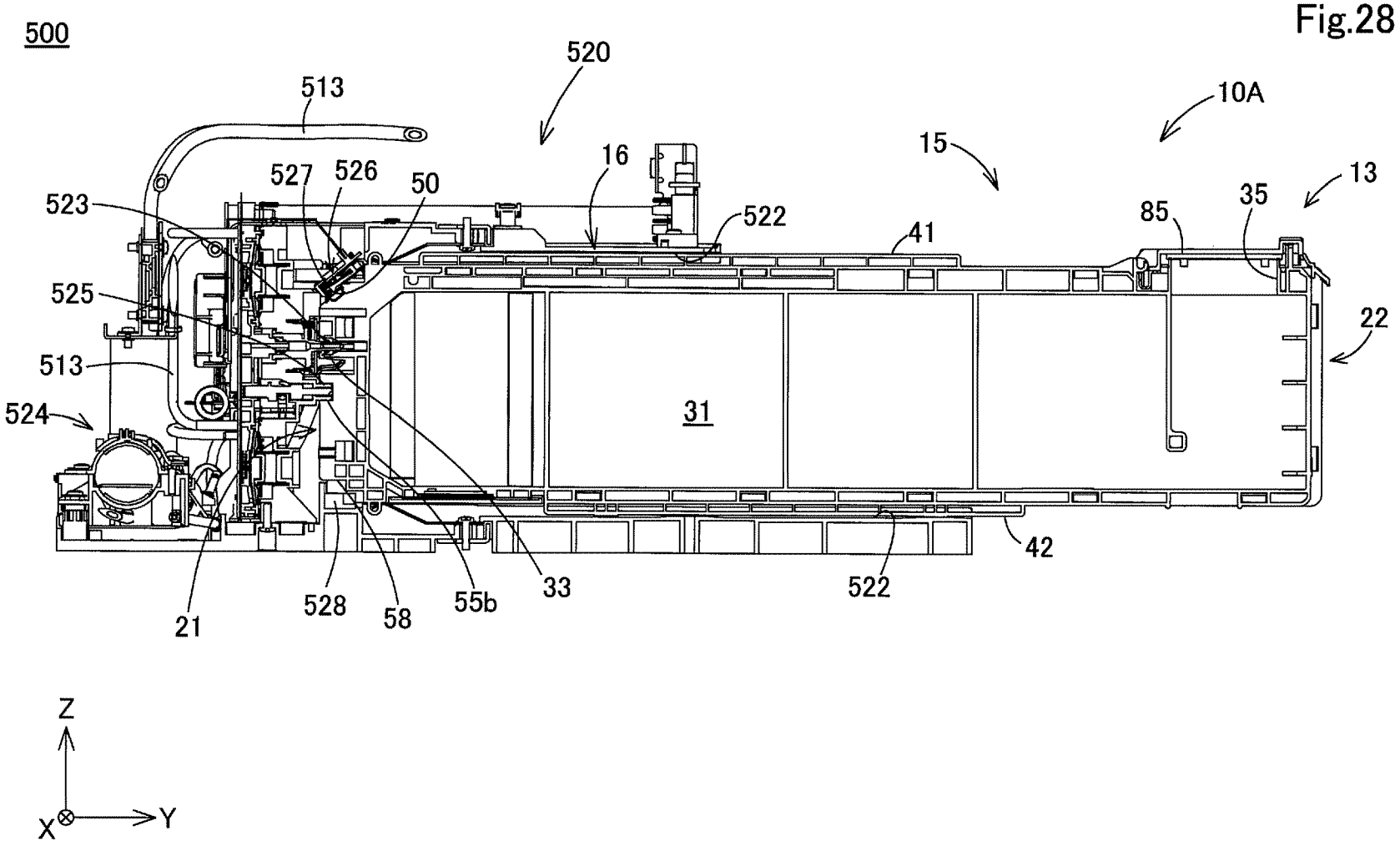
FIG. 28 is a schematic cross-sectional view of the liquid container and the liquid supply portion.

Each of the liquid container 10A contains the liquid to be supplied to the liquid-consuming device 500. The liquid supply portion 520 includes a suction pump 524. The liquid supply portion 520 sucks the liquid via a flexible tube 513 from the liquid container 10A and supplies the liquid to the head 511. The suction pump 524 and the tube 513 are illustrated in FIGS. 26 to 28 that will be referred to later.

The front surface of the device main body part 501 has a container insertion opening 521 which is opened in the +Y direction. Each of the liquid containers 10A is to be inserted and loaded into the container insertion opening 521. In the liquid-consuming device 500, the plurality of liquid containers 10A are aligned in the X direction and inserted in parallel into the container insertion opening 521 of the liquid supply portion 520. The liquid containers 10A contain inks of different colors.

The liquid containers 10A are inserted into the liquid-consuming device 500 in a direction crossing the direction of gravity. In the first embodiment, the liquid containers 10A are inserted into the liquid-consuming device 500 in the −Y direction. Hereinafter, the −Y direction in which the liquid containers 10A are inserted into the liquid-consuming device 500 will also be simply called "insertion direction".

Each of the liquid containers 10A is loaded into the liquid-consuming device 500 while being partially protruded in the insertion direction. Hereinafter, the state in which the liquid containers 10A are properly loaded in the liquid-consuming device 500 will also be simply called "loaded state". The mechanism for loading of the liquid containers 10A into the liquid-consuming device 500 will be described later in detail.

A2. Configuration of the Liquid Container

Figure 2:
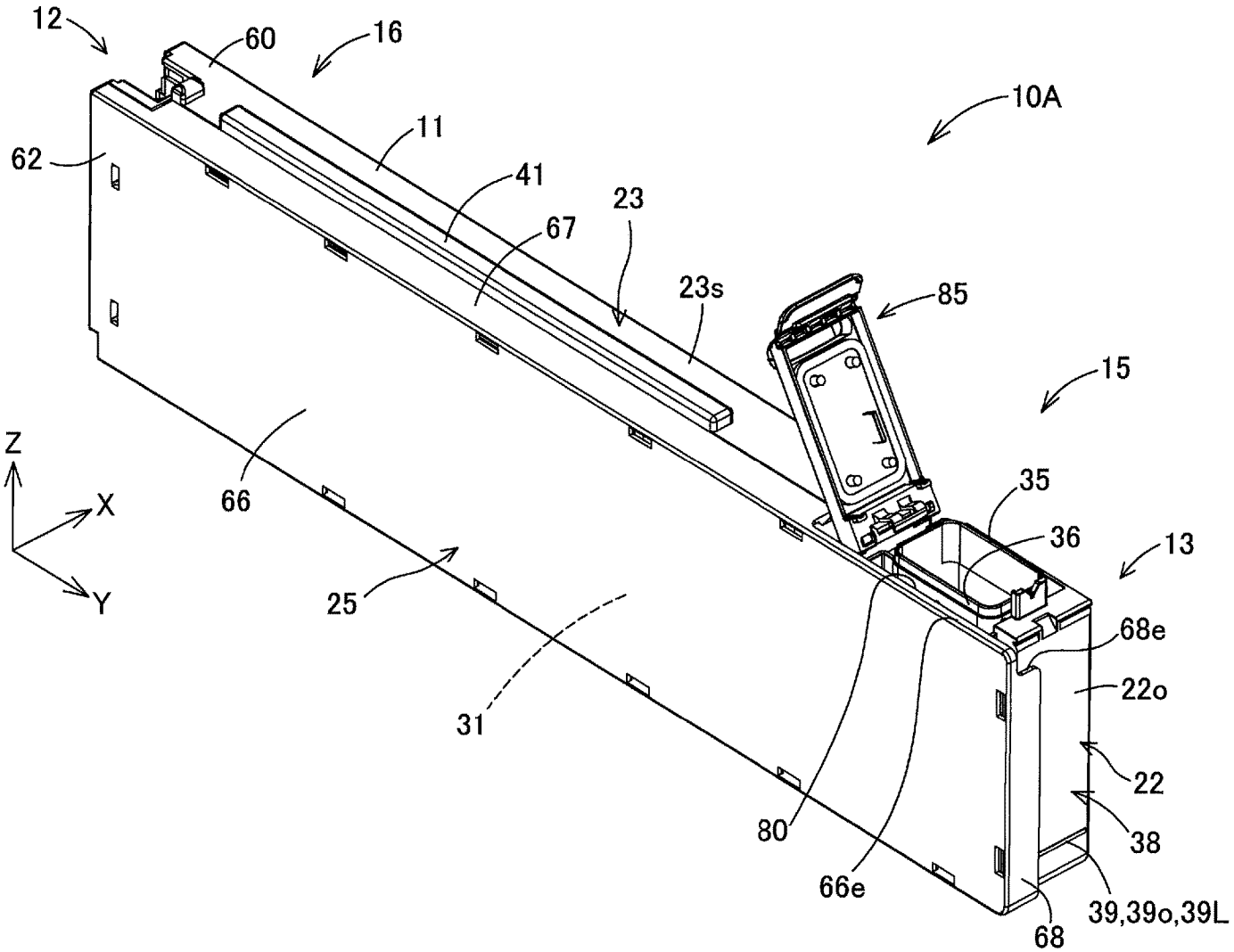
FIG. 2 is a first schematic perspective view of a liquid container according to a first embodiment.
Figure 3:
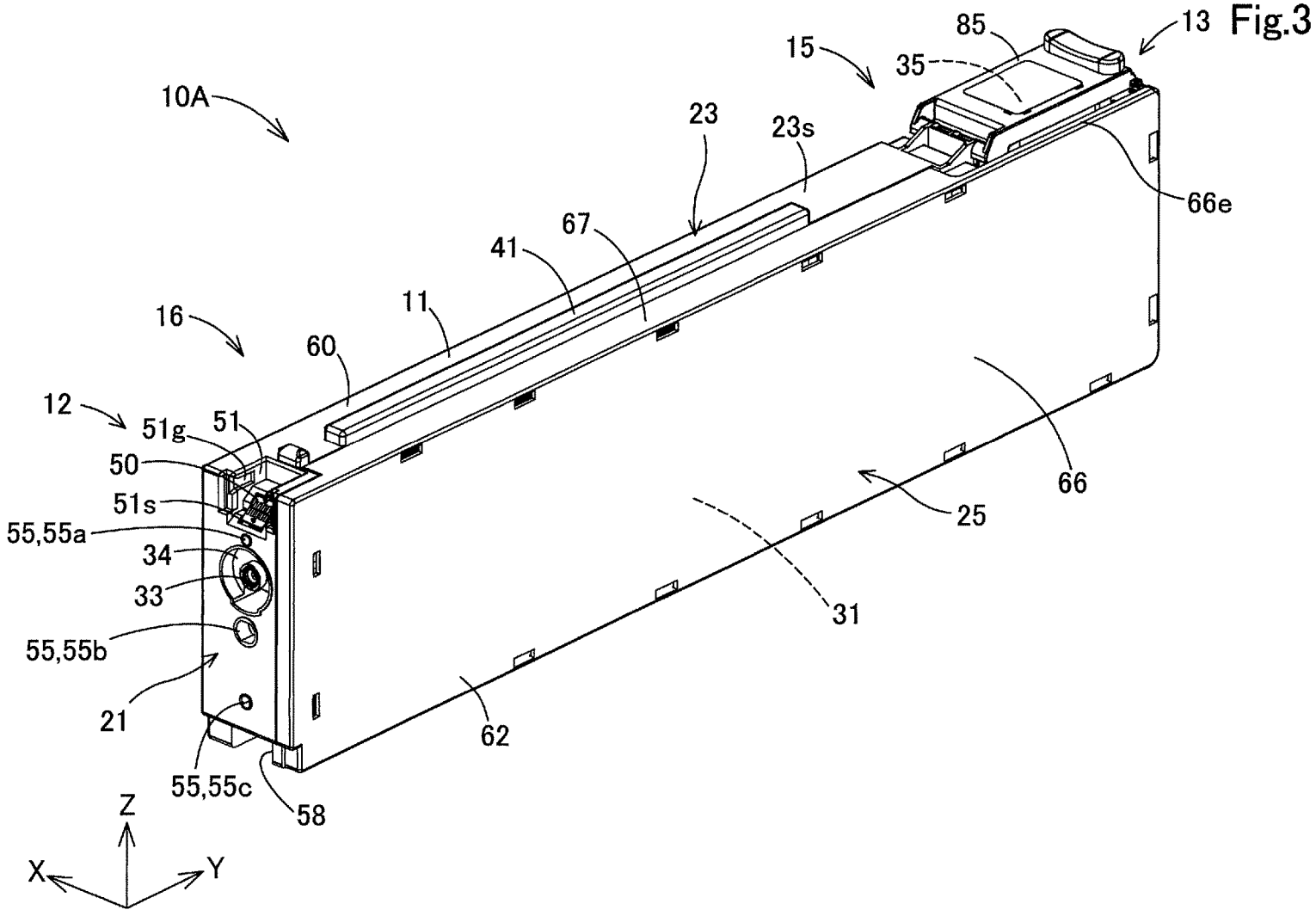
FIG. 3 is a second schematic perspective view of the liquid container according to the first embodiment.
Figure 4:
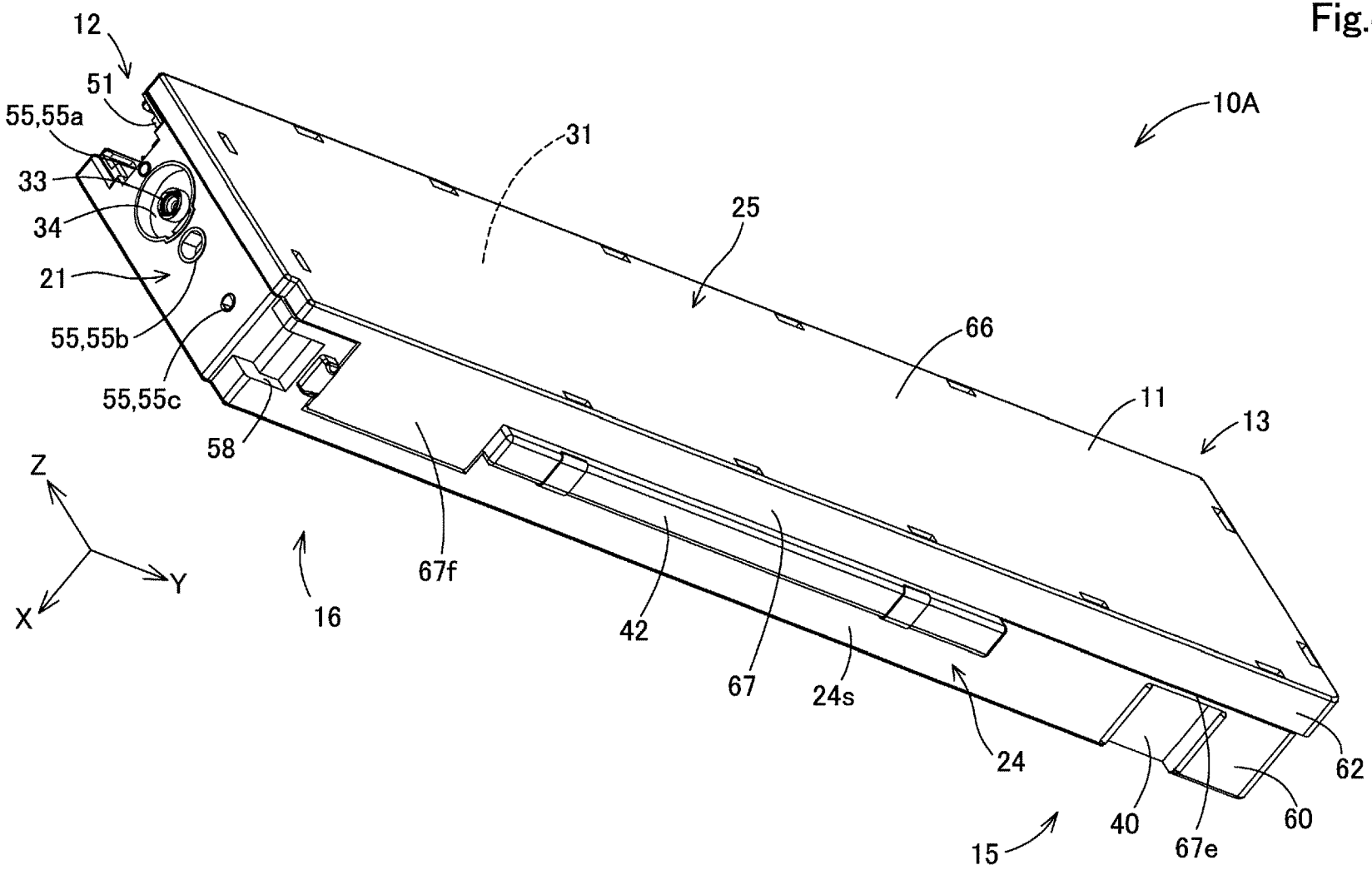
FIG. 4 is a third schematic perspective view of the liquid container according to the first embodiment.
Figure 5:
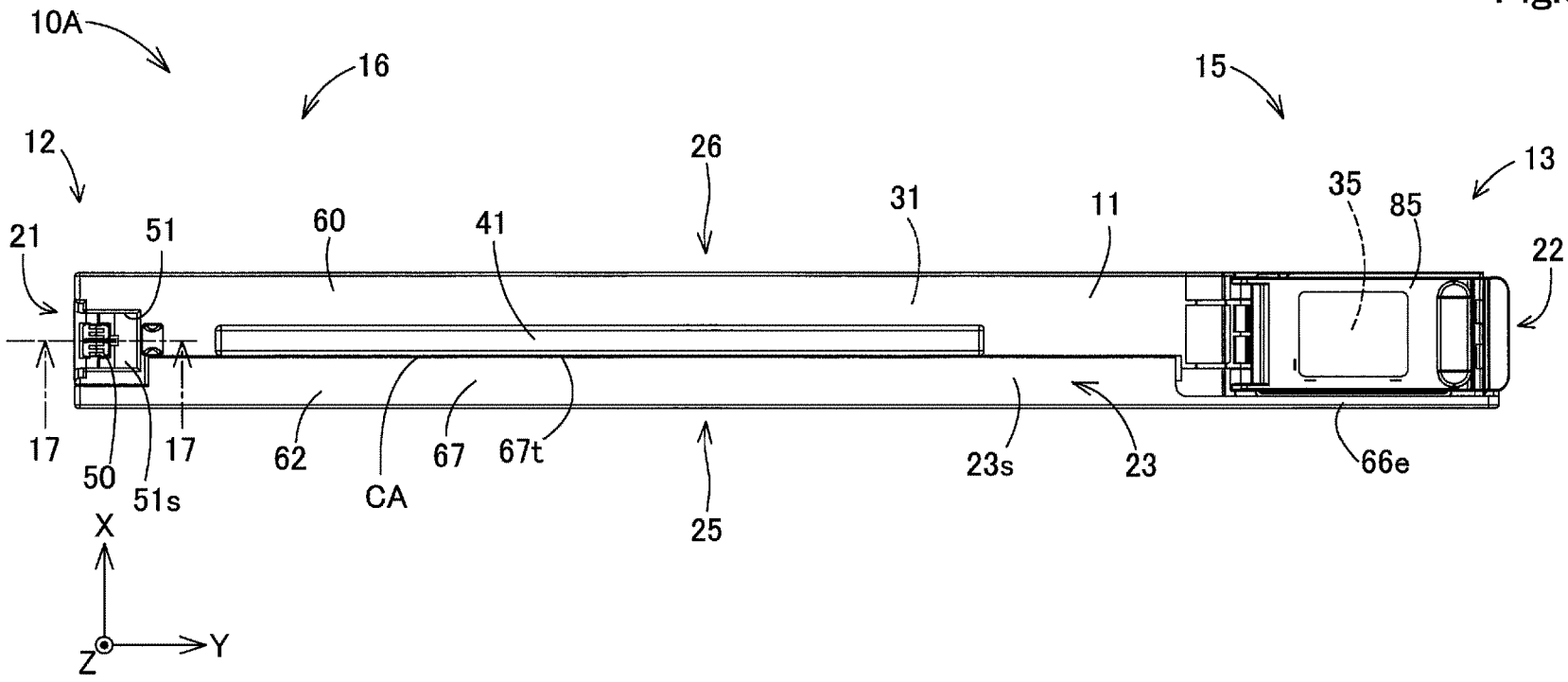
FIG. 5 is a schematic plane view of the liquid container according to the first embodiment.
Figure 6:
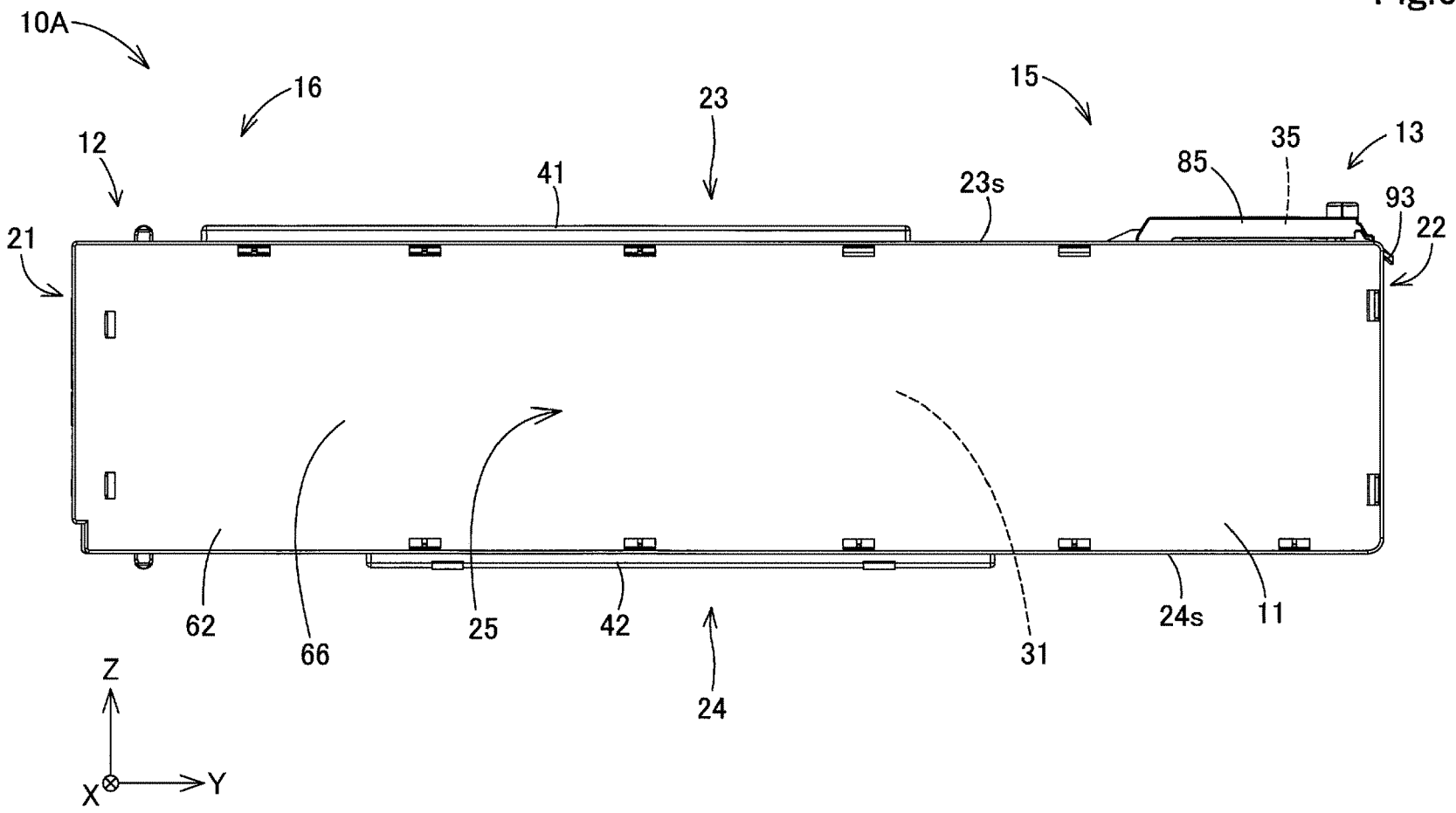
FIG. 6 is a schematic side view of the liquid container according to the first embodiment.
Figure 7:
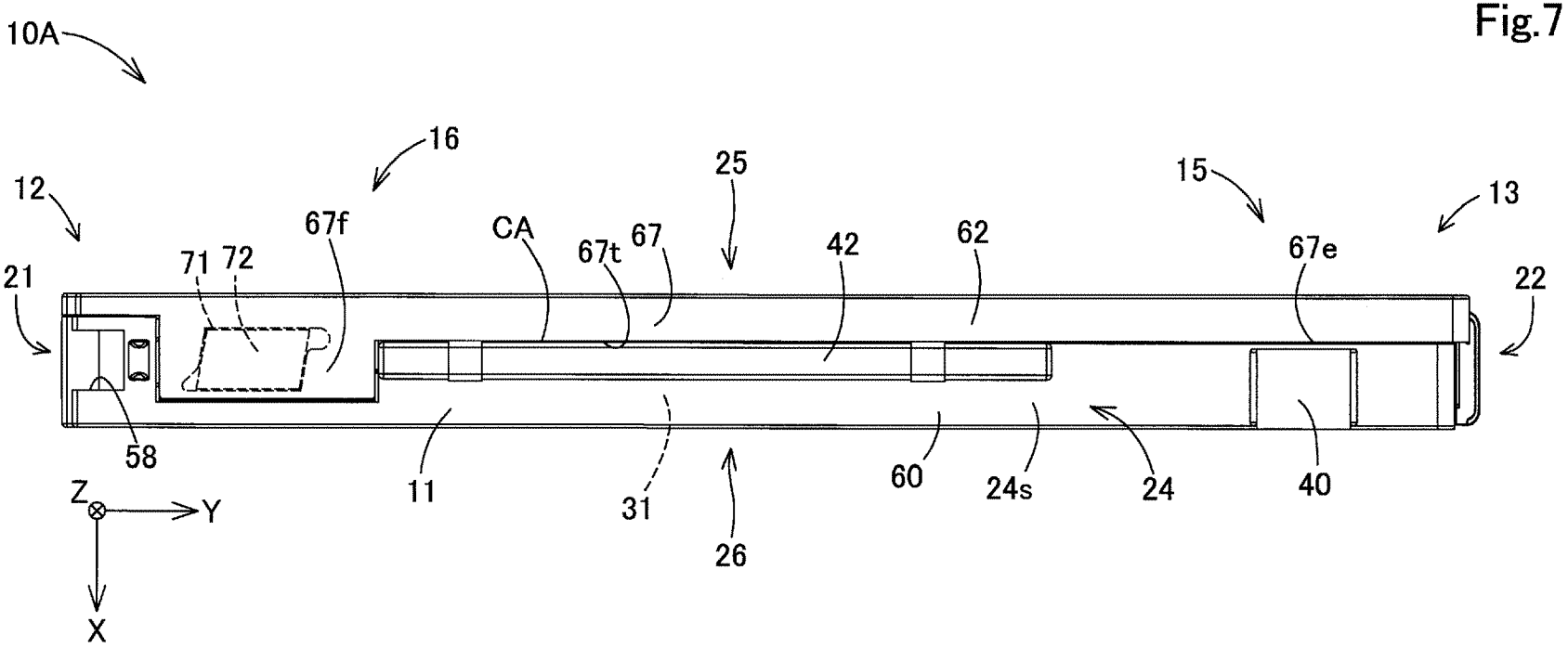
FIG. 7 is a schematic bottom view of the liquid container according to the first embodiment.
Figure 8:
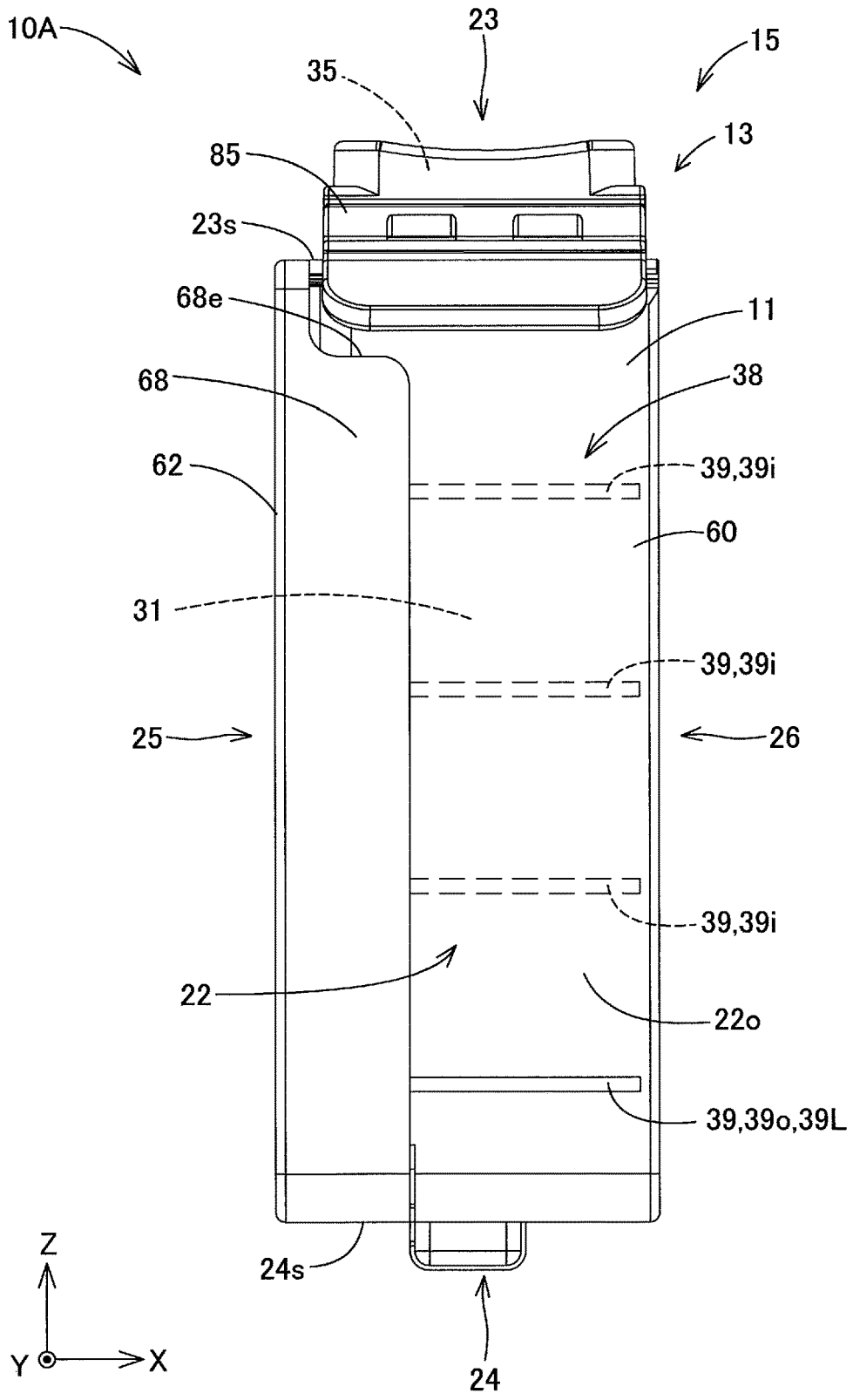
FIG. 8 is a schematic front view of the liquid container according to the first embodiment.
Figure 9:
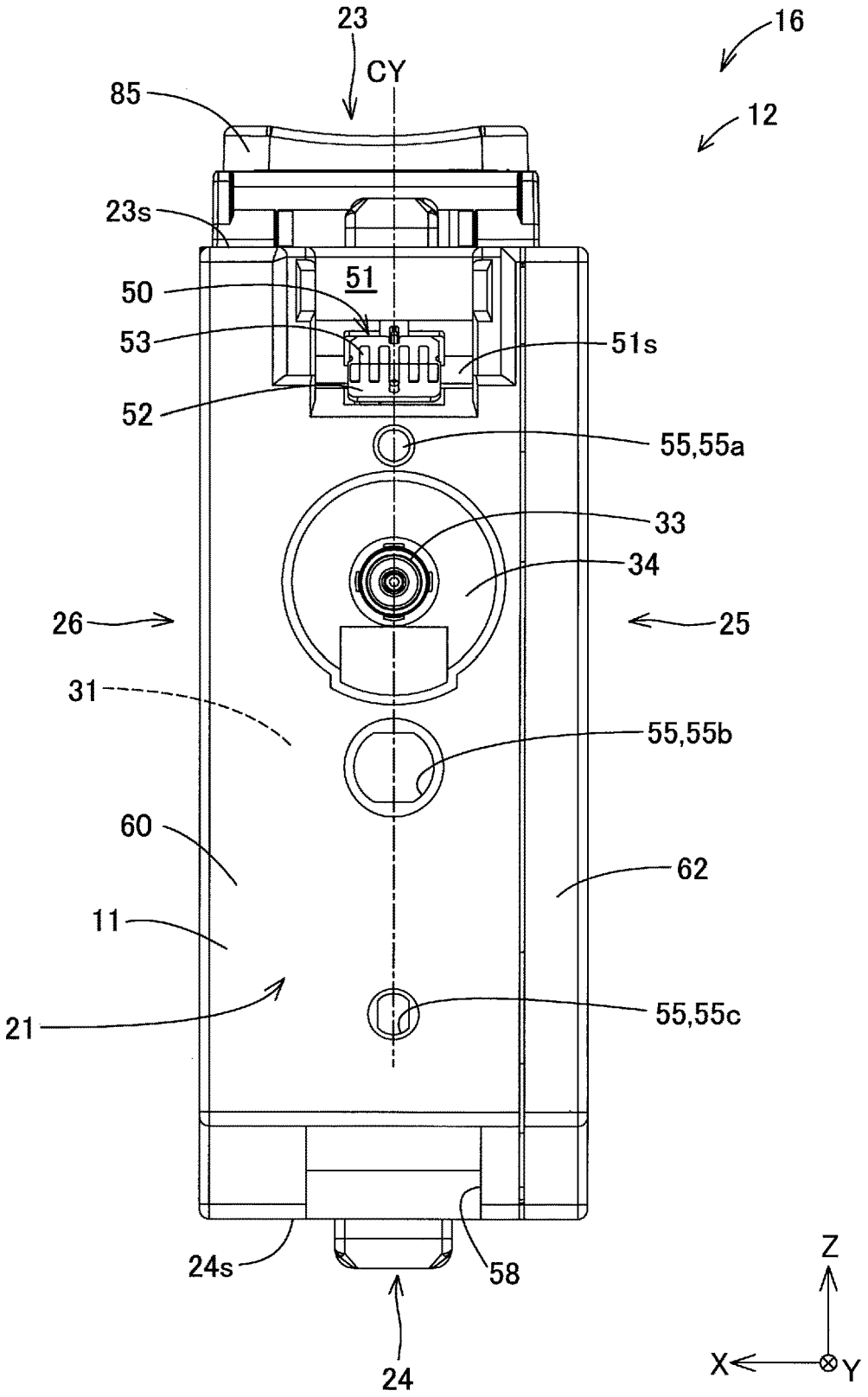
FIG. 9 is a schematic rear view of the liquid container according to the first embodiment.

A2-1. Overview of External Configuration of the Liquid Container:

An external configuration of the liquid container 10A will be briefly described with reference to FIGS. 2 to 9. FIG. 2 is a schematic perspective view of the liquid container 10A as seen from the +Y direction side and the +Z direction side. FIG. 3 is a schematic perspective view of the liquid container 10A as seen from the −Y direction side and the +Z direction side. FIG. 4 is a schematic perspective view of the liquid container 10A as seen from the −Y direction side and the −Z direction side. FIG. 5 is a schematic plane view of the liquid container 10A as seen in the −Z direction. FIG. 6 is a schematic side view of the liquid container 10A as seen in the +X direction. FIG. 7 is a schematic bottom view of the liquid container 10A as seen in the +Z direction. FIG. 8 is a schematic front view of the liquid container 10A as seen in the −Y direction. FIG. 9 is a schematic rear view of the liquid container 10A as seen in the +Y direction. All the X, Y, and Z directions are described herein with reference to the arranged posture of the liquid container 10A in the state of being loaded in the liquid-consuming device 500 in the normal use condition.

Figure 10:
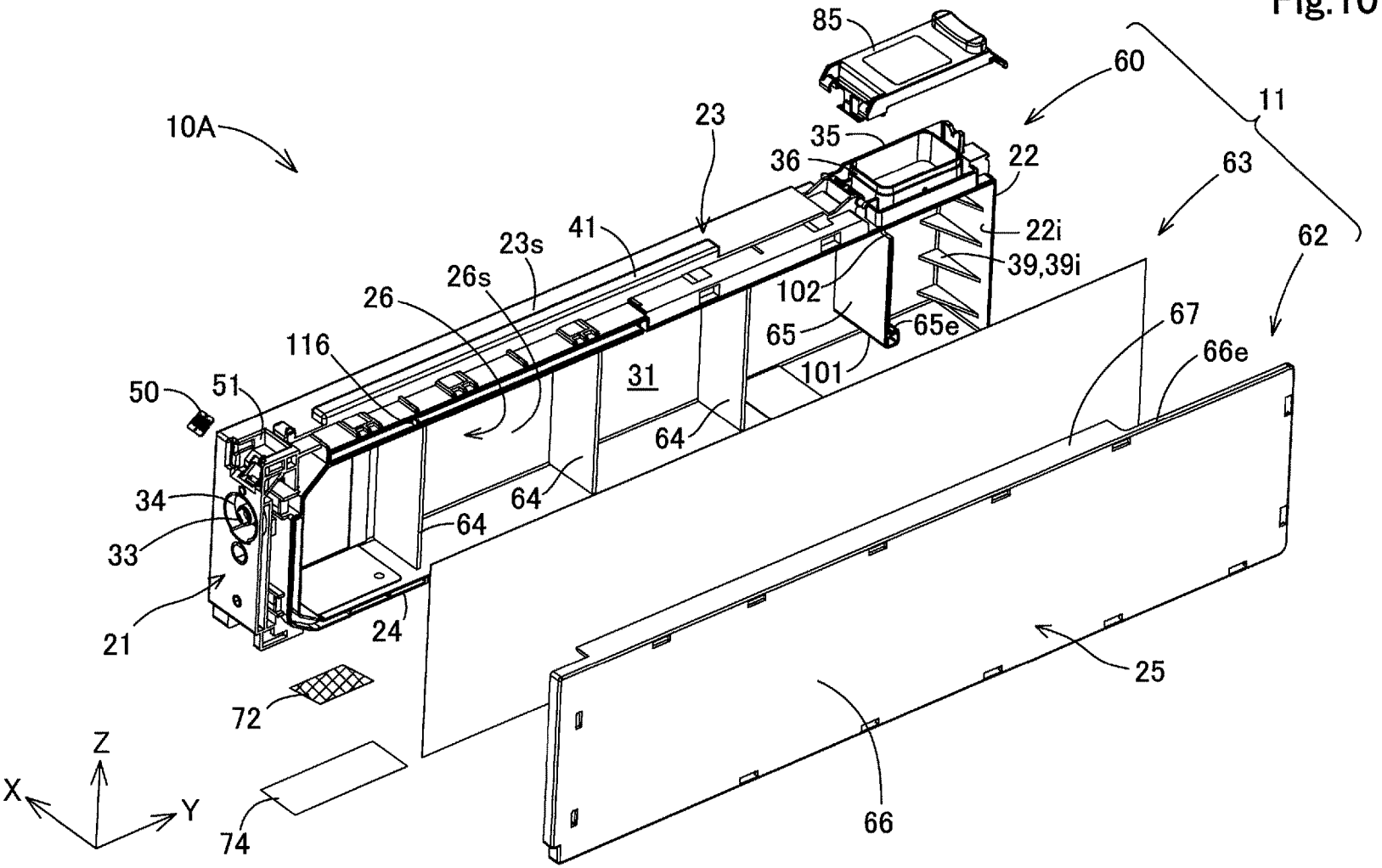
FIG. 10 is a schematic exploded perspective view of the liquid container according to the first embodiment.
Figure 11:
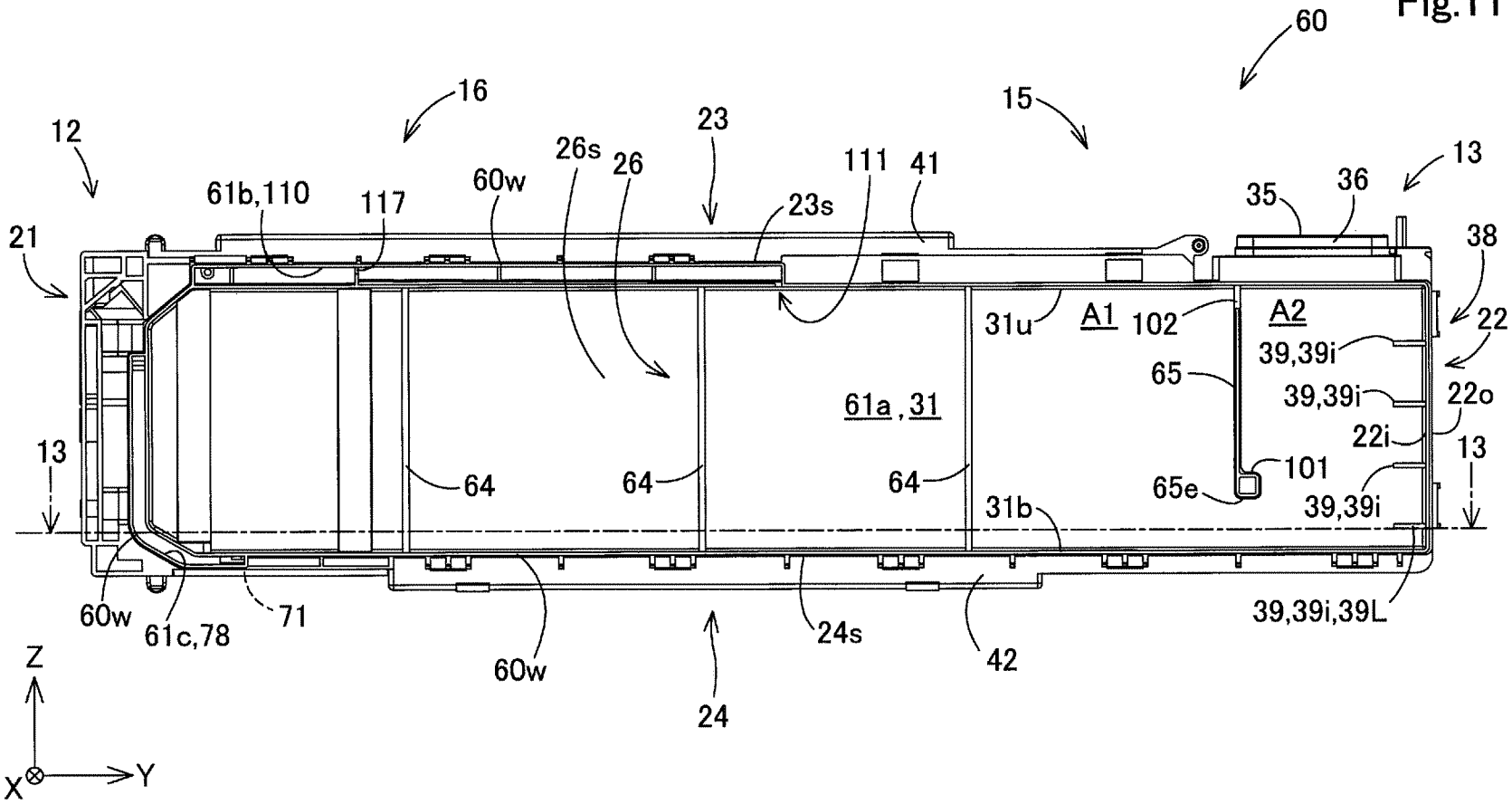
FIG. 11 is a schematic side view of an opening housing member.
Figure 12:
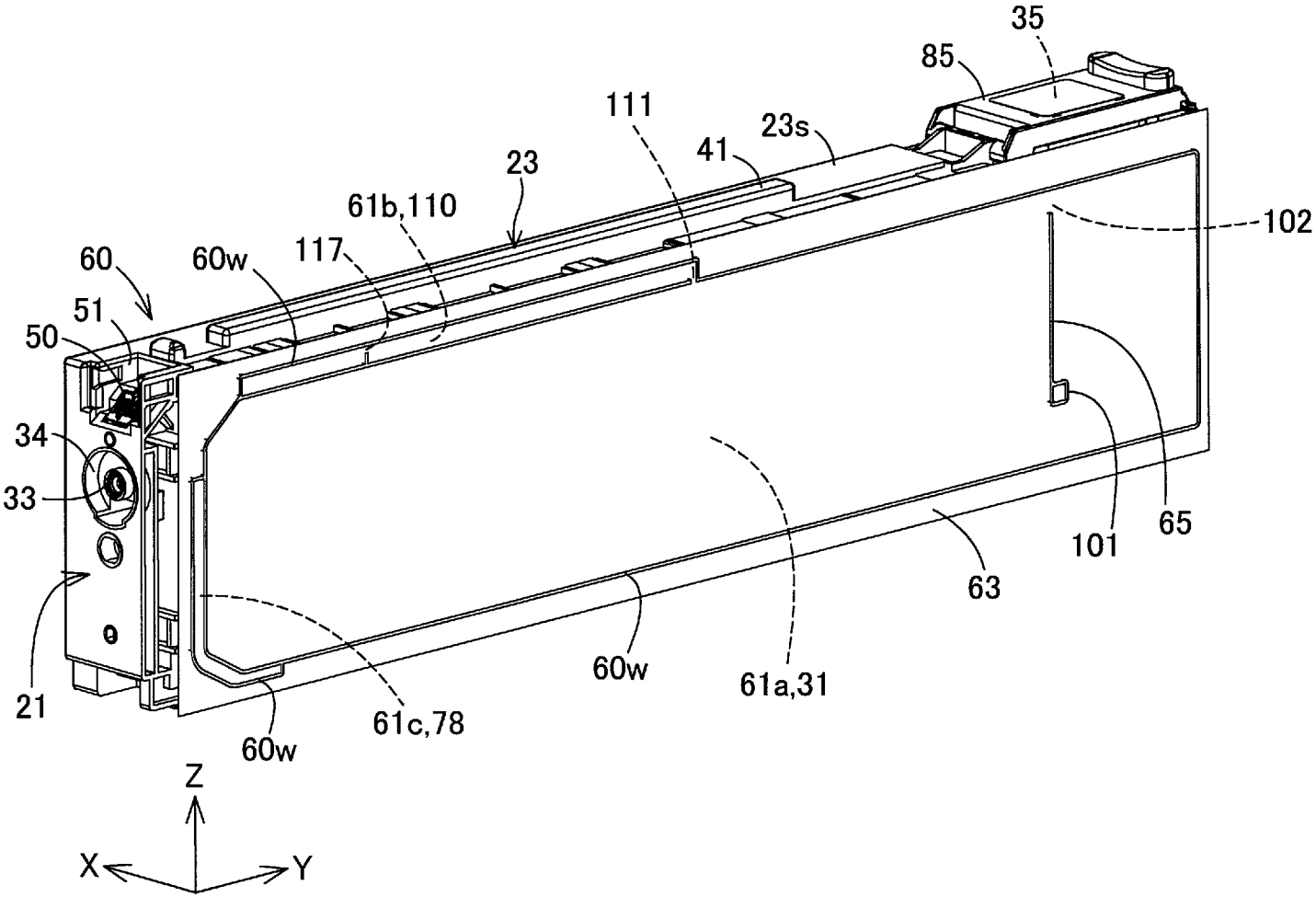
FIG. 12 is a schematic perspective view of the opening housing member to which a film member is welded.

A2-1-1. Wall Parts of the Container Main Body:

The liquid container 10A has a container main body 11 that has internally a containment chamber 31 containing the liquid. In FIGS. 2 to 9, the position of the containment chamber 31 is shown by a broken line and a reference sign for the sake of convenience. The containment chamber 31 is illustrated in FIGS. 10 to 12 that will be referred to later.

The container main body 11 has a shape in which the longitudinal direction is the Y direction along the insertion direction. That is, the container main body 11 is longer as seen from the Y direction than as seen from the X and Z directions. See FIGS. 2 to 4. In the first embodiment, the container main body 11 is shaped in an almost rectangular parallelepiped, and has a length as seen from the Y direction that is larger than a width as seen from the X direction and a height as seen from the Z direction. See FIGS. 8 and 9. The container main body 11 has the width as seen from the X direction that is smaller than the height as seen from the Z direction. The container main body 11 is formed from a resin member of polypropylene (PP), for example.

See FIGS. 2 to 7. The container main body 11 has a first end 12 and a second end 13 that are lengthwise ends. The first end 12 is an end positioned on the insertion direction side, that is, the −Y direction side. The second end 13 is an end positioned on the opposite side of the insertion direction, that is, the +Y direction side.

The container main body 11 has a first region 15 and a second region 16 as shown in FIGS. 2 to 7. See FIG. 1. When the liquid container 10A is in the loaded state, the first region 15 is exposed to the outside of the liquid-consuming device 500 and is positioned closer to the +Y direction side than the container insertion opening 521. When the liquid container 10A is in the loaded state, the second region 16 is stored in the liquid-consuming device 500 and is positioned closer to the −Y direction side than the container insertion opening 521. The first end 12 is included in the second region 16 and the second end 13 is included in the first region 15.

The container main body 11 has six wall parts 21 to 26 described below as a plurality of wall parts. The wall surfaces of the "wall parts" here may not be flat but may be curved or have concave portions, convex portions, steps, grooves, bent portions, inclined surfaces, holes, slits, and others. In the following description, the "crossing" of the wall parts means that the wall surfaces of the wall parts actually cross each other, or the extension surface of the wall surface of one wall part crosses the wall surface of the other wall part, or the extension surfaces of the wall surfaces of two wall parts cross each other. The crossing wall parts may have a chamfered portion constituting a curved surface or the like intervened therebetween.

See FIGS. 3 to 7 and 9. The first wall part 21 is a front-end wall part that is positioned on the insertion direction side of the containment chamber 31 and has an outer wall surface oriented in the insertion direction. See FIGS. 2 and 8. The second wall part 22 is a rear-end wall part that is positioned on the opposite side of the first wall part 21 with the containment chamber 31 therebetween as seen in the insertion direction and has an outer wall surface 22*o* oriented in the direction opposite to the insertion direction. As illustrated in FIGS. 10 and 11 that will be referred to later, an inner wall surface 22*i* of the second wall part 22 on the opposite side of the outer wall surface 22*o* faces the containment chamber 31.

See FIGS. 2, 3, and 5. A third wall part 23 is an upper-surface wall part that crosses the first wall part 21 and the second wall part 22 at both ends as seen in the Y direction. The third wall part 23 has an upper wall surface 23*s*. The upper wall surface 23*s* constitutes an outer wall surface of the liquid container 10A along the insertion direction, which is positioned above the containment chamber 31 and faces upward.

See FIGS. 4, 6, and 7. The fourth wall part 24 is a bottom-surface wall part that crosses the first wall part 21 and the second wall part 22 at the both ends as seen in the Y direction, and is opposed to the third wall part 23 with the containment chamber therebetween in the Z direction. The "opposed" state here includes the state in which opposite objects face directly each other and the state in which opposed objects face indirectly each other with another object intervened therebetween. The fourth wall part 24 has a bottom wall surface 24*s*. The bottom wall surface 24*s* constitutes an outer wall surface of the liquid container 10A along the insertion direction, which is positioned under the containment chamber 31 and faces downward.

See FIGS. 2 and 8. The fifth wall part 25 is a left-side wall part that is positioned on the left side of the containment chamber 31 as the liquid container 10A is seen in the insertion direction. See FIGS. 2 and 3. The fifth wall part 25 crosses the first wall part 21, the second wall part 22, the third wall part 23, and the fourth wall part 24.

See FIGS. 5, 7, and 8. The sixth wall part 26 is a right-side wall surface that is positioned on the right side of the containment chamber 31 as the liquid container 10A is seen in the insertion direction. The sixth wall part 26 crosses the first wall part 21, the second wall part 22, the third wall part 23, and the fourth wall part 24, and is opposed to the fifth wall part 25 with the containment chamber 31 therebetween as seen in the X direction.

A2-1-2. Liquid Outlet:

See FIGS. 3, 4, and 9. The liquid container 10A has a liquid outlet 33. In the loaded state, the liquid outlet 33 is connected to the liquid-consuming device 500 to flow the liquid from the containment chamber 31 into the liquid-consuming device 500. The liquid outlet 33 is provided on the first end 12 side of the container main body 11 as seen in the insertion direction. The liquid outlet 33 is open in the first wall part 21 as seen in the insertion direction. The liquid outlet 33 is provided in a concave portion 34 that is recessed in the +Y direction at the first wall part 21. Hereinafter, the concave portion 34 will also be called "outlet storage concave portion 34". The configuration of a liquid flow path provided in the container main body 11 to connect the containment chamber 31 and the liquid outlet 33 and the function of the outlet storage concave portion 34 will be described later.

A2-1-3. Liquid Inlet:

See FIGS. 2, 3, and 5. The liquid container 10A has a liquid inlet 35. FIG. 2 illustrates the state in which a lid member 85 is open to release the liquid inlet 35, and FIG. 3 illustrates the state in which the lid member 85 is closed to block the liquid inlet 35. In FIGS. 3 and 5, the position of the liquid inlet 35 is shown by a broken line and a reference sign.

The liquid inlet 35 communicates with the containment chamber 31. The liquid inlet 35 accepts injection of the liquid by the user from the outside of the container main body 11 into the containment chamber 31. The liquid inlet 35 is provided on the second end 13 side of the container main body 11 as seen in the insertion direction. The liquid inlet 35 is provided on the third wall part 23 as upper-surface wall part, closer to the second wall part 22 as rear-end wall part than the first wall part 21 as front-end wall part. The periphery of the liquid inlet 35 is surrounded by an inlet surrounding wall portion 36. The inlet surrounding wall portion 36 is a cylindrical wall part that projects upward from the third wall part 23.

See FIG. 1. In the loaded state, the liquid inlet 35 is positioned on the first region 15 exposed to the outside of the liquid-consuming device 500. Accordingly, the user is able to recharge the liquid into the liquid container 10A that remains loaded in the liquid-consuming device 500. The configuration of periphery of the liquid inlet 35 including the lid member 85 and the injection of the liquid by the user into the liquid inlet 35 will be described later.

A2-1-4. Visual Recognition Portion:

See FIGS. 2 and 8. The liquid container 10A has a visual recognition portion 38 on the second wall part 22 as rear-end wall part. The visual recognition portion 38 is see-through so that the user is able to recognize visually the position of the liquid surface of the liquid contained in the containment chamber 31 from the outside of the container main body 11. In the container main body 11, at least the second wall part 22 with the visual recognition portion 38 is formed from a translucent member with light permeability to the extent that the liquid surface of the liquid in the containment chamber 31 is visually recognized. In the liquid container 10A, the second wall part 22 may be formed from a transparent member. In the liquid container 10A, the entire container main body 11 may be formed from such a light-permeable member. The visual recognition portion 38 is provided with scale marks 39 as indexes for the amount of the liquid contained in the containment chamber 31. The scale marks 39 will be described later in detail.

According to the liquid container 10A, the user is able to check the amount of the liquid contained in the containment chamber 31 through the visual recognition portion 38 provided in the first region 15 exposed to the outside of the liquid-consuming device 500 in the loaded state. This prevents the liquid in the liquid container 10A from becoming short during the driving of the liquid-consuming device 500. In addition, the user is able to inject the liquid from the liquid inlet 35 while checking the amount of the liquid contained in the containment chamber 31 through the visual recognition portion 38.

A2-1-5. Handhold Portion:

See FIGS. 4 and 7. The liquid container 10A has a handhold portion 40 on the fourth wall part 24 as bottom-surface wall part. The handhold portion 40 is a region to be hand-held by the user to load or unload the liquid container 10A into or from the liquid-consuming device 500. In the first embodiment, the handhold portion 40 is formed as a concave portion in which the user is allowed to put fingers. The handhold portion 40 is positioned closer to the second wall part 22 than the first wall part 21 as seen in the insertion direction. In the loaded state, the handhold portion 40 is positioned in the first region 15 exposed to the outside of the liquid-consuming device 500. Accordingly, the user touch easily the handhold portion 40 to detach the liquid container 10A from the liquid-consuming device 500.

A2-1-6. Rail Portion:

See FIGS. 2, 3, and 5. The upper wall surface 23*s* of the third wall part 23 in the liquid container 10A has a rail portion 41. The rail portion 41 is formed as a convex portion extending linearly along the insertion direction. The rail portion 41 projects from the central region in the X direction of the upper wall surfaces 23*s*. The X direction is equivalent to the width direction orthogonal to the insertion direction.

The "center" here refers to a substantially central position, and the "central region" refers to a region that is separated to some extent from the both ends. When the width of the upper wall surface 23*s* as seen in the X direction is designated as x, the rail portion 41 may be formed in an area of the upper wall surface 23*s* centered on the center of the upper wall surface 23*s* as seen in the X direction and having a width of 0.5·x or less as seen in the X direction. The width of the area as seen in the X direction is desirably 0.3·x or less, more desirably 0.2·x or less.

The length of the rail portion 41 as seen in the Y direction is half or more the length of the container main body 11 as seen in the Y direction. The rail portion 41 is positioned slightly closer to the first wall part 21 side in the insertion direction.

See FIGS. 4, 6, and 7. In the liquid container 10A, the bottom wall surface 24*s* of the fourth wall part 24 also has a rail portion 42. Hereinafter, for the sake of differentiation, the rail portion 41 on the upper wall surface 23*s* will also be called "first rail portion 41", and the rail portion 42 on the bottom wall surface 24*s* will also be called "second rail portion 42". The second rail portion 42 projects in the central region in the X direction of the bottom wall surface 24*s*. The position in the X direction of the second rail portion 42 on the bottom wall surface 24*s* is similar to the position in the X direction of the first rail portion 41 on the upper wall surface 23*s*. The second rail portion 42 is provided at a position offset from the first rail portion 41 in the +Y direction as shown in FIG. 6.

An end of the first rail portion 41 on the −Y direction side is positioned closer to the −Y direction side than an end of the second rail portion 42 on the −Y direction side. Meanwhile, an end of the second rail portion 42 on the +Y direction side is positioned closer to the +Y direction side than an end of the first rail portion 41 on the +Y direction side. The length of the first rail portion 41 in the Y direction is larger than the length of the second rail portion 42 in the Y direction. See FIG. 7. A filter chamber wall 67*f*, which is described later, of a container lid member 62 is arranged on the −Y direction side of the second rail portion 42.

The rail portions 41 and 42 guide the movement of the liquid container 10A in the movement direction to load or unload the liquid container 10A into or from the liquid-consuming device 500. The rail portions 41 and 42 serve as regions to be hand-held by the user to grasp and carry the liquid container 10A. In addition, the rail portions 41 and 42 serve as reference regions for positioning the liquid container 10A to be assembled. The functions of the rail portions 41 and 42 will be described later in detail.

A2-1-7. Electrical Connection Portion:

See FIGS. 3, 5, and 9. The first end 12 of the liquid container 10A has an electrical connection portion 50 to be electrically connected to the liquid-consuming device 500. The controller 510 of the liquid-consuming device 500 acquires information about the liquid contained in the liquid container 10A by electrical signals received from the electrical connection portion 50. The "information about the liquid" includes the kind of the liquid, and the current amount of the liquid contained in the liquid container 10A, for example. The controller 510 also electrically detects the loaded state of the liquid container 10A in the liquid-consuming device 500.

Figure 17:
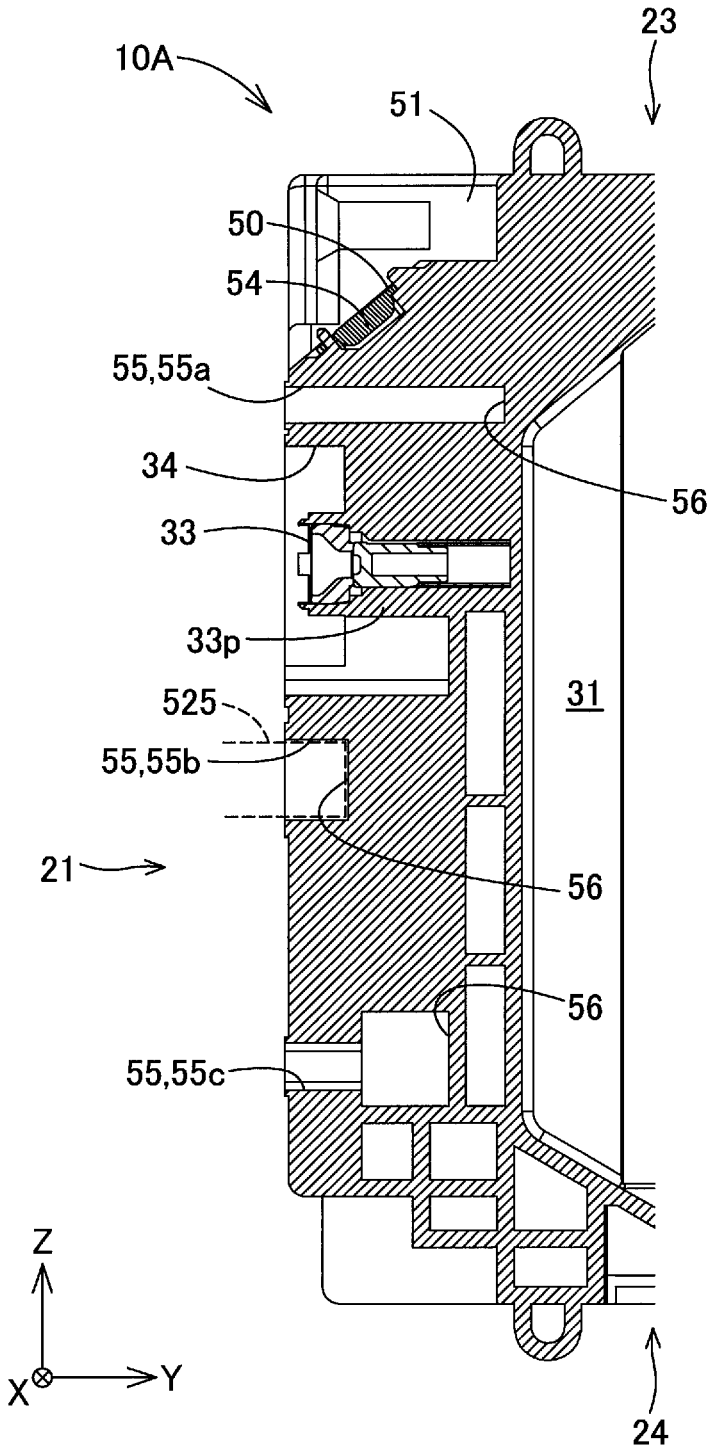
FIG. 17 is a schematic cross-sectional view of a first wall part.

See FIG. 9. The electrical connection portion 50 is provided above the liquid outlet 33. See FIG. 3. The electrical connection portion 50 is formed from a substrate and is arranged in a concave portion 51 at the corner between the first wall part 21 and the third wall part 23. The concave portion 51 has internally an inclined surface 51*s* oriented obliquely upward between the +Y direction and the +Z direction, and the electrical connection portion 50 is arranged on the inclined surface 51*s*. The electrical connection portion 50 is arranged such that a substrate surface 52 is oriented obliquely upward. See FIG. 9. A plurality of electrode plates 53 are arranged on the substrate surface 52 of the electrical connection portion 50. An electrical circuit portion 54 including a storage device to store the information about the liquid is provided on the back side of the substrate surface 52. The electrical circuit portion 54 is illustrated in FIG. 17 that will be referred to later.

When the liquid container 10A is loaded into the liquid-consuming device 500, a connection terminal 527, which is illustrated in FIG. 28 that will be referred to later, of the liquid-consuming device 500 biased downward by an elastic member comes into contact with the electrode plates 53 of the electrical connection portion 50 from above. At that time, the electrode plates 53 are subjected to +Y direction force for inserting the liquid container 10A into the liquid-consuming device 500 and −Z direction biasing force from the connection terminal 527. The forces of two directions enhance electrical connectivity of the electrical connection portion 50 to the liquid-consuming device 500. In addition, when the liquid container 10A is inserted into the liquid-consuming device 500, the connection terminal 527 of the liquid-consuming device 500 grazes the surfaces of the electrode plates 53 to remove foreign matter such as oil and dust from the electrode plates 53. This enhances electrical connectivity of the electrical connection portion 50 to the liquid-consuming device 500.

See FIG. 3. In the liquid container 10A, grooves 51*g* extending along the Y direction are provided in the side wall surfaces of the concave portion 51 sandwiching the electrical connection portion 50 in the X direction. When the liquid container 10A is loaded into the liquid-consuming device 500, convex portions, which are not illustrated, included in the liquid supply portion 520 of the liquid-consuming device 500 are inserted into the grooves 51*g*. This suppresses the displacement of the electrical connection portion 50 of the liquid container 10A from the connection terminal 527 of the liquid-consuming device 500.

The electrical connection portion 50 is provided at the end opposite to the liquid inlet 35 in the Y direction that is the longitudinal direction of the liquid container 10A, which suppresses adhesion of the liquid spilling out of the liquid inlet 35. The electrical connection portion 50 is provided above the liquid outlet 33, which suppresses adhesion of the liquid dripped from the liquid outlet 33 to the electrical connection portion 50. The electrical connection portion 50 is provided in the concave portion 51. Accordingly, while the liquid container 10A is detached from the liquid-consuming device 500, it leads to suppress the user's touch on the electrode plates 53 and the breakage of the electrical connection portion 50 if the liquid container 10A falls.

A2-1-8. Other Constituent Elements of the First Wall Part:

See FIGS. 3, 4, and 9. The first wall part 21 of the liquid container 10A has a plurality of concave portions 55. The concave portions 55 are bottomed holes that are recessed in the +Y direction. In the first embodiment, as the plurality of concave portions 55, three concave portions 55*a*, 55*b*, and 55*c* are provided as shown is FIG. 9. The first concave portion 55*a* is provided between the electrical connection portion 50 and the liquid inlet 35. The second concave portion 55*b* is provided under the liquid outlet 33. The third concave portion 55*c* is provided under the second concave portion 55*b*. When the liquid container 10A is loaded into the liquid-consuming device 500, the second concave portion 55*b* serves as a positioning portion that defines the position of the liquid container 10A.

A concave portion 58 opening in the −Y direction and the −Z direction is provided at the corner between the first wall part 21 and the fourth wall part 24. When the liquid container 10A is loaded into the liquid-consuming device 500, the concave portion 58 stores an identification member 528 provided in the liquid-consuming device 500. The identification member 528 is illustrated in FIG. 28 that will be referred to later. The configurations and functions of the concave portions 55 and 58 will be described later in detail.

A2-2. Overview of Assembly Structure and Internal Configuration of the Liquid Container:

The assembly structure and internal configuration of the liquid container 10A will be described with reference to FIGS. 10 to 12. FIG. 10 is a schematic exploded perspective view of the liquid container 10A. FIG. 11 is a schematic side view of an opening housing member 60 as seen in the +X direction. FIG. 12 is a schematic perspective view of the opening housing member 60 to which a film member 63 is welded.

The container main body 11 of the liquid container 10A is formed from the opening housing member 60, the container lid member 62, and the film member 63 as shown in FIG. 10. See FIGS. 10 and 11. The opening housing member 60 is a box-like member in the shape of an almost rectangular parallelepiped, which is open in the −X direction crossing the insertion direction.

See FIGS. 10 and 11. The opening housing member 60 has wall parts constituting the first wall part 21, the second wall part 22, the third wall part 23, the fourth wall part 24, and the sixth wall part 26 of the liquid container 10A. The liquid outlet 33, the liquid inlet 35, the concave portion 51 in which the electrical connection portion 50 is arranged, the rail portions 41 and 42, the handhold portion 40, and the plurality of concave portions 55 described above are provided in the opening housing member 60.

See FIG. 11. The opening housing member 60 has three concave portions 61*a*, 61*b*, and 61*c* that are recessed in the +X direction and open in the −X direction. The first concave portion 61*a* is open in the direction crossing the insertion direction between the wall part constituting the third wall part 23 as upper-surface wall part and the wall part constituting the fourth wall part 24 as bottom-surface wall part. The internal space in the first concave portion 61*a* constitutes the containment chamber 31. In the following description, the first concave portion 61*a* will also be called "containment chamber concave portion 61*a*". The internal space in the containment chamber concave portion 61*a* is almost rectangular parallelepiped in shape. The internal space in the containment chamber concave portion 61*a* is formed over almost the entire opening housing member 60. The containment chamber 31 is extended in the container main body 11 along the longitudinal direction of the container main body 11 by the containment chamber concave portion 61*a*.

See FIGS. 10 and 11. The containment chamber concave portion 61*a* has internally a plurality of reinforcement walls 64. The reinforcement walls 64 serve as ribs that suppress the deformation of the wall parts of the opening housing member 60. In the first embodiment, three reinforcement walls 64 are provided. The reinforcement walls 64 extend in the containment chamber concave portion 61*a* along the Z direction. The "extending" here means the state in which something extends in a direction without intermittence. The reinforcement walls 64 are aligned in the containment chamber concave portions 61 in the Y direction at predetermined intervals.

The reinforcement walls 64 are coupled to the wall part constituting the third wall part 23, the wall part constituting the fourth wall part 24, and the wall part constituting the sixth wall part 26. The end surfaces of the reinforcement walls 64 on the −X direction side are positioned closer to the +X direction side than the end surfaces of the wall parts constituting the first wall part 21, the second wall part 22, the third wall part 23, and the fourth wall part 24 on the −X direction side. The end surfaces of the reinforcement walls 64 on the −X direction side are not welded to the film member 63 as shown in FIG. 12. In the liquid container 10A, there is space between the entire end surfaces of the reinforcement walls 64 on the −X direction side and the film member 63 to distribute the liquid in the containment chamber 31 in the Y direction. In the liquid container 10A, the end surfaces of the reinforcement walls 64 on the −X direction side may have a concave portion that is recessed to the +X direction side, and the regions of the end surfaces of the reinforcement walls 64 on the −X direction side other than the concave portions may be welded to the film member 63. In this configuration, the concave portions serve as a flow path for distributing the liquid in the containment chamber 31.

See FIGS. 10 and 11. The containment chamber concave portion 61*a* has an inner wall 65. The inner wall 65 droops downward from an upper surface 31*u* to a bottom surface 31*b* of the containment chamber 31 and has a lower end 65*e* positioned between the upper surface 31*u* and the bottom surface 31*b* of the containment chamber 31. The inner wall 65 extends entirely in the containment chamber concave portion 61*a* in the X direction. An end of the inner wall 65 on the +X direction side is coupled to an inner wall surface 26*s* as a wall surface of the sixth wall part 26 on the containment chamber 31 side. An end of the inner wall 65 on the −X direction side is welded and coupled to the film member 63, which is shown in FIG. 10, constituting an inner wall surface of the containment chamber 31 on the −X direction side.

See FIG. 11. The internal space in the containment chamber concave portion 61*a*, that is, the containment chamber 31 is divided into two areas A1 and A2 adjacent to each other in the insertion direction with the inner wall 65 therebetween. The inner wall 65 is positioned closer to the second wall part 22 than the first wall part 21 as seen in the insertion direction. The inner wall 65 is positioned closer to the insertion direction side than the liquid inlet 35. In the first embodiment, the inner wall 65 droops from the upper surface 31*u* of the containment chamber 31 below the inlet surrounding wall portion 36 positioned on the insertion direction side of the liquid inlet 35. The configuration and function of the inner wall 65 will be described later in detail. The plurality of reinforcement walls 64 are provided in the area A1 on the −Y direction side of the inner wall 65.

The internal space in the second concave portion 61*b* constitutes an air introduction portion 110 that is a path for introducing external air into the containment chamber 31. The second concave portion 61*b* is provided above the containment chamber concave portion 61*a*. The Z direction width of the second concave portion 61*b* is significantly smaller than the Z direction width of the containment chamber concave portion 61*a*. The second concave portion 61*b* extends from the center of the containment chamber 31 toward the first wall part 21 in the Y direction. The air introduction portion 110 formed by the second concave portion 61*b* will be described later in detail.

The third concave portion 61*c* constitutes part of an outlet flow path 78 that is a liquid flow path the connecting a filter chamber 71 and the liquid outlet 33. In FIG. 11, the liquid outlet 33 and the filter chamber 71 are hidden from view and thus their positions are shown by broken lines and reference signs. The configuration of the filter chamber 71 will be described later. The third concave portion 61*c* extends in the +Z direction from the lower end area of the end of the containment chamber concave portion 61*a* on the −Y direction side, then turns to the +Z direction along the corner of the containment chamber concave portion 61*a*, and then reaches the liquid outlet 33.

See FIG. 12. Openings in the three concave portions 61*a*, 61*b*, and 61*c* of the opening housing member 60 are blocked in common by the film member 63. The film member 63 is formed from a material with flexibility, gas barrier property, and liquid impermeability. The film member 63 is formed from a resin film of polyethylene-terephthalate (PET), nylon, or polyethylene, for example.

The film member 63 is welded to end surfaces of a wall portion 60*w* surrounding the three concave portions 61*a*, 61*b*, and 61*c* of the opening housing member 60 as shown in FIG. 12. The wall portion 60*w* protrudes in the −X direction and has the end surfaces aligned in the −X direction. The film member 63 is welded to the end surfaces of the inner wall 65 on the −X direction sides. The end surfaces of the wall portion 60*w* as seen in the −X direction and the end surface of the inner wall 65 as seen in the −X direction align with each other as seen in the −X direction.

In the liquid container 10A of the first embodiment, the film member 63 is welded to the opening housing member 60 to form simply the space constituting the containment chamber 31, the air introduction portion 110, and the outlet flow path 78 in the container main body 11. In the liquid container 10A, welding the film member 63 enhances the liquid-sealing property of the containment chamber 31. The use of the lightweight and thin film member 63 achieves reduction in the weight and size of the liquid container 10A.

In the liquid container 10A, the film member 63 welded to the opening housing member 60 is covered with the container lid member 62 as shown in FIG. 10. The container lid member 62 has a main body wall 66 and two peripheral walls 67 and 68. The main body wall 66 is an almost rectangular flat plate-like region that constitutes the fifth wall part 25 of the container main body 11.

See FIG. 10. The first peripheral wall 67 constitutes an edge portion that is provided at upper and lower ends of the main body wall 66 and protrudes in a roof-like shape in the +X direction. In FIG. 10, the peripheral wall 67 provided at the lower end of the main body wall 66 is hidden from view. The peripheral walls 67 extend along the insertion direction that is the −Y direction. See FIGS. 5 and 7. When the container lid member 62 is attached to the opening housing member 60, the peripheral walls 67 are arranged on the outer wall surface of the opening housing member 60 to constitute part of the third wall part 23 and the fourth wall part 24 of the container main body 11. As described later in detail, the peripheral walls 67 serve as positioning portions for positioning the container lid member 62 to the opening housing member 60.

See FIG. 2. The second peripheral wall 68 constitutes an edge that is provided at an end of the main body wall 66 on the +Y direction side and protrudes in a roof-like shape to the +X direction. The lower end of the peripheral wall 68 on the −Z direction side is coupled to the end of the first peripheral wall 67 on the +Y direction side provided at the lower end of the main body wall 66. When the container lid member 62 is attached to the opening housing member 60, the peripheral wall 68 is arranged on the outer wall surface of the opening housing member 60 to constitute part of the second wall part 22 of the container main body 11. An upper end 68*e* of the peripheral wall 68 on the +Z direction side is positioned closer to the −Z direction side than the upper end of the second wall part 22. The reason for this will be described later.

See FIG. 10. The main body wall 66 of the container lid member 62 has an outer peripheral end 66*e* that is an end extending linearly along the Y direction on the +Y direction side of the peripheral wall 67 provided at the upper end of the main body wall 66. See FIG. 2. When the container lid member 62 is attached to the opening housing member 60, the outer peripheral end 66*e* is arranged along a liquid-receiving portion 80, which is described later, provided on the periphery of the liquid inlet 35. See FIG. 3. In addition, the outer peripheral end 66*e* is arranged along the lid member 85 closing the liquid inlet 35. See FIG. 7. The peripheral wall 67 provided at the lower end of the container lid member 62 has an end region 67*e* arranged along the handhold portion 40 on the +Y direction side. The functions of the outer peripheral end 66*e* and the end region 67*e* will be described later.

In this way, in the liquid container 10A, the container lid member 62 is attached to the opening housing member 60 to block the opening in the containment chamber concave portion 61*a* as shown in FIG. 10. The main body wall 66 of the container lid member 62 crosses the upper wall surface 23*s* and constitutes the side wall surface that is the outer wall surface of the container main body 11 along the insertion direction, that is, the outer wall surface of the fifth wall part 25 as shown in FIGS. 3 and 4. See FIG. 10. In the liquid container 10A, the container lid member 62 protects the film member 63.

See FIGS. 5, 7, and 8. In the liquid container 10A, the peripheral walls 67 and 68 of the container lid member 62 are laid on the wall part constituting the third wall part 23, the wall part constituting the fourth wall part 24, and the wall part constituting the second wall part 22 of the opening housing member 60. Accordingly, in the liquid container 10A, the occurrence of a large gap between the opening housing member 60 exposed to the outside and the container lid member 62 is suppressed.

Figure 13:
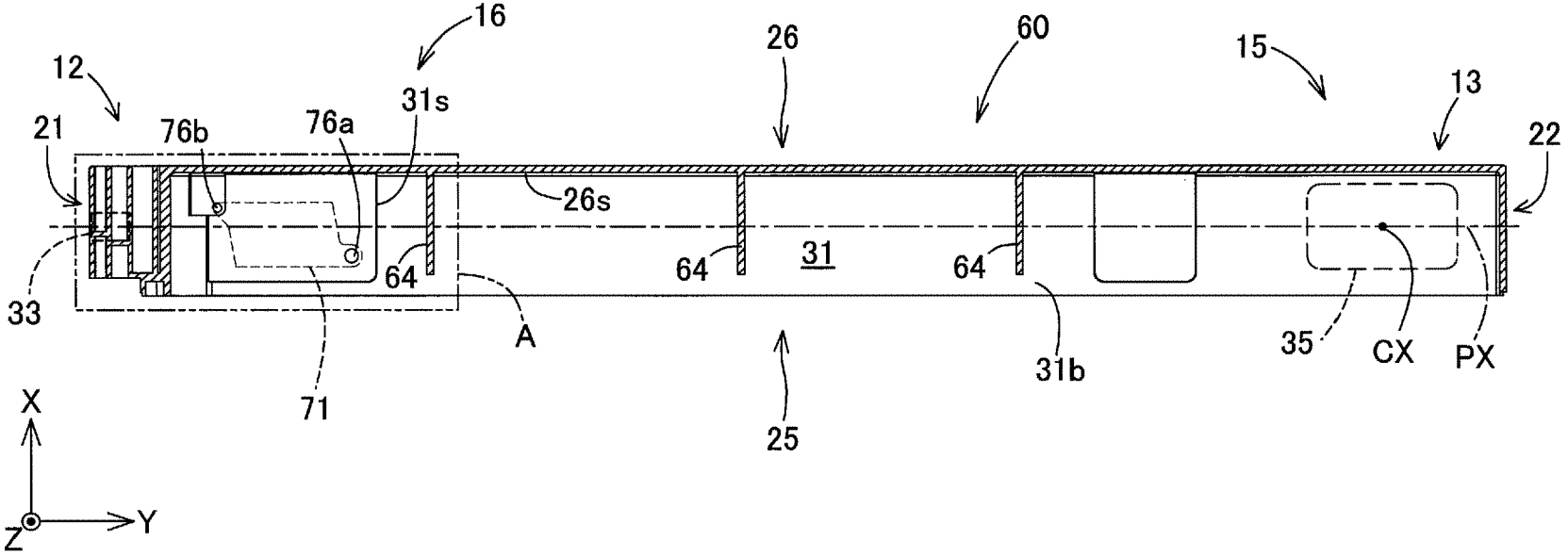
FIG. 13 is a schematic cross-sectional view of the opening housing member, which illustrates a bottom surface of a containment chamber.
Figure 14:
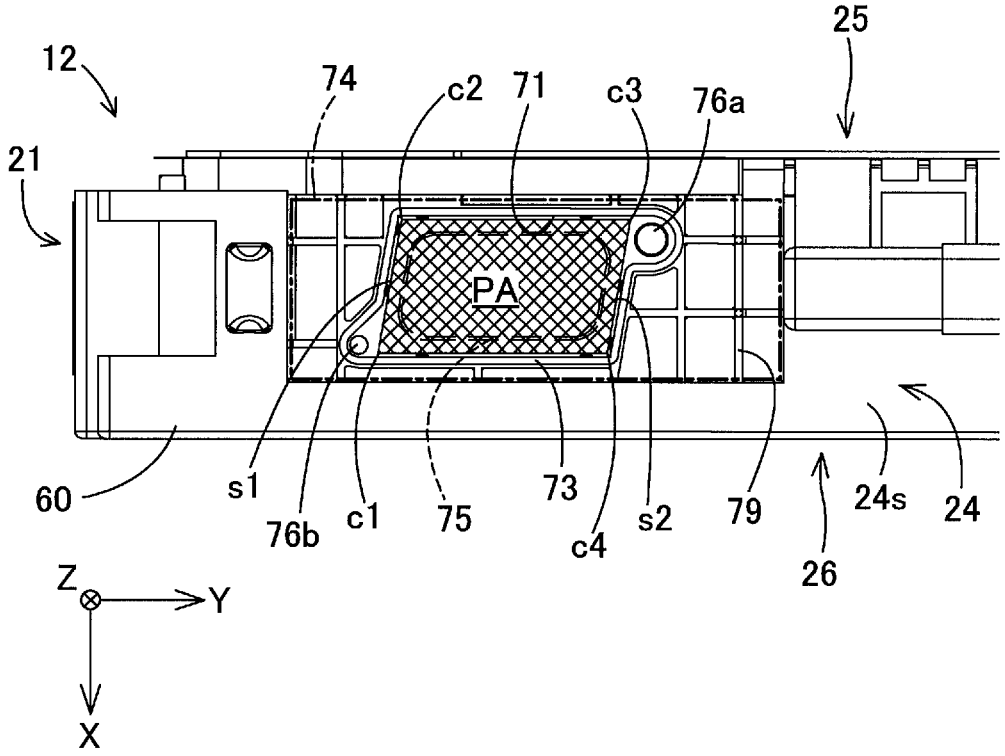
FIG. 14 is a schematic bottom view of the opening housing member.
Figure 15:
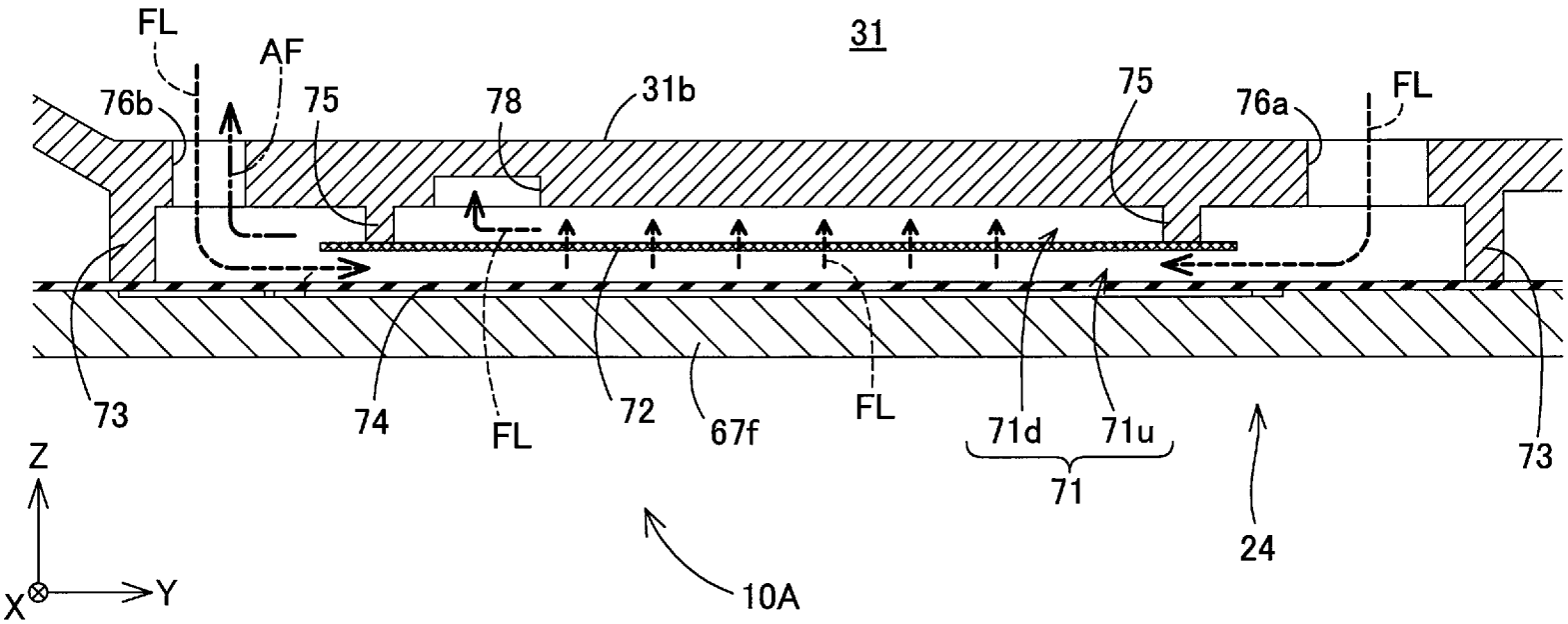
FIG. 15 is a schematic cross-sectional view of a filter chamber.
Figure 16:
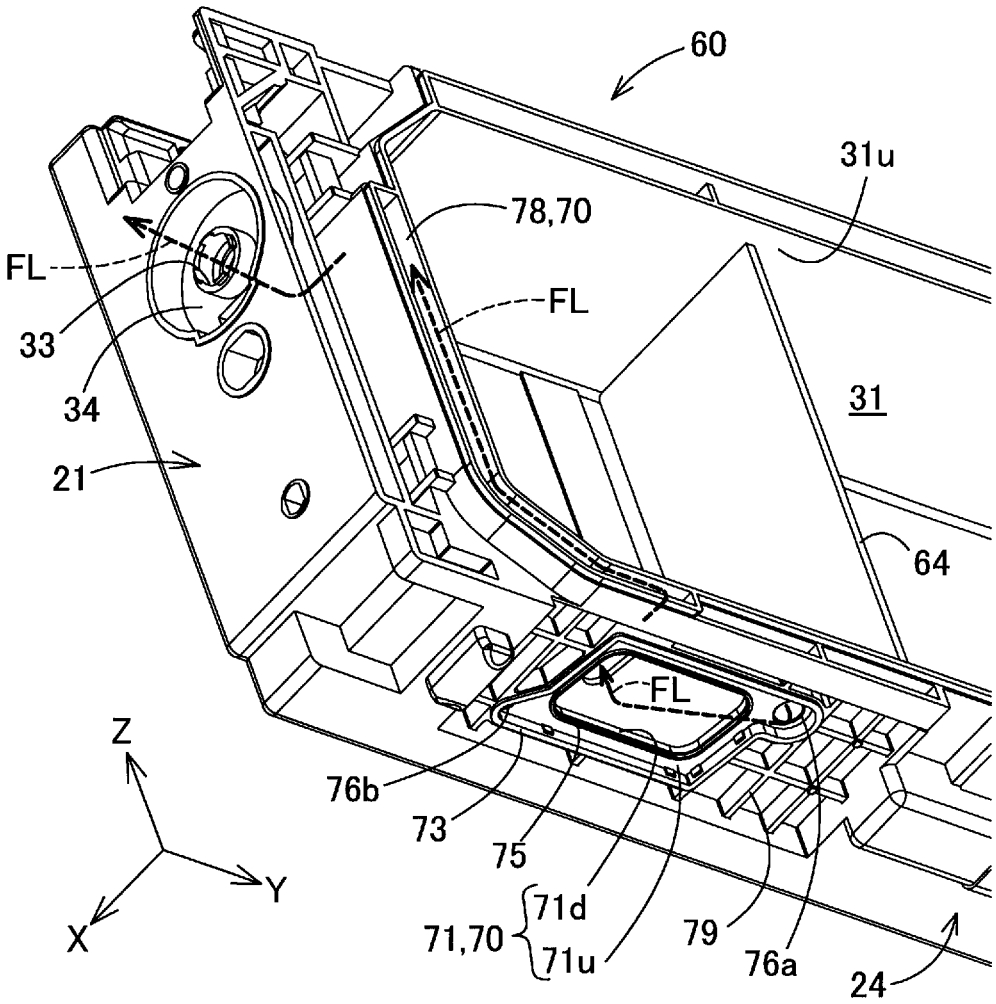
FIG. 16 is a schematic perspective view of an end of the opening housing member as seen from below.

A2-3. Liquid Flow Path Connecting the Containment Chamber and the Liquid Outlet:

A2-3-1. Configuration of the Flow Path:

Further referring to FIGS. 13 to 16, the configuration of a liquid flow path 70 connecting the containment chamber 31 and the liquid outlet 33 in the liquid container 10A will be described. FIG. 13 is a schematic cross-sectional view of the opening housing member 60 taken along line 13-13 illustrated in FIG. 11, which illustrates the bottom surface 31*b* of the containment chamber 31 as seen in the −Z direction. In FIG. 13, the positions of the liquid outlet 33 and the liquid inlet 35 are shown by broken lines as the liquid container 10A is seen in the −Z direction. FIG. 14 is a schematic bottom view of the region of the opening housing member 60 included in an area A illustrated in FIG. 13 as seen in the +Z direction, which illustrates the filter chamber 71 provided in the fourth wall part 24. FIG. 15 is a schematic cross-sectional view of a cross-sectional structure of the filter chamber 71 as taken along the Y direction. FIG. 16 is a schematic perspective view of the end of the opening housing member 60 with the filter chamber 71 on the first wall part 21 side as seen from below.

In FIG. 16, arrows FL are illustrated. Arrows FL indicate the flow of the liquid from the containment chamber 31 to the liquid outlet 33. The container main body 11 of the liquid container 10A is provided with the liquid flow path 70 connecting the containment chamber 31 and the liquid outlet 33 as shown in FIG. 16. The flow path 70 includes the filter chamber 71 and the outlet flow path 78. See FIG. 14. The filter chamber 71 is a space for storing a filter 72 catching foreign matter and air bubbles included in the liquid and removing them from the liquid. That is, in the liquid container 10A, the filter 72 is provided between the containment chamber 31 and the liquid outlet 33. The foreign matter caught and removed by the filter 72 here includes not only substances not included in the ingredients of the liquid but also particles of the ingredients of the liquid that are of predetermined or larger sizes due to the agglomeration of fine particles dispersed in the liquid.

See FIGS. 14 and 16. The filter chamber 71 is provided under the containment chamber 31. See FIGS. 7 and 13. The filter chamber 71 is provided inside the fourth wall part 24 of the container main body 11. In FIGS. 7 and 13, the filter chamber 71 is hidden from view and thus the position of the filter chamber 71 is shown by broken lines. As shown in FIG. 13, when the liquid container 10A is seen in the Z direction, the filter chamber 71 aligns with the liquid inlet 35 along the insertion direction. See FIGS. 14 and 16. The filter chamber 71 is formed as a concave space surrounded by a rib 73 protruding in the −Z direction from the surface of the wall part of the opening housing member 60 constituting the fourth wall part 24 of the container main body 11 on the −Z direction side.

As shown in FIGS. 10 and 15, after the filter 72 is arranged in the concave space, the opening in the concave space constituting the filter chamber 71 is sealed by welding a film member 74 to the rib 73. In FIG. 14, the arrangement area of the film member 74 is shown by chain lines. As shown in FIGS. 4 and 7, when the container lid member 62 is attached to the opening housing member 60, the filter chamber wall 67*f* of the container lid member 62 is arranged to cover the film member 74. The filter chamber wall 67*f* is part of the peripheral wall 67 that is provided at the end of the container lid member 62 on the −Z direction side. The filter chamber wall 67*f* is arranged in abutment with the end of the second rail portion 42 on the −Y direction side as shown in FIG. 7.

See FIG. 15. The filter 72 is formed from a film-like member with fine pores to let the liquid through the fine pores in the thickness direction and remove foreign matter and air bubbles included in the liquid larger in size than the diameter of the fine pores. The filter 72 is joined to and supported by a filter support wall 75 that is a convex portion protruding from the upper surface of the filter chamber 71 in the −Z direction such that the thickness direction aligns with the Z direction. The area surrounded by the filter support wall 75 is the area in which the liquid passes through the filter 72. The outer peripheral shape of the area is formed along the outer peripheral shape of the filter 72.

See FIG. 14. In the liquid container 10A, the outer peripheral shape of the filter 72, that is, the shape of the filter 72 as seen along the thickness direction is an almost square. In the first embodiment, the outer peripheral shape of the filter 72 is an almost parallelogram. The filter 72 has a first side s1 positioned on the insertion direction side and a second side s2 positioned on the opposite side of the first side s1 as seen in the insertion direction. The filter 72 has a first pair of corners c1 and c2 at both ends of the first side s1 and a second pair of corners c3 and c4 at both ends of the second side s2. Of the first pair of corners c1 and c2, one corner c1 is more protruded than the other corner c2 in the insertion direction. Of the second pair of corners c3 and c4, one corner c3 is more protruded than the other corner c4 in the direction opposite to the insertion direction.

See FIG. 15. The filter chamber 71 is divided into an upstream space 71*u* that is positioned upstream of the filter 72 and a downstream space 71*d* that is positioned downstream of the filter 72. See FIGS. 15 and 16. The upstream space 71*u* is connected to the containment chamber 31 via a first communication opening 76*a* and a second communication opening 76*b*. The downstream space 71*d* is a space surrounded by the filter support wall 75 and is connected to the outlet flow path 78. The upstream space 71*u* is positioned below the filter 72 and the downstream space 71*d*.

See FIGS. 13, 14, and 16. The first communication opening 76*a* and the second communication opening 76*b* communicating with the upstream space 71*u* are open in the bottom surface 31*b* of the containment chamber 31. The first communication opening 76*a* is provided closer to the liquid inlet 35 than the filter chamber 71 as seen in the insertion direction as shown in FIG. 13. As shown in FIG. 13, the first communication opening 76*a* is provided closer to the fifth wall part 25 where the film member 63, which is shown in FIG. 12, is arranged than the sixth wall part 26 as seen in the X direction. The second communication opening 76*b* is provided closer to the liquid outlet 33 than the filter chamber 71 on the opposite side of the first communication opening 76*a* with the filter 72 therebetween as seen in the insertion direction. The second communication opening 76*b* is provided closer to the sixth wall part 26 than the fifth wall part 25 as seen in the X direction. The first communication opening 76*a* is provided closer to the third corner c3 than the fourth corner c4 of the filter 72 as shown in FIG. 14. The second communication opening 76*b* is provided closer to the first corner c1 than the second corner c2 of the filter 72.

See FIG. 13. The first communication opening 76*a* is provided closer to the fifth wall part 25 than the sixth wall part 26 as seen in the X direction as described above. Accordingly, the liquid having passed between the reinforcement walls 64 and the film member 63 easily flow into the filter chamber 71 through the first communication opening 76*a*. The first communication opening 76*a* and the second communication opening 76*b* are open on the plane of the bottom surface 31*b* made slightly high via a step 31*s* which is shown in FIG. 13. This prevents the foreign matter settled out on the lower plane of the bottom surface 31*b* from getting over the step 31*s* and flowing into the first communication opening 76*a* and the second communication opening 76*b*.

See FIG. 14. The rib 73 surrounding the filter chamber 71 is formed to surround the filter 72, the first communication opening 76*a*, and the second communication opening 76*b* along their outer peripheral lines. A reinforcement rib 79 is formed in a grid shape on the outside of the filter chamber 71 to enhance the strength of the periphery of the filter chamber 71. This suppresses the deformation of the surrounding walls of the filter chamber 71 and suppresses separation of the filter 72 and the film member 74.

A2-3-2. Flow of the Liquid in the Flow Path:

Referring to FIGS. 15 and 16, the flow of the liquid in the flow path 70 will be described. See arrows FL in FIG. 15. The liquid in the containment chamber 31 flows into the upstream space 71*u* in the filter chamber 71 through the first communication opening 76*a* and the second communication opening 76*b*. The liquid flows inside the filter 72 in the direction opposite to the direction of gravity, and then enters the downstream space 71*d*. At that time, the foreign matter and air bubbles mixed in the liquid remain in the upstream space 71*u*. See the arrows FL in FIG. 16. The liquid having entered the downstream space 71*d* flows into the outlet flow path 78 connected to the downstream space 71*d*, and then flows into the liquid outlet 33 through the outlet flow path 78.

Referring to FIG. 13, in the liquid container 10A, the filter 72 is provided closer to the liquid outlet 33 than the liquid inlet 35 as seen in the insertion direction. This allows the foreign matter in the liquid injected through the liquid inlet 35 to settle out before reaching the filter 72. Accordingly, it leads to prevent the foreign matter from reaching the filter 72 and suppress the clogging of the filter 72 by the foreign matter. Even when air bubbles are mixed into the liquid in the containment chamber 31 by the injection of the liquid from the liquid inlet 35, it leads to reduce the quantity of air bubbles reaching the filter 72. The distance between the liquid outlet 33 and the filter 72 is short, which suppresses a larger pressure loss between the filter 72 and the liquid outlet 33. This makes it possible to reduce the suction power for sucking the liquid to the liquid outlet 33, which is generated by the suction pump 524 of the liquid-consuming device 500 which is shown in FIGS. 26 to 28.

In particular, in the first embodiment, the liquid inlet 35 is provided closer to the second wall part 22 than the first wall part 21, and the filter 72 is provided closer to the first wall part 21 than the second wall part 22, so that the distance between the liquid inlet 35 and the filter 72 becomes longer. Accordingly, the foreign matter in the liquid is less likely to reach the filter 72. In addition, the foreign matter in the liquid is caught by the plurality of reinforcement walls 64 between the liquid inlet 35 and the filter 72, therefore the amount of foreign matter reaching the filter 72 is to be reduced. This suppresses the clogging of the filter 72 to lengthen the lifetime of the filter 72.

FIG. 13 illustrates a central axis CX of the liquid inlet 35 and an axis line PX that crosses the central axis CX in parallel to the insertion direction. In the liquid container 10A, the first communication opening 76*a* communicating with the filter chamber 71 is displaced from the axis line PX. In this configuration, the distance between the first communication opening 76*a* and the central position of the liquid inlet 35 is longer than that in the case where the first communication opening 76*a* is positioned on the axis line PX. Accordingly, the increase of the distance further suppresses the arrival of the foreign matter having entered from the liquid inlet 35 at the first communication opening 76*a*. Accordingly, it leads to further suppress the clogging of the filter 72.

See FIG. 15. In the liquid container 10A, the filter chamber 71 is provided under the containment chamber 31. Accordingly, the liquid is guided from the containment chamber 31 to the filter chamber 71 by gravity to facilitate the smooth flow of the liquid into the filter chamber 71. This makes it possible to flow the liquid more smoothly from the liquid container 10A to the liquid-consuming device 500, and enhance the liquid container 10A in the capability of supplying the liquid to the liquid-consuming device 500.

In the liquid container 10A, the upstream space 71*u* of the filter chamber 71 is positioned under the filter 72 and the downstream space 71*d*, and the liquid in the filter chamber 71 passes through the filter 72 in the direction opposite to the direction of gravity. Accordingly, it allows the foreign matter removed from the liquid by the filter 72 to settle out under the filter 72 by gravity. Therefore, the clogging of the filter 72 is further suppressed.

In the liquid container 10A, the containment chamber 31 and the filter chamber 71 are allowed to communicate with each other by the first communication opening 76*a* that is provided close to the liquid inlet 35 and the second communication opening 76*b* that is positioned closer to the −Y direction side than the first communication opening 76*a* and provided distant from the liquid inlet 35. Accordingly, as shown by the arrows AF in FIG. 15, when the liquid is injected into the empty containment chamber 31, it leads to flow the liquid from the first communication opening 76*a* into the upstream space 71*u* of the filter chamber 71 while escaping the air in the upstream space 71*u* from the second communication opening 76*b* into the containment chamber 31. This suppresses the retention of the air in the upstream space 71*u* of the filter chamber 71. Accordingly, it leads to suppress interference with the charging of the liquid into the filter chamber 71 and suppress reduction in the capability of the filter chamber 71 to supply the liquid to the liquid-consuming device 500 due to such retention of the air.

See FIG. 14. In the liquid container 10A, the first corner c1 of the filter 72 is more protruded than the second corner c2 in the insertion direction, and the third corner c3 is more protruded than the fourth corner c4 in the direction opposite to the insertion direction. That is, the first corner c1 is positioned closer to the −Y direction side than the second corner c2, and the third corner c3 is positioned closer to the +Y direction side than the fourth corner c4. The outer peripheral shape of a liquid passage area PA in the filter 72 surrounded by the filter support wall 75 is formed along the outer peripheral shape of the filter 72. This increases the area of the liquid passage area PA in the filter 72 as compared to the case where the outer peripheral shape of the filter 72 is a rectangle with corners at the positions of the second corner c2 and the fourth corner c4 and the outer peripheral shape of the liquid passage area PA is formed adapting to the rectangular shape. Accordingly, the increase enhances the filter 72 in the effect of removing foreign matter. The outer peripheral shape of the filter 72 is different between the front and back sides. This makes it easy to discriminate between the upper and lower surfaces of the filter 72. This simplifies the process of assembling the filter 72 into the container main body 11 of the liquid container 10A.

See FIGS. 7 and 16. In the liquid container 10A, when the container lid member 62 is removed from the opening housing member 60, the filter chamber 71 is exposed to the outside. This facilitates the replacement and maintenance of the filter 72.

A2-4. The Outlet Storage Concave Portion and the Plurality of Concave Portions of the First Wall Part:

A2-4-1. Outlet Storage Concave Portion:

FIG. 17 is a schematic cross-sectional view of the first wall part 21 of the liquid container 10A taken along lines 17-17 illustrated in FIG. 5. In the first wall part 21, the liquid outlet 33 is open at the front-end of a tube portion 33*p* protruding in the −Y direction at almost the central position of the outlet storage concave portion 34. The liquid outlet 33 is surrounded by the inner wall surface of the outlet storage concave portion 34. Accordingly, the liquid spilling out of the liquid outlet 33 is received by the outlet storage concave portion 34 to suppress the soiling of the liquid container 10A with the liquid spilling out of the liquid outlet 33.

In the outlet storage concave portion 34, the area under the liquid outlet 33 is deeper than the area above the liquid outlet 33 as seen in the +Y direction. This increases the capacity of the outlet storage concave portion 34 retaining the liquid leaking downward from the liquid outlet 33. Accordingly, it leads to suppress the movement of the liquid leaking from the liquid outlet 33 to the area under the outlet storage concave portion 34, thereby further suppressing the soiling of the liquid container 10A by the leaking liquid.

A2-4-2. Concave Portion of the First Wall Part:

When the liquid container 10A is loaded into the liquid-consuming device 500, a rod 525 provided in the container insertion opening 521 of the liquid-consuming device 500 is inserted into the second concave portion 55*b* in the first wall part 21. The rod 525 is shown by a broken line in the drawing. The rod 525 is formed from a shaft-like member extending in the +Y direction and is shaped according to the opening shape and opening depth of the second concave portion 55*b*.

The second concave portion 55*b* has a bottom 56 on the +Y direction side. In the liquid containers 10A in the loaded state, the front-ends of the rods 525 contact the bottom 56. This makes it possible to prevent, at insertion of the liquid container 10A into the liquid-consuming device 500, the liquid container 10A from being too pressed toward the −Y direction side beyond a predetermined loaded position.

In the liquid container 10A, the liquid outlet 33 is provided above the second concave portion 55*b* serving as a positioning portion for the liquid container 10A. Accordingly, it leads to prevent defective connection between a liquid introduction opening, which is not illustrated in figures, of the liquid-consuming device 500 to be connected to the liquid outlet 33 and the liquid outlet 33 caused by the displacement of the liquid outlet 33.

See FIG. 9. In the liquid container 10A, the second concave portion 55*b* has the shape of an almost circle with both ends cut flatly as seen in the Z direction. Accordingly, it leads to prevent the posture of the liquid container 10A from being inclined in the Z direction with respect to the central axis of the rod 525 inserted into the second concave portion 55*b*.

In the liquid container 10A, the first concave portion 55*a* is provided between the electrical connection portion 50 and the liquid outlet 33. Accordingly, even if the liquid container 10A is brought into a posture in which the third wall part 23 is positioned under the fourth wall part 24, the first concave portion 55*a* suppresses the movement of the liquid spilling out of the liquid outlet 33 to the electrical connection portion 50. Accordingly, it leads to suppress the degradation of the electrical connection portion 50 due to the adhesion of the liquid to the electrical connection portion 50 and reduction in electrical connectivity of the electrical connection portion 50 to the liquid-consuming device 500.

In the liquid container 10A, the second concave portion 55*b* and the third concave portion 55*c* are provided under the liquid outlet 33. Accordingly, even if the liquid container 10A is brought into a posture in which the fourth wall part 24 is positioned under the third wall part 23, the two concave portions 55*b* and 55*c* suppress the movement of the liquid spilling out of the liquid outlet 33 to the fourth wall part 24. This suppresses increase in the area soiled with the liquid spilling out of the liquid outlet 33.

See FIG. 9. In the liquid container 10A, the central position of the concave portions 55, the liquid outlet 33, and the electrical connection portion 50 as seen in the X direction align in a line on an axis CY parallel to the Z direction. These central positions may be slightly displaced from the axis CY. The displacements in the X direction of the central positions of the concave portions 55 from the central positions of the liquid outlet 33 and the electrical connection portion 50 may be permitted as far as the liquid spilling out of the liquid outlet 33 is smoothly collected. The central positions of the concave portions 55 may be displaced such that, when the liquid container 10A is seen in the Y direction, the concave portions 55 overlap at least partially the liquid outlet 33 and the electrical connection portion 50.

Figure 18:
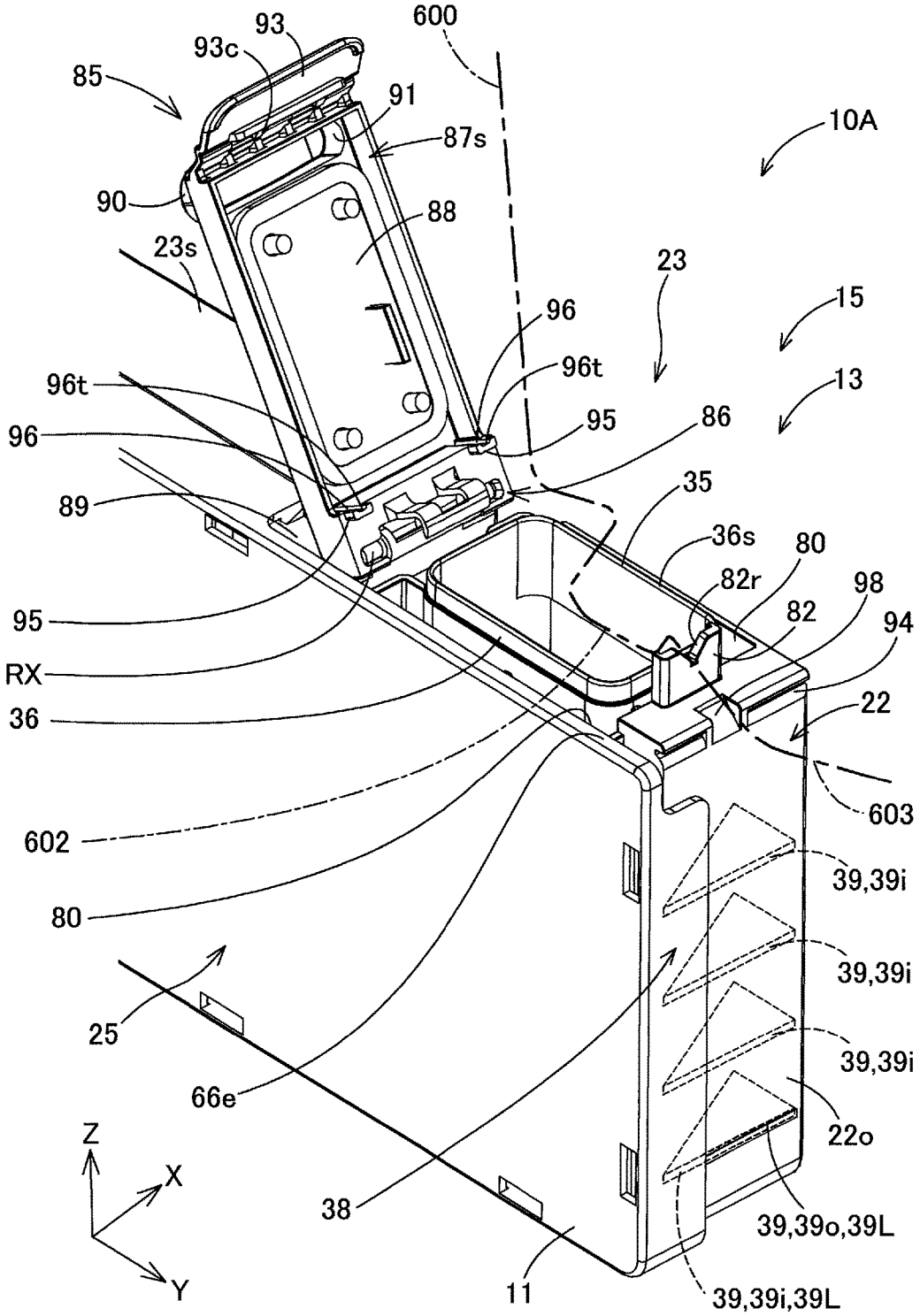
FIG. 18 is a schematic perspective view of a second end side of the liquid container.
Figure 19:
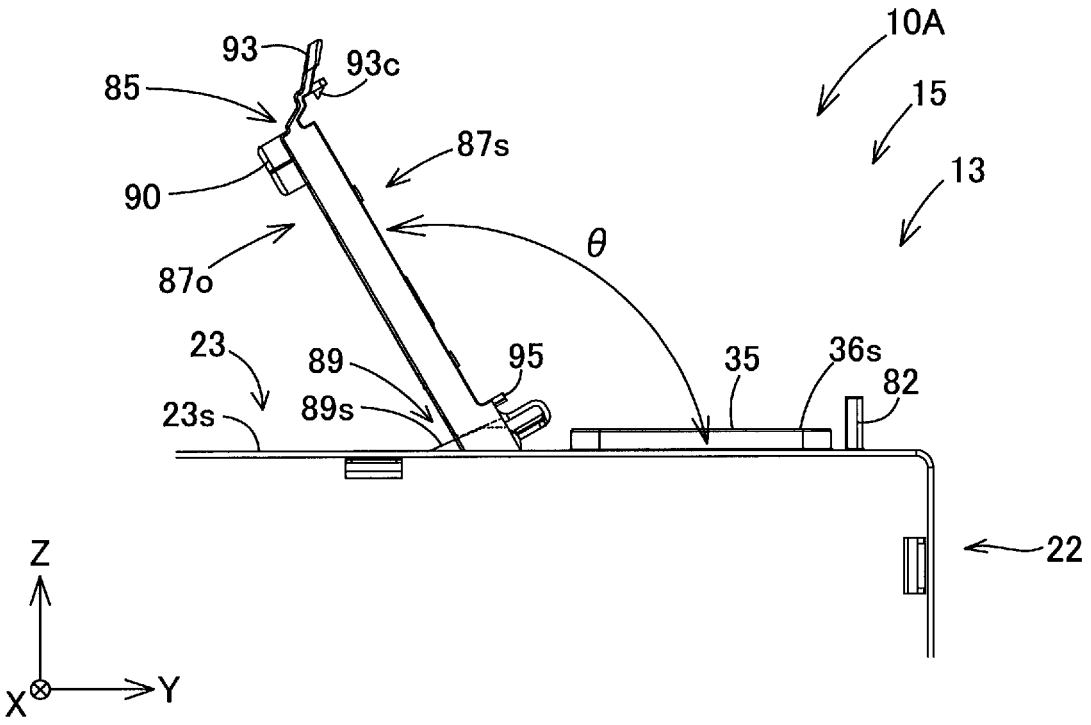
FIG. 19 is a schematic side view of the second end side of the liquid container.
Figure 20:
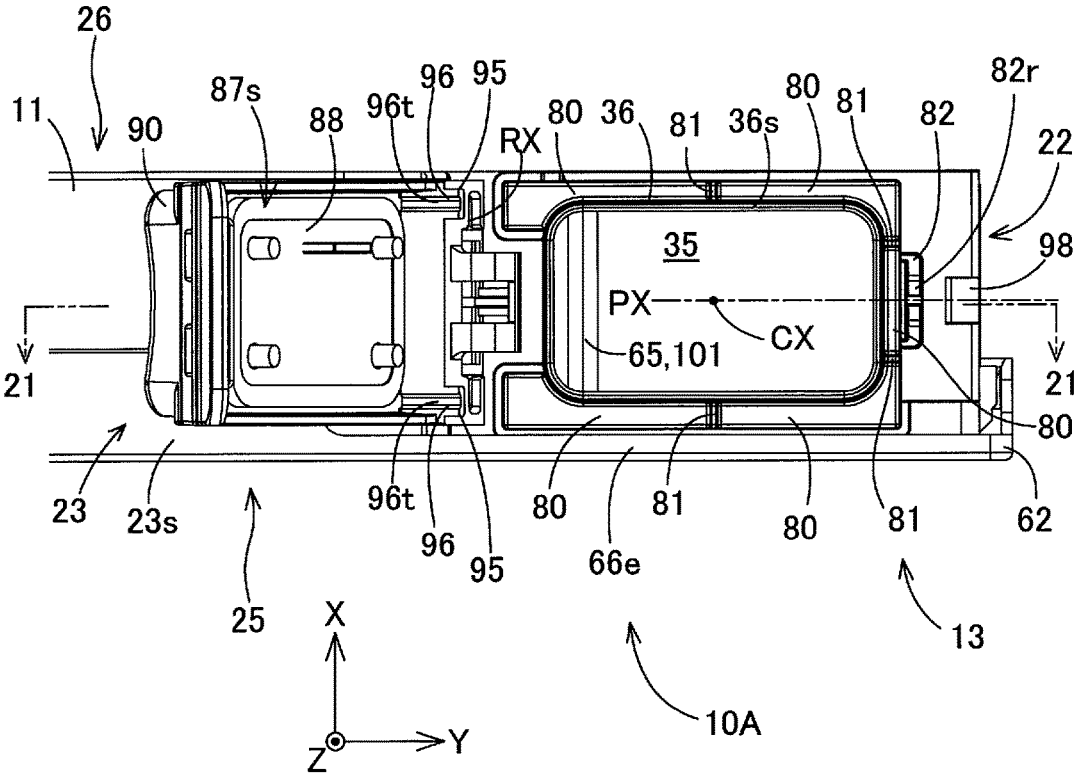
FIG. 20 is a schematic plane view of the second end side of the liquid container.
Figure 21:
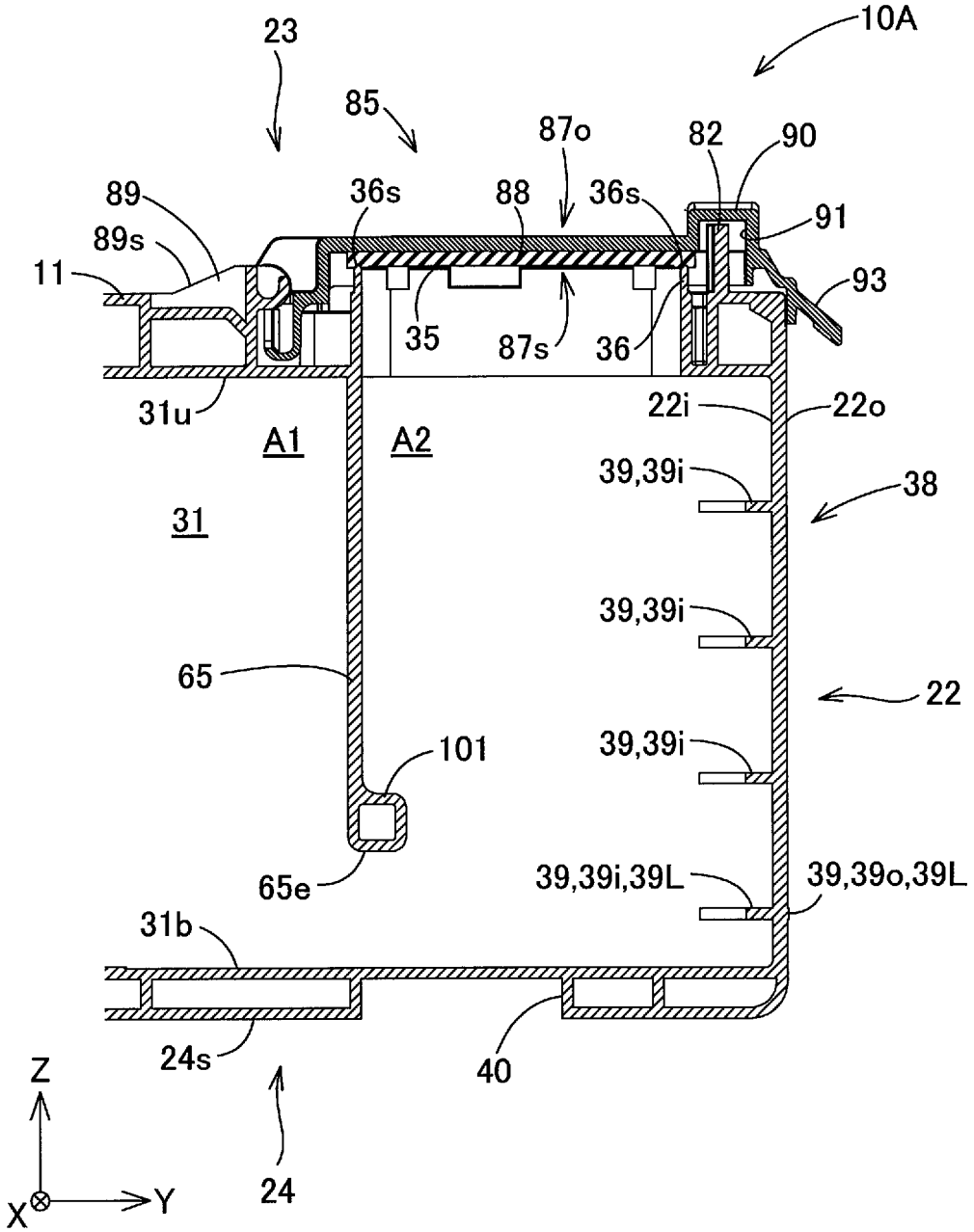
FIG. 21 is a schematic cross-sectional view of the second end side of the liquid container.
Figure 22:
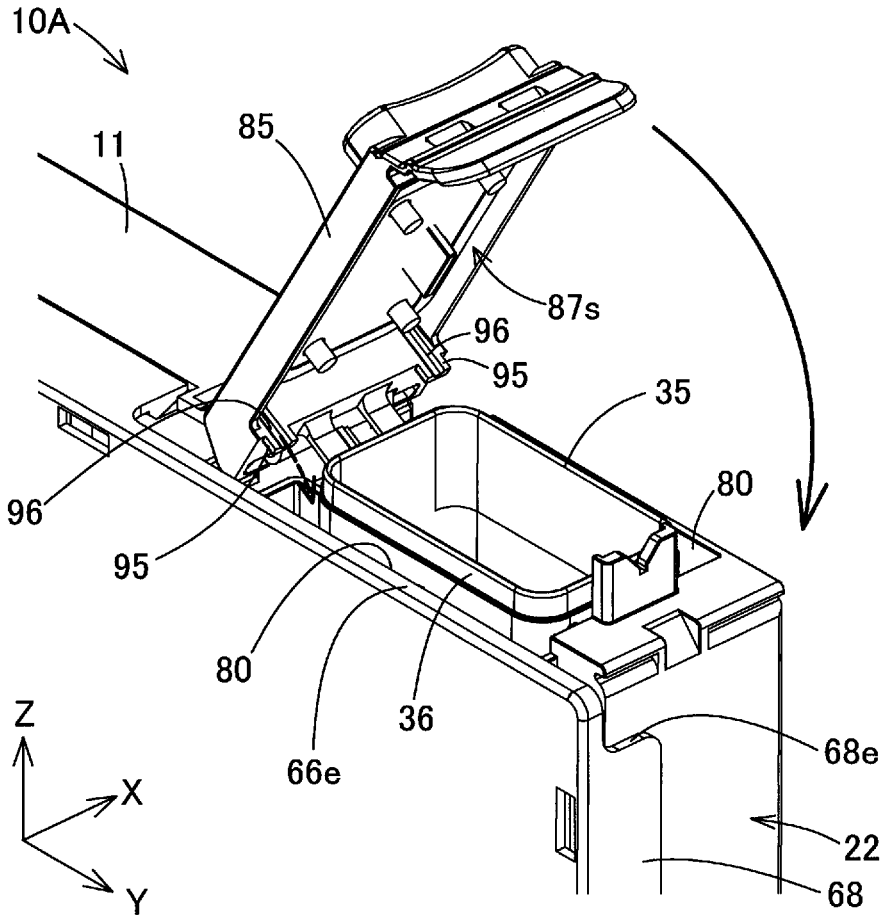
FIG. 22 is a schematic perspective view of a lid member that is being moved in a closing direction.
Figure 23:
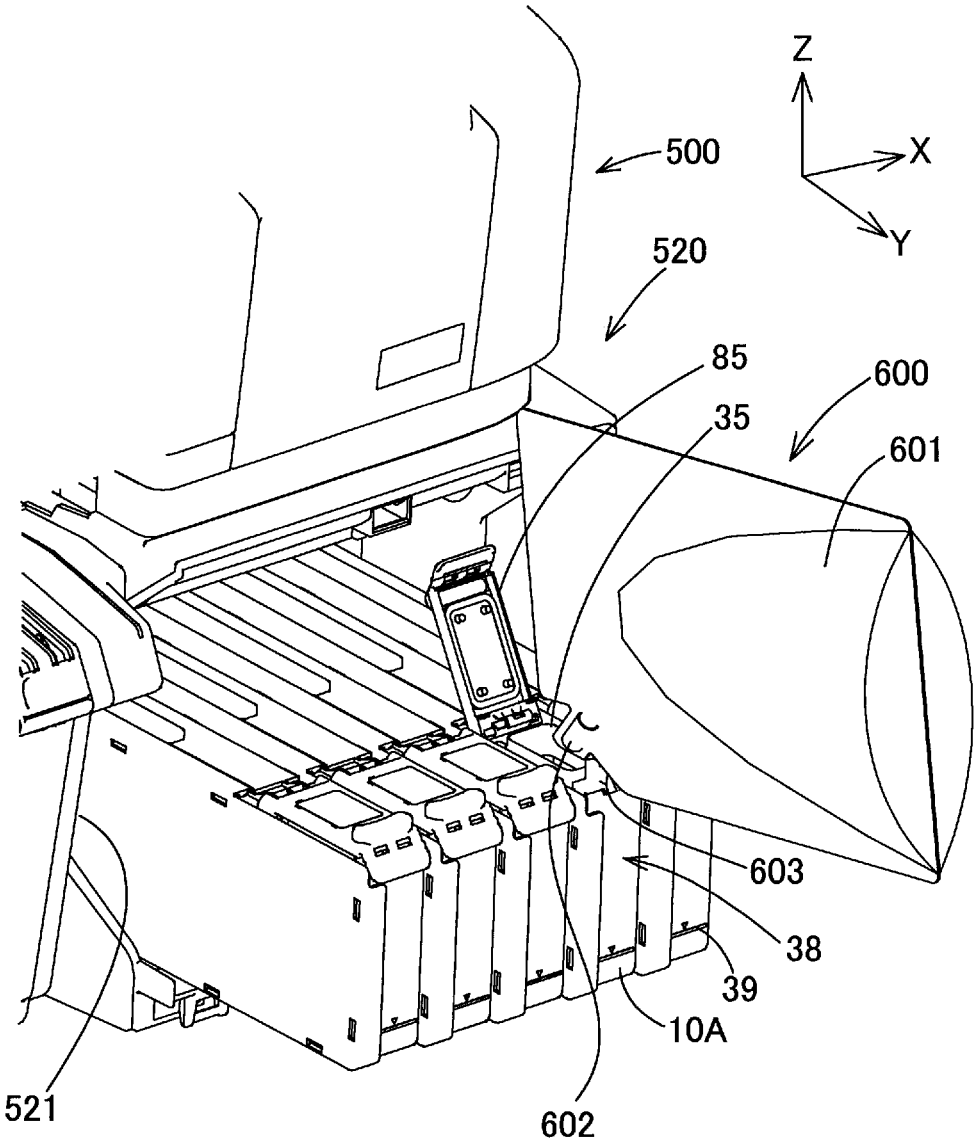
FIG. 23 is a schematic perspective view of injection of a liquid into the liquid container.

A2-5. Configuration of Second End Portion Side of the Liquid Container:

Referring to FIGS. 18 to 23, the configuration of the second end 13 side of the liquid container 10A will be described in detail. FIG. 18 is a schematic perspective view of the second end 13 side of the liquid container 10A with the lid member 85 opened. FIG. 19 is a schematic side view of the upper end region of the second end 13 of the liquid container 10A with the lid member 85 opened as seen in the +X direction. FIG. 20 is a schematic plane view of the second end 13 of the liquid container 10A with the lid member 85 opened as seen in the –Z direction. FIG. 21 is a schematic cross-sectional view of the second end 13 of the liquid container 10A taken along line 21-21 illustrated in FIG. 20. FIG. 21 illustrates the lid member 85 in the closed state. FIG. 22 is a schematic perspective view of the lid member 85 that is being moved in a closing direction. FIG. 23 is a schematic perspective view of injection of the liquid into the liquid container 10A loaded in the liquid-consuming device 500.

As described above, the liquid inlet 35 is provided on the second end 13 side of the liquid container 10A, and the visual recognition portion 38 with the scale marks 39 and the handhold portion 40 are provided under the liquid inlet 35. Hereinafter, the configurations of the scale marks 39 in the visual recognition portion 38, the handhold portion 40, the liquid inlet 35, and their vicinities, and the injection of the liquid into the liquid inlet 35 will be described in sequence.

A2-5-1. Scale Marks in the Visual Recognition Portion:

See FIG. 18. The visual recognition portion 38 of the second wall part 22 has the scale marks 39 as described above. In the liquid container 10A, at least part of the scale marks 39 are provided on the outer wall surface 220 outside the containment chamber 31 in the visual recognition portion 38 and the inner wall surface 22*i* inside the containment chamber 31 in the visual recognition portion 38. Hereinafter, the scale mark 39 provided on the outer wall surface 22*o* will be called "outer scale mark 390". In addition, the scale marks 39 provided on the inner wall surface 22*i* will be called "inner scale marks 39*i*".

The outer scale mark 390 is formed as a convex portion on the outer wall surface 22*o*. The convex portion constituting the outer scale mark 390 has a linear shape extending in the X direction. The outer scale mark 390 is formed as a lower-limit scale mark 39L indicating the lower limit of the amount of the liquid contained in the containment chamber 31. Besides the lower-limit scale mark 39L, other scale marks indicating other liquid amounts may be added as the outer scale marks 39*o*.

The inner scale marks 39*i* are formed as a plurality of ribs in the containment chamber 31. The ribs constituting the inner scale marks 39*i* are vertically aligned at predetermined intervals in the containment chamber 31. The ribs constituting the inner scale marks 39*i* are provided at the corner between the second wall part 22 and the sixth wall part 26, and are formed as almost triangular wall portions extending along the X direction and the Y direction to couple the second wall part 22 and the sixth wall part 26. The plurality of ribs constituting the inner scale marks 39*i* also serve as reinforcement ribs for enhancing the strength of the opening housing member 60.

The inner scale marks 39*i* includes a lower-limit scale mark 39L provided at the lowest position in the containment chamber 31. The inner scale mark 39*i* constituting the lower-limit scale mark 39L is opposed to the outer scale mark 390 constituting the lower-limit scale mark 39L in the Y direction.

According to the liquid container 10A, the scale marks 39 include the inner scale marks 39*i* on the inner wall surface 22*i* and the outer scale mark 390 on the outer wall surface 22*o*. Accordingly, even if some of the inner scale marks 39*i* become lowered in visibility for some reason, the user is able to check the amount of the liquid in the containment chamber 31 by the outer scale mark 39*o*. Similarly, even if the outer scale mark 390 becomes lowered in visibility due to the wearing away of the outer scale mark 390 or the adhesion of the liquid to the outer scale mark 39*o*, the user is able to check the amount of the liquid in the containment chamber 31 by the inner scale marks 39*i*. In this way, it leads to prevent a situation where the user cannot check the liquid amount even in the event of a defect in either the inner scale marks 39*i* or the outer scale mark 39*o*.

According to the liquid container 10A, the outer scale mark 390 is formed from the convex portion on the outer wall surface 22*o* of the second wall part 22. Accordingly, even if the liquid spilling out of the liquid inlet 35 adheres to the outer scale mark 390 to deteriorate the visibility of the outer scale mark 39*o*, the user is able to find tactually the position of the outer scale mark 39*o*.

According to the liquid container 10A, the inner scale marks 39*i* are formed as ribs provided on the inner wall surface 22*i*. Accordingly, when the surroundings of the ribs are immersed with the liquid contained in the containment chamber 31, the formation regions of the inner scale marks 39*i* become more different in luminosity and coloration from their surrounding areas, thereby to enhance the visibility of the inner scale marks 39*i*.

According to the liquid container 10A, the lower-limit scale mark 39L is provided on both the outer wall surface 22*o* and the inner wall surface 22*i*. This suppresses reduction in the visibility of the scale marks 39 indicating the lower-limit position, which makes it possible to prevent the occurrence of a delay in supplying the liquid to the liquid-consuming device 500 due to the shortage of the liquid in the liquid container 10A.

A2-5-2. Handhold Portion:

See FIGS. 4 and 21. As described above, in the liquid container 10A, the handhold portion 40 is provided in the first region 15. In the liquid container 10A, the handhold portion 40 enhances the operability for the user in loading or unloading the liquid container 10A into or from the liquid-consuming device 500. The handhold portion 40 is provided on the bottom wall surface 24*s* of the fourth wall part 24 on the opposite side of the upper wall surface 23*s* of the third wall part 23 where the liquid inlet 35 is open. This prevents the liquid spilling out of the liquid inlet 35 from reaching the handhold portion 40 and adhering to the handhold portion 40. Accordingly, it leads to prevent the adhesion of the liquid to the user's body via the handhold portion 40.

As described above, in the liquid container 10A, the convex portion on the outer wall surface 22*o* constituting the outer scale mark 390 as the lower-limit scale mark 39L in the visual recognition portion 38 is provided above the handhold portion 40. The convex portion constituting the outer scale mark 390 is able to receive the liquid spilling out of the liquid inlet 35 and moving to the outer wall surface 22*o* of the second wall part 22. Accordingly, it leads to further prevent the spilling liquid from reaching the handhold portion 40 which is shown in FIG. 4.

In the liquid container 10A, the handhold portion 40 is provided on the bottom wall surface 24*s* of the fourth wall part 24 to suppress the interference between the formation area of the handhold portion 40 and the formation area of the visual recognition portion 38 provided on the second wall part 22. Accordingly, even with the provision of the handhold portion 40, the formation area of the visual recognition portion 38 is provided larger. In addition, it leads to prevent the handhold portion 40 from interfering with the user visually checking the visual recognition portion 38.

See FIG. 1. The plurality of liquid containers 10A are loaded in parallel into the liquid-consuming device 500 in a state of being aligned in the X direction. That is, as shown in FIG. 1, the plurality of liquid containers 10A are aligned in the liquid-consuming device 500 in the direction crossing both the insertion direction and the direction, which is seen in FIG. 6, from the upper wall surface 23*s* to the bottom wall surface 24*s* of the liquid container 10A. With the handhold portion 40 provided on the bottom wall surface 24*s* as described above, even though the intervals between the liquid containers 10A aligned in the liquid-consuming device 500 in the X direction are decreased, it leads to prevent reduction in user accessibility to the handhold portion 40. Accordingly, it leads to make the arrangement area of the liquid containers 10A compact in size in the liquid-consuming device 500.

In the liquid container 10A, the provision of the visual recognition portion 38 as described above prevents the liquid from flowing out of the liquid inlet 35 due to excessive injection of the liquid into the containment chamber 31 through the liquid inlet 35. Therefore, it leads to suppress the soiling of the handhold portion 40 with the outflowing liquid and the adhesion of the liquid to the user's body via the handhold portion 40. In addition, in the liquid container 10A, the surroundings of the liquid inlet 35 are configured in various manners to suppress the leakage of the liquid from the liquid inlet 35 and the diffusion of the liquid leaking from the liquid inlet 35, thereby preventing the adhesion of the liquid to the handhold portion 40. In this way, the liquid container 10A is enhanced in user convenience by the provision of the handhold portion 40 and the easy-to-see configuration of the visual recognition portion 38.

A2-5-3. Configuration of the Surroundings of the Liquid Inlet:

1. Liquid-Receiving Portion:

See FIGS. 18 and 20. In the liquid container 10A, the liquid-receiving portion 80 is provided on the upper wall surface 23*s* of the third wall part 23 as upper-surface wall part to receive the liquid spilling out of the liquid inlet 35. The liquid-receiving portion 80 is formed as a concave portion provided around the liquid inlet 35. See FIG. 18. The liquid-receiving portion 80 is provided at the lower end of the inlet surrounding wall portion 36. See FIG. 20. The liquid-receiving portion 80 is provided in the area between the liquid inlet 35 and the second wall part 22, the area between the liquid inlet 35 and the fifth wall part 25, and the area between the liquid inlet 35 and the sixth wall part 26.

According to the liquid container 10A, the liquid spilling out of the liquid inlet 35 is received by the liquid-receiving portion 80. Therefore, it leads to suppress the soiling of the outer wall surface of the liquid container 10A with the liquid spilling out of the liquid inlet 35. This suppresses the adhesion of the liquid spilling out of the liquid inlet 35 to the user's body. In addition, it leads to prevent the liquid spilling out of the liquid inlet 35 from moving to the visual recognition portion 38 of the second wall part 22 and decreasing the visibility of the scale marks 39.

See FIG. 20. The concave portion constituting the liquid-receiving portion 80 has liquid-receiving portion division walls 81 that divide the space in the concave portion into a plurality of sections. The liquid-receiving portion division walls 81 are formed by wall portion extending upward in the liquid-receiving portion 80. In the liquid container 10A, the internal space in the liquid-receiving portion 80 is divided by the liquid-receiving portion division walls 81 into a plurality of pieces to prevent the liquid from flowing within the liquid-receiving portion 80 and spilling out of the liquid-receiving portion 80. Accordingly, it leads to suppress the soiling of the outer wall surface of the liquid container 10A with the liquid spilling out of the liquid inlet 35. This further suppresses the adhesion of the liquid spilling out of the liquid inlet 35 to the user's body. This also further suppresses reduction in the visibility of the scale marks 39 caused by the liquid spilling out of the liquid inlet 35.

2. Convex Wall Portion:

See FIGS. 18 and 19. In the liquid container 10A, the upper wall surface 23*s* of the third wall part 23 has an upwardly projecting convex wall portion 82 between the liquid inlet 35 and the second wall part 22, that is, on the +Y direction side of the liquid inlet 35. The convex wall portion 82 serves as a preventive wall that prevents the diffusion of liquid drops from the liquid inlet 35 in the +Y direction at the time of the user's injection of the liquid into the liquid inlet 35. Accordingly, it leads to suppress the soiling of the liquid container 10A with the liquid and the adhesion of the liquid to the user's body during the liquid injection. This also suppresses reduction in the visibility of the scale marks 39 due to the adhesion of the liquid to the outer wall surface 220 of the second wall part 22. As shown in FIG. 18, the upper end of the convex wall portion 82 is provided with a notch-like concave portion 82*r* recessed in the −Z direction. The function of the concave portion 82*r* will be described later.

3. Lid Member:

See FIGS. 18 to 23. The liquid container 10A is provided with the lid member 85 that rotates with respect to the upper wall surface 23*s* of the third wall part 23 as upper-surface wall part to open or close the liquid inlet 35. The lid member 85 is coupled to the third wall part 23 via a coupling portion 86 as shown in FIG. 18. The coupling portion 86 is formed from a hinge mechanism and the lid member 85 rotates around a rotation axis RX of the coupling portion 86. The coupling portion 86 is provided on the −Y direction side of the liquid inlet 35 and the rotation axis RX is arranged along the X direction. The lid member 85 rotates above the upper wall surface 23*s* along the Y direction.

See FIG. 19. The lid member 85 has a sealing surface 87*s* facing the liquid inlet 35 and an outer surface 87*o* on the opposite side. As shown in FIG. 21, when the lid member 85 rotates to the +Y direction side, the sealing surface 87*s* enters a state that covers the liquid inlet 35 to block the liquid inlet 35. As shown in FIGS. 18 and 19, when the lid member 85 rotates to the −Y direction side, the sealing surface 87*s* enters a state that separates from the liquid inlet 35 to open the liquid inlet 35.

According to the liquid container 10A, the lid member 85 suppresses the spilling of the liquid from the liquid inlet 35 by keeping the liquid inlet 35 closed except at the time of liquid injection. Accordingly, it leads to suppress the soiling of the liquid container 10A with the liquid spilling out of the liquid inlet 35. It is also possible to prevent the liquid spilling out of the liquid inlet 35 from adhering to the visual recognition portion 38 of the second wall part 22 and reducing in the visibility of the scale marks 39. According to the liquid container 10A, keeping the liquid inlet 35 closed by the lid member 85 makes it possible to suppress entry of foreign matter from the liquid inlet 35 into the containment chamber 31. See FIG. 22. To close the lid member 85, the user is able to position the lid member 85 with reference to the position of the outer peripheral end 66*e* of the container lid member 62 arranged along the attachment position of the lid member 85. This enhances the operability of the lid member 85 for the user.

See FIGS. 18 and 21. The sealing surface 87*s* has a seal member 88. As shown in FIG. 21, when the liquid inlet 35 is closed with the sealing surface 87*s*, the seal member 88 is in abutment with the upper end surface 36*s* of the inlet surrounding wall portion 36 to seal the liquid inlet 35. The seal member 88 is formed from a resin material such as elastomer or rubber, for example. In the liquid container 10A, the seal member 88 enhances the blockage of the liquid inlet 35 with the lid member 85 to further suppress the leakage of the liquid from the liquid inlet 35. Accordingly, it leads to further suppress the soiling of the liquid container 10A by the liquid spilling out of the liquid inlet 35 and reduction in the visibility of the scale marks 39.

See FIGS. 18, 19, and 21. In the liquid container 10A, the third wall part 23 has a stopper portion 89 that restricts the rotation of the lid member 85 in the −Y direction. As shown in FIG. 19, the stopper portion 89 supports the lid member 85 in an inclined state with respect to the upper wall surface 23*s* of the third wall part 23 such that the liquid inlet 35 is kept open. The stopper portion 89 is provided as a convex structure on the upper wall surface 23*s* on the −Y direction side of the coupling portion 86.

See FIGS. 19 and 21. The stopper portion 89 has an inclined surface 89*s* at an inclination angle with respect to the upper wall surface 23*s*. The inclined surface 89*s* of the stopper portion 89 rotates the lid member 85 in the direction that opens the liquid inlet 35. As shown in FIG. 19, when an angle θ of the lid member 85 with respect to the upper wall surface 23*s* has reached a predetermined angle, the inclined surface 89*s* abuts with the lower end of the lid member 85 on the outer surface 87*o* side. The lid member 85 receives reaction force against its own weight from the inclined surface 89*s* of the stopper portion 89 and is supported in the state that is inclined with respect to the upper wall surface 23*s*.

According to the liquid container 10A, it leads to prevent the lid member 85 from interfering with the user's injection of the liquid into the liquid inlet 35. Accordingly, it leads to prevent the user from accidentally spilling the liquid at the time of liquid injection and suppress the soiling of the liquid container 10A with the spilling liquid and reduction in the visibility of the scale marks 39. In addition, when the user tries to rotate the lid member 85 to close the liquid inlet 35, the lid member 85 is in the inclined state and thus the user is able to hand-hold easily the outer surface 87*o* of the lid member 85 and lift the lid member 85. This enhances the operability of the lid member 85.

In the first embodiment, the angle θ between the lid member 85 supported by the stopper portion 89 and the upper wall surface 23*s* on the +Y direction side is 100° or more. This further prevents the lid member 85 from interfering with the user's injection of the liquid into the liquid inlet 35. In addition, at the time of liquid injection, the lid member 85 is able to receive the liquid drops diffused from the liquid inlet 35 in the −Y direction. Accordingly, it leads to further suppress the soiling of the liquid container 10A with the liquid drops diffused from the liquid inlet 35.

See FIGS. 18 and 19. The outer surface 87*o* of the lid member 85 has an outer surface convex portion 90 protruding from the outer surface 87*o* at the end of the front-end side opposite to the base end side coupled by the coupling portion 86. The user is able to hand-hold the outer surface convex portion 90 to open or close the lid member 85. This facilitates the user's smooth operation of the lid member 85 to enhance the operability of the lid member 85.

See FIGS. 18 and 21. The outer surface convex portion 90 contains a sealing surface-side concave portion 91 as a concave portion provided in the sealing surface 87*s*. When the lid member 85 closes the liquid inlet 35, the sealing surface-side concave portion 91 internally accepts and stores the convex wall portion 82 as shown in FIG. 21. The User is able to use the convex wall portion 82 as a positioning reference for closing the lid member 85. To close the liquid inlet 35 by the lid member 85, the user is able to rotate the outer surface convex portion 90 toward the convex wall portion 82 with the convex wall portion 82 as a reference. This facilitates the user's smooth opening and closing of the lid member 85.

See FIGS. 18 and 21. The front-end portion of the lid member 85 has a lock portion 93 extending in a tongue-like shape in the direction crossing the sealing surface 87*s*. The lock portion 93 has a claw portion 93*c* to lock a locked portion 94 as a concave portion opening at the upper end of the second wall part 22 in the +Y direction when the lid member 85 closes the liquid inlet 35. See FIG. 6. The lock portion 93 of the lid member 85 locks the locked portion 94 to enhance the sealing property of the lid member 85 to the liquid inlet 35. In addition, when the liquid inlet 35 is closed with the lid member 85, the lock portion 93 protrudes from the second wall part 22 in the +Y direction. Accordingly, it becomes easily for the user to hand-hold the lower surface of the lock portion 93 to open the lid member 85. The lock portion 93 extends obliquely downward from the upper end of the second wall part 22. Accordingly, when the user hand-holds the lower surface of the lock portion 93 and tries to rotate the lid member 85 in the +Z direction, the lock portion 93 is subjected to the force of separating the claw portion 93*c* from the locked portion 94. Accordingly, it becomes easily for the user to remove the lock portion 93 from the locked portion 94.

See FIG. 8. When the liquid inlet 35 is closed with the lid member 85, the lock portion 93 of the lid member 85 is arranged on the second wall part 22. The end of the second wall part 22 on the −X direction side is formed from the peripheral wall 68 of the container lid member 62. The upper end portion 68*e* of the peripheral wall 68 is positioned under the arrangement position of the front-end of the lock portion 93 such that a predetermined clearance is produced between the upper end portion 68*e* of the peripheral wall 68 and the front end of the lock portion 93 on the second wall part 22. Accordingly, the wall surface 22*o* of the second wall part 22 has a concave portion formed along the outer peripheral shape of the front end of the lock portion 93. To close the lid member 85, the user recognizes that the front end of the lock portion 93 needs to be moved to the position of the upper end portion 68*e* of the peripheral wall 68. In this way, the upper end portion 68*e* of the second peripheral wall 68 of the container lid member 62 serves as a positioning portion for the lock portion 93 to close the liquid inlet 35 with the lid member 85 in a reliable manner.

See FIG. 18. Projections 95 are protruded from the sealing surface 87*s* at the end of the sealing surface 87*s* of the lid member 85 on the second wall part 22 side. The projections 95 are provided at the end on the +X direction side and the end on the −X direction side. The projections 95 are provided between the coupling portion 86 and the seal member 88. Each of the projections 95 has a groove 96. See FIGS. 18 and 20. Each of the grooves 96 extends along the protrusion direction of the projection 95 and has a bottom 96*t* on the rotation axis RX side of the lid member 85.

See FIG. 22. While the lid member 85 is rotated toward the liquid inlet 35, the grooves 96 of the projections 95 enter a state where the liquid-receiving portion 80 is positioned ahead of the projections 95 as seen in the protrusion direction. While the liquid inlet 35 is opened by the lid member 85 as shown in FIG. 18, the liquid on the sealing surface 87*s* of the lid member 85 moves to the grooves 96 by gravity. See FIG. 22. When the liquid inlet 35 is being closed with the lid member 85, the liquid accumulated in the grooves 96 is guided by the grooves 96 to the liquid-receiving portion 80 and is retained in the liquid-receiving portion 80.

In this way, the projections 95 serve as gutters to guide the liquid on the sealing surface 87*s* to the liquid-receiving portion 80. Accordingly, it leads to prevent the liquid on the sealing surface 87*s* of the lid member 85 from moving to regions other than the liquid-receiving portion 80 and suppress the soiling of the liquid container 10A with the liquid. In addition, it leads to prevent the liquid on the sealing surface 87*s* of the lid member 85 from moving to the second wall part 22 and adhering to the visual recognition portion 38 with decrease in the visibility of the scale marks 39.

A2-5-4. Injection of the Liquid into the Liquid Inlet:

Referring to FIGS. 18, 20, and 23, the injection of the liquid into the liquid inlet 35 will be described. A liquid injection instrument 600 is used for liquid injection as shown in FIG. 23. The liquid injection instrument is configured such that a bag-like member 601 containing the liquid has an end to which a cylindrical pourer 602 for flowing the liquid out of the bag-like member 601 is attached. The pourer 602 extends from the bag-like member 601. The bag-like member 601 has an overhang portion 603. The overhang portion 603 is a region that overhangs from the attachment portion of the pourer 602 in a direction crossing the extension direction of the pourer 602.

The user injects the liquid while connecting the opening end of the pourer 602 to the liquid inlet 35 and inclining the bag-like member 601. At the time of liquid injection, the user is able to refer to the scale marks 39 in the visual recognition portion 38 to check the amount of the liquid contained in the containment chamber 31.

In FIG. 18, the position of the liquid injection instrument 600 during liquid injection is shown by a chain line. As described above, the concave portion 82*r* is provided at the upper end of the convex wall portion 82 provided on the upper wall surface 23*s* of the third wall part 23 of the container main body 11. A concave portion 98 recessed in the −Y direction and the −Z direction is provided at the corner between the second wall part 22 and the third wall part 23 of the container main body 11. The two concave portions 82*r* and 98 are aligned with the liquid inlet 35 in the Y direction. See FIG. 20. More specifically, the two concave portions 82*r* and 98 are positioned on an axis line PX crossing the central axis CX of the liquid inlet 35 and parallel to the Y direction.

At the time of liquid injection, the two concave portions 82*r* and 98 accept part of the liquid injection instrument 600. The two concave portions 82*r* and 98 accept a gusset portion as an end of the overhang portion 603 of the liquid injection instrument 600 to support the liquid injection instrument 600. Hereinafter, the concave portions 82*r* and 98 will also be called "support concave portions 82*r* and 98". In addition, to differentiate the two portions, the concave portion 82*r* will also be called "first support concave portion 82*r*" and the concave portion 98 will also be called "second support concave portion 98".

According to the liquid container 10A, at the time of liquid injection, the liquid injection instrument 600 is supported by the first support concave portion 82*r* to prevent the posture of the liquid injection instrument 600 from becoming unstable to spill the liquid. In particular, supporting the liquid injection instrument 600 is supported at two points by the first support concave portion 82*r* and the second support concave purport 98 makes it possible to further enhance the stability of the posture of the liquid injection instrument 600 at the time of liquid injection. In addition, according to the liquid container 10A, the liquid moving from the liquid injection instrument 600 to the convex wall portion 82 is to be received by the first support concave portion 82*r* at the upper end. Accordingly, it leads to further suppress the adhesion of the liquid to the outer wall surface of the liquid container 10A. It also leads to further suppress reduction in the visibility of the scale marks 39 caused by the liquid spilling out of the liquid inlet 35.

A2-5-5. Details of the Inner Wall:

See FIG. 21. In the containment chamber 31, the inner wall 65 droops downward in the vicinity of the liquid inlet 35. In the first embodiment, the inner wall 65 has its wall surface extending continuously from the inner peripheral surface of the liquid inlet 35 on the −Y direction side. According to the liquid container 10A, at the time of liquid injection, it leads to move the liquid injected from the liquid inlet 35 along the inner wall 65 and guide the liquid smoothly into the bottom surface 31*b* of the containment chamber 31. Accordingly, it leads to prevent the liquid in the containment chamber 31 from becoming foamed by the liquid poured from the liquid inlet 35 and mixing air bubbles into the liquid. Therefore, it leads to suppress reduction in the capability of supplying the liquid to the liquid-consuming device 500 caused by air bubbles in the liquid.

In addition, it leads to prevent a situation where the position of the liquid surface to be visually recognized through the visual recognition portion 38 becomes unclear due to the foaming of the liquid in the containment chamber 31 to make it difficult for the user to check the amount of the liquid via the visual recognition portion 38. Accordingly, it leads to suppress the spilling of the liquid out of the liquid inlet 35 due to excessive injection of the liquid. Besides, the inner wall 65 facilitates the smooth introduction of the liquid into the containment chamber 31, which suppresses the diffusion of liquid drops to the outside of the containment chamber 31 through the liquid inlet 35 during the injection of the liquid. Accordingly, it leads to suppress the soiling of the liquid container 10A and the user's body with such liquid drops.

See FIG. 20. The inner wall 65 is desirably provided at a position where the inner wall 65 is at least partially visible when the liquid inlet 35 is seen from the outside of the container main body 11. This makes it lead to, at the time of liquid injection, allow the user to check visually the position of the inner wall 65 and prompt the user to pour the liquid toward the inner wall 65. In this case, the liquid inlet 35 may not be seen from the outside of the container main body 11 in the −Z direction as illustrated in FIG. 20 but may be seen in a direction from the position of the user to the liquid inlet 35 at the time of liquid injection.

See FIG. 10. The upper end of the inner wall 65 is coupled to the third wall part 23, and the end of the inner wall 65 on the +X direction side is coupled to the sixth wall part 26. This enhances the strength of the opening housing member 60. See FIG. 12. The end surface of the inner wall 65 on the −X direction side is welded to the film member 63. Accordingly, in the liquid container 10A, the welded area of the film member 63 is increased by the reach area of the inner wall 65 to enhance the joint strength of the film member 63 to the opening housing member 60. In this way, in the liquid container 10A, the inner wall 65 serves as a reinforcement rib in the containment chamber 31 that enhances the strength and durability of the liquid container 10A.

See FIG. 11. In the liquid container 10A, the lower end 65*e* of the inner wall 65 is positioned above the bottom surface 31*b*. Accordingly, it leads to, when the liquid in the containment chamber 31 is consumed in the liquid-consuming device 500, prevent the inner wall 65 from causing the liquid to remain in the area A2 on the +Y direction side. In the first embodiment, the lower end 65*e* of the inner wall 65 is positioned closer to the bottom surface 31*b* than the upper surface 31*u* of the containment chamber 31. The lower end 65*e* of the inner wall 65 is positioned above the lower-limit scale mark 39L. More specifically, when the Z direction distance between the upper surface 31*u* and the lower-limit scale mark 39L is designated as H, the lower end 65*e* of the inner wall 65 is positioned at a height ¼ H or less from the lower-limit scale mark 39L. Accordingly, the inner wall 65 is kept contact with the liquid until the position of the liquid surface comes close to the position of the lower-limit scale mark 39L. This makes it possible to obtain the effect of suppressing the foaming of the liquid and the occurrence of liquid drops in the containment chamber 31 at the time of liquid injection as described above in a wide range until the liquid in the containment chamber 31 comes close to the lower-limit amount.

See FIG. 21. The inner wall 65 has an end convex portion 101 that protrudes along the insertion direction at the lower end 65*e*. The end convex portion 101 is locally thickened at the lower end 65*e* of the inner wall 65 and projected from the wall surface of the inner wall 65. In the first embodiment, the end convex portion 101 projects toward the liquid inlet 35 in the +Y direction. Therefore, at the time of liquid injection, when the position of the liquid surface in the containment chamber 31 is under the end convex portion 101, the end convex portion 101 dampens the momentum of the liquid flowing downward along the inner wall 65. Accordingly, even when the position of the liquid surface in the containment chamber 31 is under the lower end 65*e* of the inner wall 65, it leads to suppress the foaming of the liquid in the containment chamber 31 at the time of liquid injection. It also leads to suppress the occurrence of liquid drops caused by the liquid bumping the liquid surface of the liquid in the containment chamber 31. Accordingly, it leads to prevent a situation where such liquid drops are diffused to the outside through the liquid inlet 35 and soil the outer wall surface of the liquid container 10A and the user's body. In the first embodiment, the upper surface of the end convex portion 101 facing in the +Z direction constitutes a plane along the Y direction. Accordingly, the upper surface dampens more effectively the momentum of the liquid flowing along the inner wall 65, thereby to further suppress the foaming of the liquid in the containment chamber 31 and the diffusion of liquid drops from the liquid inlet 35 as described above.

In the liquid container 10A, the inner wall 65 has the end convex portion 101 that increases the coupling portion between the inner wall 65 and the inner wall surface 26*s* of the containment chamber 31. Accordingly, the inner wall 65 is fixed more firmly to the inner wall surface 26*s* of the containment chamber 31. In addition, the end convex portion 101 increases the welded area of the lower end 65*e* of the inner wall 65 to the film member 63 as shown in FIG. 12. This suppresses separation of the film member 63 from the inner wall 65 with the lower end 65*e* of the inner wall 65 as an origin point. In this way, in the liquid container 10A, the end convex portion 101 of the inner wall 65 enhances the fixity of the inner wall 65 to the wall parts 25 and 26, thereby further enhancing the function of the inner wall 65 as reinforcement rib.

See FIG. 11. The upper end of the inner wall 65 has a communication portion 102 that allows communication between the two adjacent areas in the containment chamber 31 divided by the inner wall 65 in the insertion direction. See FIGS. 11 and 12. The communication portion 102 is formed as a flow path between a concave portion that is locally recessed in the +X direction at the end of the inner wall 65 on the −X direction side and the film member 63. Accordingly, at the time of injection of the liquid from the liquid inlet 35, the air in the area on the insertion direction side of the inner wall 65 in the containment chamber 31 is allowed to be escaped to the liquid inlet 35 through the communication portion 102. This further facilitates the smooth injection of the liquid into the liquid container 10A.

Figure 24A:
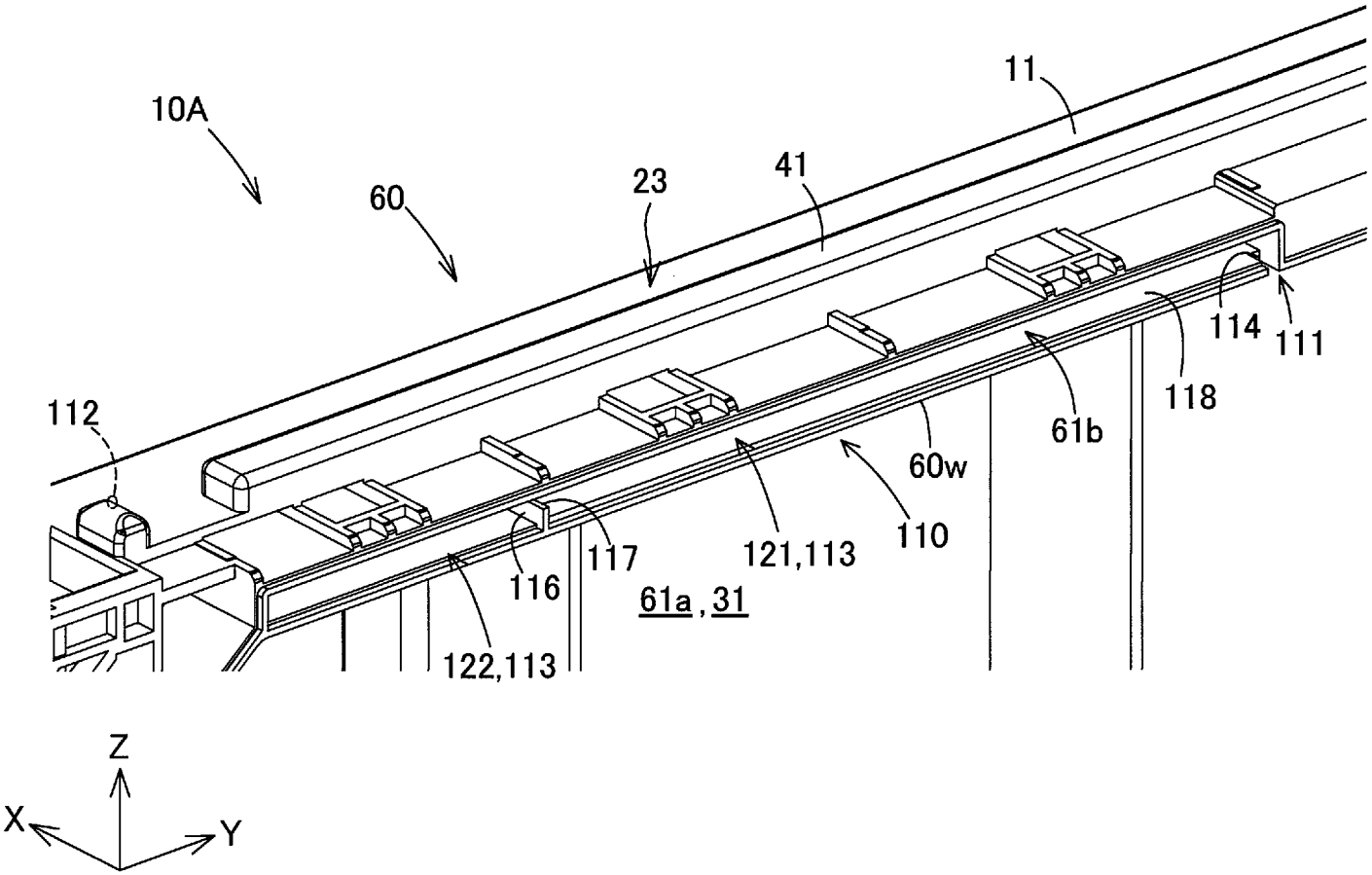
FIG. 24A is a schematic perspective view of a region with an air introduction portion.
Figure 24B:
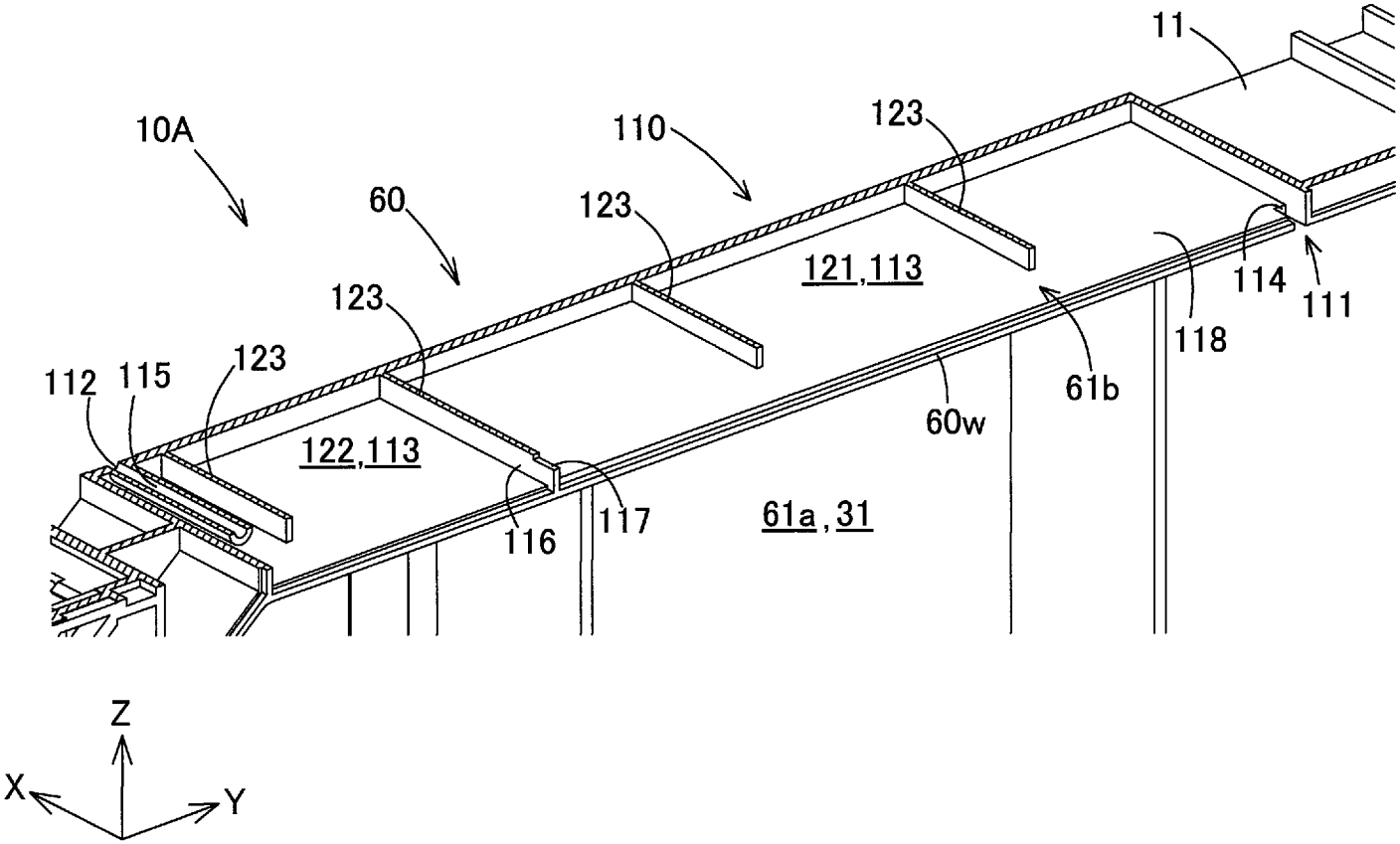
FIG. 24B is a schematic perspective view of an internal structure of the air introduction portion.
Figure 25:
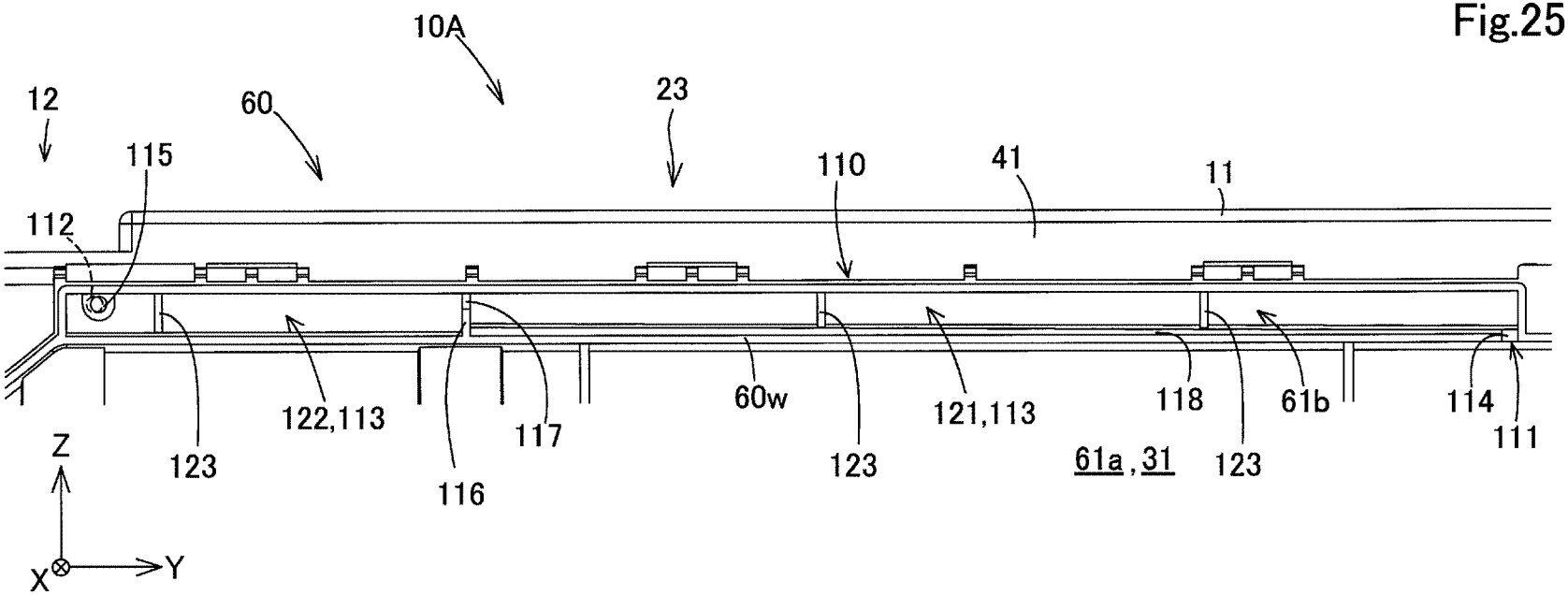
FIG. 25 is a schematic side view of the region with the air introduction portion.

A2-6. Configuration of the Air Introduction Portion:

Referring additionally to FIGS. 24A, 24B, and 25, the configuration of the air introduction portion 110 provided in the liquid container 10A will be described. FIG. 24A is a schematic perspective view of a region of the opening housing member 60 where the second concave portion 61*b* constituting the air introduction portion 110 is formed. FIG. 24B is a schematic perspective view of an internal structure of the air introduction portion 110. FIG. 24B does not illustrate a wall covering the upper side of the air introduction portion 110, which is illustrated in FIG. 24A. FIG. 25 is a schematic side view of the same region in the opening housing member 60 as that illustrated in FIG. 24A, which is seen in the +X direction.

See FIGS. 10 to 13. The air introduction portion 110 is provided above the containment chamber 31. The air introduction portion 110 is provided along the insertion direction in the area on the first wall part 21 side as seen in the insertion direction. The air introduction portion 110 is provided under the rail portion 41. The air introduction portion 110 connects the containment chamber 31 to the outside of the liquid container 10A. In the liquid container 10A, as the liquid in the containment chamber 31 is consumed, the external air is introduced into the containment chamber 31 through the air introduction portion 110. See FIGS. 24A and 24B. The air introduction portion 110 has a containment chamber air opening 111, a container air opening 112, and an air path 113.

The containment chamber air opening 111 is open in the containment chamber 31 as shown in FIGS. 24A and 24B. The containment chamber air opening 111 serves as an air inlet/outlet for the containment chamber 31. See FIG. 12. The containment chamber air opening 111 is formed as a through hole between a concave portion that is locally recessed in the +X direction at the end of the wall portion 60*w* of the opening housing member 60 on the −X direction side and the film member 63.

See FIGS. 11 and 12. The containment chamber air opening 111 is provided in the central region of the containment chamber 31 as seen in the longitudinal direction. As described above, the "center" here refers to a substantially central position that is separated to some extent from the both ends, and the "central region" refers to a region that is separated to some extent from the both ends. When the Y direction length of the containment chamber 31, in other words the longitudinal direction length of the containment chamber 31, is designated as L, the containment chamber air opening 111 is formed in an area that is centered on the center of the containment chamber 31 in the Y direction and has a the Y direction width of 0.5·L or less. The containment chamber air opening 111 is desirably provided at a position not too distant from the center of the containment chamber 31 in the Y direction. The Y direction width of the formation area of the containment chamber air opening 111 as seen is desirably 0.3·L or less, more desirably 0.1·L or less.

See FIGS. 24A and 24B. The container air opening 112 is open in the outer wall surface of the sixth wall part 26 as wall surface on the +X direction side. In FIGS. 24A and 25, the container air opening 112 is hidden from view and thus is shown by a broken line for the sake of convenience. See FIG. 25. The container air opening 112 is open to the outside of the container main body 11 and serves as an air inlet/outlet between the air introduction portion 110 and the outside of the liquid container 10A. See FIG. 11. The container air opening 112 is open at the first end 12. The container air opening 112 is open in the vicinity of the first wall part 21. The container air opening 112 is connected to the air path 113 through a penetration flow path 115 formed as a through hole extending from the sixth wall part 26 in the X direction in an area on the upper side of the air path 113. See FIG. 24B. The end of the penetration flow path 115 on the −X direction side is open at a position closer to the fifth wall part 25, which is shown in FIG. 10, as seen in the X direction.

See FIGS. 24A, 24B, and 25. The air path 113 extends along the insertion direction and is connected to the containment chamber air opening 111 and the container air opening 112. The air path 113 is divided into a first air path portion 121 on the +Y direction side and a second air path portion 122 on the −Y direction side by a path division wall 116 between the containment chamber air opening 111 and the container air opening 112. See FIG. 25. The path division wall 116 is positioned closer to the container air opening 112 and the penetration flow path 115 than the containment chamber air opening 111 as seen in the insertion direction. See FIG. 10. The end of the path division wall 116 on the +X direction side is coupled to the inner wall surface 26*s* of the sixth wall part 26, and the end of the path division wall 116 on the −X direction side is welded to the film member 63.

See FIGS. 24A, 24B, and 25. The first air path portion 121 and the second air path portion 122 communicate with each other via the air communication portion 117 penetrating through the path division wall 116 in the thickness direction. In the first embodiment, the air communication portion 117 penetrates through the path division wall 116 in the insertion direction. See FIGS. 11 and 12. In the liquid container 10A, the air communication portion 117 is formed as a through hole between a concave portion that is locally recessed in the +X direction at the end of the path division wall 116 on the −X direction side and the film member 63. See FIG. 25. The air communication portion 117 is provided at the upper end of the path division wall 116.

See FIGS. 24A, 24B, and 25. The containment chamber air opening 111 is provided in the first air path portion 121. The containment chamber air opening 111 is provided at the lower end of the first air path portion 121. The containment chamber air opening 111 is positioned at the end of the first air path portion 121 in the +Y direction. The containment chamber air opening 111 is also positioned at the end of the first air path portion 121 in the −X direction.

See FIGS. 24B and 25. The container air opening 112 is connected to the second air path portion 122 via the penetration flow path 115. The container air opening 112 is connected via the penetration flow path 115 to the end of the second air path portion 122 on the −Y direction side. The container air opening 112 is connected via the penetration flow path 115 to the second air path portion 122 at a position closer to the upper end than the lower end of the second air path portion 122.

See FIGS. 24A, 24B, and 25. The air path 113 has an inclined wall surface 118 that is a bottom surface inclined downward from the container air opening 112 to the containment chamber air opening 111. The inclined wall surface 118 is provided in the first air path portion 121. The inclined wall surface 118 is connected to the containment chamber air opening 111. See FIG. 25. The inclined wall surface 118 is inclined to be gradually lower in the +Y direction toward the containment chamber air opening 111. See FIGS. 24A and 24B. The inclined wall surface 118 is also inclined to be gradually lower in the −X direction toward the containment chamber air opening 111.

See FIG. 24B. Each of the first air path portion 121 and the second air path portion 122 has one or more path ribs 123 extending along the X direction. The first air path portion 121 has the plurality of path ribs 123 aligned in the Y direction at predetermined intervals. The second air path portion 122 has one path rib 123 close to the end on the −Y direction side.

See FIG. 25. Each of the path ribs 123 extends in the air path 113 in the Z direction. See FIG. 24B. Each of the path ribs 123 extends in the −X direction from the end of the air path 113 on the +X direction side. Each of the path rib 123 has an end on the −X direction side positioned closer to the +X direction side than the end of the air path 113 in the X direction so as not to interfere with the distribution of the air in the air path 113.

See FIG. 24B. In the second air path portion 122, the path rib 123 extends along the penetration flow path 115 in the X direction on the +Y direction side of the penetration flow path 115. The end of the path rib 123 of the second air path portion 122 on the −X direction side is more protruded in the −X direction than the end of the penetration flow path 115 on the −X direction side.

See FIGS. 10 and 11. In the liquid container 10A, the air introduction portion 110 is provided above the containment chamber 31 in the area closer to the first wall part 21 than the center of the container main body 11 in the Y direction. In contrast, the liquid inlet 35 is provided in the area closer to the second wall part 22 than the center of the container main body 11 in the Y direction. In this way, in the liquid container 10A, the air introduction portion 110 is separated from the liquid inlet 35 in the −Y direction. Accordingly, it leads to extend the opening width of the liquid inlet 35 in the Y direction and to increase the opening area of the liquid inlet 35 while avoiding interference with the air introduction portion 110. In addition, the air introduction portion 110 and the liquid inlet 35 are aligned in series in the Y direction, which makes it lead to decrease the X direction width of the container main body 11 and make the liquid container 10A compact in size, as compared to the case where the air introduction portion 110 and the liquid inlet 35 are aligned in parallel in the X direction.

See FIGS. 24B and 25. In the air introduction portion 110 of the liquid container 10A, the container air opening 112 is connected to the air path 113 at a position above the containment chamber air opening 111. Accordingly, even if the liquid enters the air path 113, it leads to suppress the movement of the liquid from the air path 113 to the container air opening 112. This suppresses the leaking of the liquid from the container air opening 112.

See FIG. 25. In the air introduction portion 110 of the liquid container 10A, the air path 113 has the inclined wall surface 118. Therefore, even if the liquid enters the air path 113 through the containment chamber air opening 111, the liquid is guided by gravity to the containment chamber air opening 111 along the inclined wall surface 118 and returned to the containment chamber 31. Accordingly, it leads to suppress the leaking of the liquid from the containment chamber 31 through the air introduction portion 110.

As shown in FIG. 25, in the air introduction portion 110 of the liquid container 10A, the containment chamber air opening 111 is provided in the central region of the containment chamber 31 in the Y direction. In the central region of the containment chamber 31 in the Y direction, when the liquid surface in the containment chamber 31 is swung and displaced vertically and alternately between the both ends in the Y direction of the containment chamber 31, the displacement of the liquid surface is relatively small. Accordingly, even if the liquid surface in the containment chamber 31 is swung greatly, it leads to suppress the entry of the liquid from the containment chamber 31 into the air introduction portion 110 through the containment chamber air opening 111 and suppress the leaking of the liquid to the outside of the liquid container 10A through the air introduction portion 110. In the liquid container 10A of the first embodiment, the Y direction aligns with the longitudinal direction of the containment chamber 31. In the containment chamber 31, the liquid is likely to swing such that the position of the liquid surface is alternately displaced between the both ends in the longitudinal direction. In addition, in the central region in the longitudinal direction with such swings, the displacement of the liquid surface is further suppressed as compared to the other regions. Accordingly, in the liquid container 10A in which the longitudinal direction of the containment chamber 31 aligns with the Y direction, it leads to further suppress the entry of the liquid into the containment chamber air opening 111 due to the swings of the liquid. The swings of the liquid surface in the containment chamber 31 as described above occur, for example, while the liquid container 10A is shaken to stir the liquid in the containment chamber 31, or while the liquid container 10A is being loaded into or unloaded from the liquid-consuming device 500, or during transport of the liquid container 10A.

See FIGS. 24A, 24B, and 25. In the air introduction portion 110 of the liquid container 10A, the air path 113 is divided by the path division wall 116 into the first air path portion 121 and the second air path portion 122. Accordingly, even if the liquid enters the air introduction portion 110 through the containment chamber air opening 111, it leads to suppress the movement of the liquid from the first air path portion 121 to the second air path portion 122. Accordingly, it leads to suppress the leaking of the liquid to the outside of the liquid container 10A through the air introduction portion 110.

See FIGS. 24B and 25. In the air introduction portion 110 of the liquid container 10A, the containment chamber air opening 111 is provided at the end of the first air path portion 121 opposite to the path division wall 116. In this way, the containment chamber air opening 111 is separated from the path division wall 116, which makes it lead to prevent a situation where the liquid having entered from the containment chamber air opening 111 into the first air path portion 121 reaches the path division wall 116.

See FIGS. 24B and 25. In the liquid container 10A, the path division wall 116 is positioned closer to the container air opening 112 and the penetration flow path 115 than the containment chamber air opening 111 to make further longer the distance between the containment chamber air opening 111 and the path division wall 116. Accordingly, it leads to further prevent the liquid having entered into the first air path portion 121 from reaching the path division wall 116.

In the liquid container 10A, the first air path portion 121 and the second air path portion 122 have path ribs 123. This prevents a situation where the air flow path in the air path portions 121 and 122 is blocked by deformation of the wall part constituting the air path 113. In the first air path portion 121, the path ribs 123 prevent the liquid having entered into the first air path portion 121 from reaching the path division wall 116. In the second air path portion 122, as described above, the ends of the path ribs 123 on the −X direction side are positioned closer to the −X direction side than the end of the penetration flow path on the −X direction side. This prevents the liquid having reached the second air path portion 122 from entering the penetration flow path 115.

See FIGS. 24B and 25. In the liquid container 10A, the air communication portion 117 allowing the first air path portion 121 and the second air path portion 122 to communicate with each other is provided at the upper end of the path division wall 116. This further prevents the liquid having entered the first air path portion 121 from going over the path division wall 116 and reaching the second air path portion 122.

See FIGS. 24B and 25. In the air introduction portion 110 of the liquid container 10A, the container air opening 112 is connected to the end of the second air path portion 122 opposite to the path division wall 116. In this way, the container air opening 112 is connected to the second air path portion 122 at a position separated from the path division wall 116, which makes it lead to further prevent the liquid having gone over the path division wall 116 and entered the second air path portion 122 from reaching the container air opening 112. In addition, in the liquid container 10A, the connection position of the container air opening 112 to the second air path portion 122 is closer to the upper end of the second air path portion 122, which makes the liquid in the second air path portion 122 less likely to reach the container air opening 112.

As described above with reference to FIGS. 11 and 12, in the liquid container 10A, the concave portions 61*a*, 61*b*, and 61*c* of the opening housing member 60 are closed with the film member 63 to form the containment chamber 31, the air introduction portion 110, and the outlet flow path 78. As above, according to the liquid container 10A, the containment chamber 31, the outlet flow path 78, and the air introduction portion 110 are simply formed by a simple structure in the container main body 11.

A2-7. Loading of the Liquid Container into the Liquid Supply Portion:

Referring additionally to FIGS. 26, 27, and 28, the loaded state of the liquid container 10A in the liquid supply portion 520 of the liquid-consuming device 500 will be described. FIG. 26 is a schematic perspective view of the liquid supply portion 520 loaded with the plurality of liquid containers 10A. FIG. 27 is a schematic plane view of the liquid supply portion 520 loaded with the plurality of liquid containers 10A as seen in the −Z direction. FIG. 28 is a schematic cross-sectional view of the liquid container 10A and the liquid supply portion 520 taken along line 28-28 illustrated in FIG. 27. In FIG. 28, no hatching is applied to the cross section for the sake of convenience.

See FIG. 28. The liquid supply portion 520 has a liquid supply pipe 523 that extends in the +Y direction. When the liquid container 10A is loaded, the front end of the liquid supply pipe 523 on the +Y direction side is inserted into and connected to the liquid outlet 33 of the liquid container 10A. See FIGS. 26 to 28. The liquid supply pipe 523 is connected to a flexible tube 513. The liquid supply portion 520 flows the liquid in the containment chamber 31 of the liquid container 10A from the liquid outlet 33 into the liquid supply pipe 523 by suction power generated by a suction pump 524 to supply the liquid to the head 511, which is shown in FIG. 1, through the tube 513.

See FIG. 28. The liquid supply portion 520 has the rod 525 described above with reference to FIG. 17 under the liquid supply pipe 523. The rod 525 extends in the +Y direction in parallel with the liquid supply pipe 523. As described above, when the liquid container 10A is loaded into the liquid supply portion 520, the rod 525 is inserted into the second concave portion 55*b* of the liquid container 10A.

As shown in FIG. 28, the liquid supply portion 520 further has a device-side terminal portion 526 above the liquid supply pipe 523. The device-side terminal portion 526 has a connection terminal 527 that electrically connects to the electrical connection portion 50 of the liquid container 10A. As described above, when the liquid container 10A is loaded into the liquid supply portion 520, the connection terminal 527 of the device-side terminal portion 526 comes into contact with the electrode plates 53 of the electrical connection portion 50 from above. The electrode plates 53 are shown in FIG. 9.

The liquid supply portion 520 has an identification member 528 on the bottom surface. The identification member 528 is formed as a rectangular structure that projects upward from the bottom surface portion. When the liquid container 10A is loaded into the liquid supply portion 520, the identification member 528 is stored in the concave portion 58 at the lower end corner of the first wall part 21 of the liquid container 10A.

The inner wall surfaces of the concave portions 58 of the plurality of liquid containers 10A to be loaded in the liquid-consuming device 500 are different in shape from one another according to the type of the liquid contained. For example, in the first embodiment, one of the types of the liquid contained is the color of the ink. The identification member 528 of the liquid supply portion 520 is formed in a shape that fits to the shape of the inner wall surface of the concave portion 58 in the liquid container 10A to be loaded. This prevents the liquid container 10A from being inserted into an incorrect loading portion.

A2-8. Function of the Rail Portion:

Referring to FIG. 26, the upper end of the container insertion opening 521 included in the liquid supply portion 520 of the liquid-consuming device 500 has a guide groove 522 extending along the Y direction. The guide groove 522 is shaped to project from the upper wall surface 23*s* of the liquid container 10A so that the first rail portion 41 extending along the insertion direction fits therein. The lower end of the container insertion opening 521 has a guide groove 522 that is shaped to project from the bottom wall surface 24*s* of the liquid container 10A so that the second rail portion 42 extending along the insertion direction fits therein as shown in FIG. 28.

When the liquid container 10A is loaded into the liquid-consuming device 500, the first rail portion 41 is inserted into the guide groove 522 to guide the insertion of the liquid container 10A into the container insertion opening 521. Therefore, this makes it easy for the user to load or unload the liquid container 10A into or from the liquid supply portion 520 of the liquid-consuming device 500. In particular, in the liquid container 10A, the insertion of the liquid container 10A is guided by the two vertically provided rail portion 41 and 42, whereby the posture of the liquid container 10A becomes further stabled at the time of insertion of the liquid container 10A into the liquid-consuming device 500.

In the loaded state, the two rail portions 41 and 42 are more extended in the +Y direction than the guide groove 522. Accordingly, the insertion of the liquid container 10A is guided until the loading into the liquid-consuming device 500 is completed. In addition, the two rail portions 41 and 42 are lengthened in the Y direction, which allows the liquid container 10A to be inserted in a stabled posture into various types of liquid-consuming devices with a guide groove lengthened in the Y direction.

Referring to FIGS. 5, 7, and 10 to 12, the manufacturing process of the liquid container 10A will be described. The rail portions 41 and 42 serve as reference regions for positioning the liquid container 10A at the time of assembly.

See FIG. 10. In a first step, the opening housing member 60 is prepared. In this step, the rail portions 41 and 42 may be used as handling portions for treating the opening housing member 60. In the first step, the electrical connection portion 50 is attached to the concave portion 51 of the opening housing member 60. In addition, the filter 72 is arranged in the filter chamber 71 of the opening housing member 60 and the filter chamber 71 is sealed with the film member 74. In the first step, the film member 63 is welded to the opening housing member 60 and the openings in the concave portions 61*a*, 61*b*, and 61*c* of the opening housing member 60 are blocked at a time as shown in FIG. 12.

In a second step, the container lid member 62, which is shown in FIG. 10, is attached to the opening housing member 60 to which the film member 63 is welded. As shown in FIGS. 5 and 7, in the state in which the container lid member 62 is properly attached to the opening housing member 60, the end surface 67*t* of the peripheral wall 67 of the container lid member 62 on the +X direction side is in abutment with the rail portions 41 and 42. The end surface 67*t* of the peripheral wall 67 on the +X direction side is in contact with the rail portions 41 and 42 in contact areas CA extending linearly along the insertion direction. In the second step, the film member 63 is covered with the main body wall 66 of the container lid member 62, and the film member 74 sealing the filter chamber 71 is covered with the filter chamber wall 67*f* as part of the peripheral wall 67 as shown in FIG. 7.

In this way, in the second step, when the container lid member 62 is attached to the opening housing member 60, the peripheral walls 67 of the container lid member 62 come into abutment with the rail portions 41 and 42 and serve as positioning portions for positioning the container lid member 62. The rail portions 41 and 42 serve as reference regions for positioning the container lid member 62.

According to the liquid container 10A, in the opening housing member 60, the container lid member 62 is positioned with reference to the rail portions 41 and 42 that are easy to see and conspicuous. Therefore, it leads to suppress the creation of a gap between the container lid member 62 and the opening housing member 60 at the time of manufacture of the liquid container 10A. Accordingly, it leads to prevent the entry of foreign matter through such a gap into the liquid container 10A. This suppresses the occurrence of a defect in the liquid container 10A due to the entry of foreign matter, such as breakage of the film members 63 and 74, for example.

According to the liquid container 10A, the peripheral walls 67 come into contact with the rail portions 41 and 42 in the contact areas CA extending linearly along the insertion direction. In this way, the contact areas of the positioning portion and the reference region are made large to enhance the accuracy of positioning the container lid member 62 in the rail portions 41 and 42. Accordingly, it leads to further suppress the creation of a gap between the opening housing member 60 and the container lid member 62.

According to the liquid container 10A, the rail portions 41 and 42 are provided in the central region of the upper wall surface 23*s* or the bottom wall surface 24*s* in the X direction. Accordingly, in the manufacturing process, to bring the peripheral walls 67 of the container lid member 62 into abutment with the rail portions 41 and 42, the peripheral walls 67 of the container lid member 62 are pressed to run deeply over the outer wall surface of the opening housing member 60 in the X direction. Accordingly, it leads to further suppress the creation of a gap between the opening housing member 60 and the container lid member 62. See FIG. 7. In the liquid container 10A, the filter chamber wall 67*f* of the peripheral wall 67 also comes into abutment with the end of the second rail portion 42 on the −Y direction side and serves as one of the positioning portions for positioning the container lid member 62. Accordingly, it leads to further suppress the occurrence of a gap between the opening housing member 60 and the container lid member 62.

In the manufacturing process of the liquid container 10A, as a reference for positioning the container lid member 62, the rail portions 41 and 42 serving as guides for loading or unloading the liquid container 10A into or from the liquid-consuming device 500 are used. Therefore, it is more efficient than in the case of providing the opening housing member 60 with a new positioning portion for the container lid member 62.

In the second step, the container lid member 62 is attached to the opening housing member 60 using the attachment positions of the concave portion constituting the liquid-receiving portion 80, the liquid inlet 35, and the lid member 85 as guides for arranging the outer peripheral end 62*e* of the container lid member 62. That is, the outer peripheral end 66*e* of the container lid member 62 is configured to be used as one of the positioning portions for attaching the container lid member 62 to the opening housing member 60. This suppresses the creation of a gap between the opening housing member 60 and the container lid member 62. Even if a gap is created between the outer peripheral end 62*e* of the container lid member 62 and the opening housing member 60, the concave portion constituting the liquid-receiving portion 80 receives foreign matter to suppress the entry of the foreign matter into the gap. In addition, the liquid-receiving portion 80 receives the liquid spilling out of the liquid inlet 35 to suppress the degradation of the container lid member 62 due to soiling. Accordingly, it leads to suppress the adhesion of the liquid to the body of the person detaching the container lid member 62 from the opening housing member 60.

In the second step, the container lid member 62 is attached to the opening housing member 60 using the handhold portion 40 as a guide for arranging the end region 67*e* of the container lid member 62. That is, the end region 67*e* of the container lid member 62 is configured to be used as one of the positioning portions for attaching the container lid member 62 to the opening housing member 60. As described above, in the liquid container 10A, the container lid member 62 has a plurality of regions configured to serve as positioning portions. Therefore, it leads to further suppress the creation of a gap between the opening housing member 60 and the container lid member 62.

A3. Summary of the First Embodiment

As described above, according to the liquid container 10A of the first embodiment, it leads to prevent a situation where the user cannot check the liquid amount via the visual recognition portion 38. Accordingly, it leads to prevent a situation where it is difficult for the user to check the amount of the liquid contained in the liquid container. Besides, according to the liquid container 10A of the first embodiment, it leads to obtain various advantageous effects described above in relation to the first embodiment.

B. Second Embodiment

Figure 29:
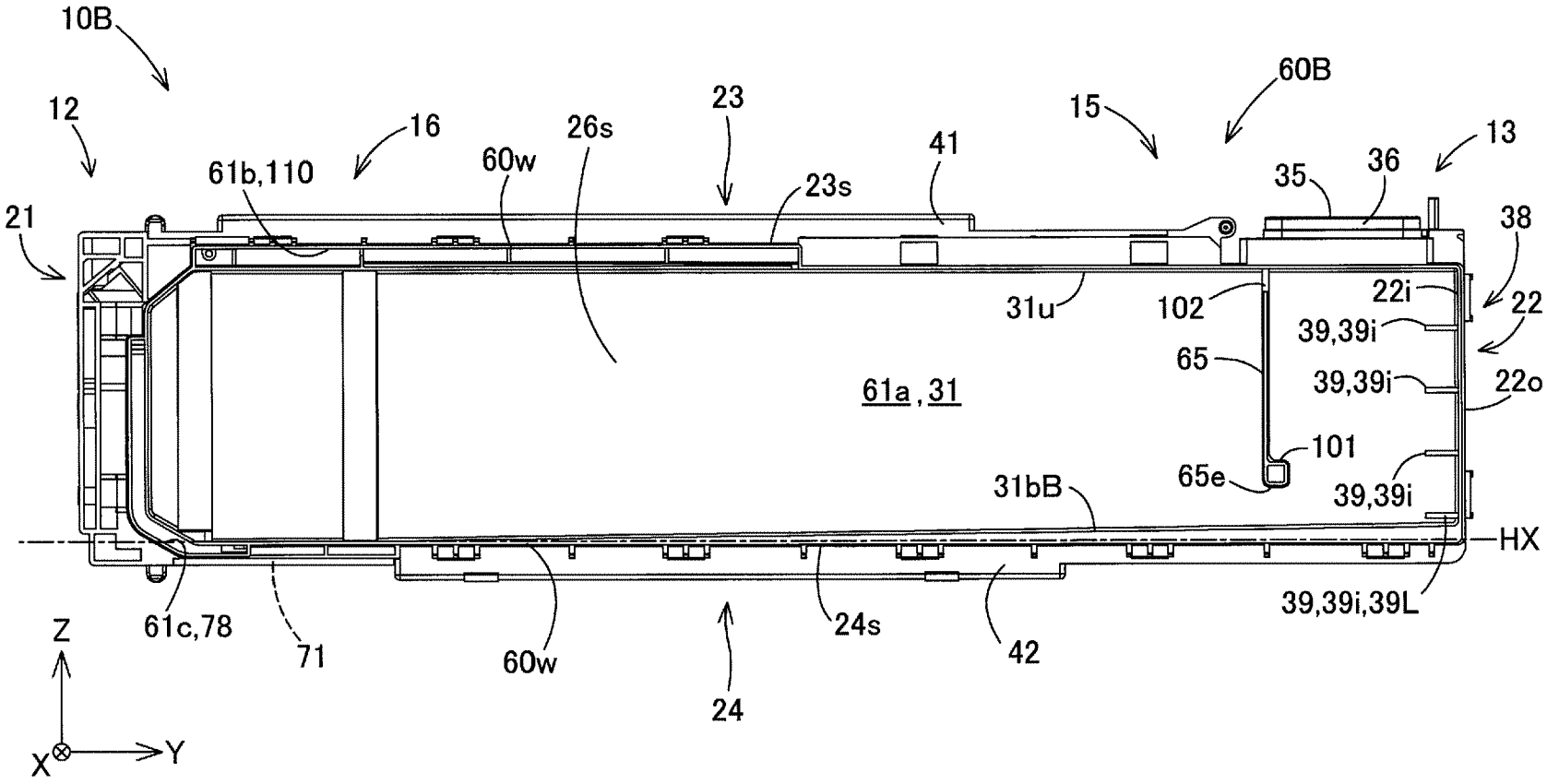
FIG. 29 is a schematic side view of an opening housing member included in a liquid container according to a second embodiment.

Referring to FIG. 29, the configuration of a liquid container 10B according to a second embodiment will be described. FIG. 29 is a schematic side view of an opening housing member 60B included in the liquid container 10B of the second embodiment as seen in the +X direction. FIG. 29 illustrates an axis line HX parallel to the horizontal direction with the liquid container 10B in the loaded state. The configuration of the liquid container 10B of the second embodiment is almost identical to that of the liquid container 10A of the first embodiment except that the containment chamber 31 has an inclined bottom surface 31*b*B and the reinforcement walls 64 are not provided. The liquid container 10B of the second embodiment is loaded into the liquid-consuming device 500 described above in relation to the first embodiment.

In the liquid container 10B of the second embodiment, the bottom surface 31*b*B of the containment chamber 31 is declined toward to the filter chamber 71 such that the filter chamber 71 side is positioned under the liquid inlet 35 side as seen in the insertion direction. The bottom surface 31*b*B of the containment chamber 31 is inclined and becomes gradually lower in the −Y direction. This further enhances the flowability of the liquid into the filter chamber 71 to increase the capability of the liquid container 10B of supplying the liquid to the liquid-consuming device 500. Even when the liquid becomes low in the containment chamber 31, the inclination of the bottom surface 31*b*B with respect to a horizontal line makes to guide the remaining liquid into the filter chamber 71. This prevents the liquid from remaining in the containment chamber 31. Accordingly, it leads to prevent a situation where, even though the user has recognized the remaining liquid via the visual recognition portion 38, the supply of the liquid from the liquid container 10B to the liquid-consuming device 500 is stopped unexpectedly. While facilitating the flowing of the liquid into the filter chamber 71, the bottom surface 31*b*B desirably has a slight inclination angle to suppress the guiding of foreign matter settled on the bottom surface 31*b*B to the filter chamber 71. The containment chamber 31 of the second embodiment may be provided with the reinforcement walls 64 described above first embodiment and shown in FIG. 11.

As described above, according to the liquid container 10B of the second embodiment, the bottom surface 31*b*B of the containment chamber 31 inclined toward the filter chamber 71 enhances the capability of supplying the liquid to the liquid-consuming device 500. In addition, according to the liquid container 10B of the second embodiment, the same various advantageous effects as those of the liquid container 10A of the first embodiment are provided.

C. Third Embodiment

Figure 30:
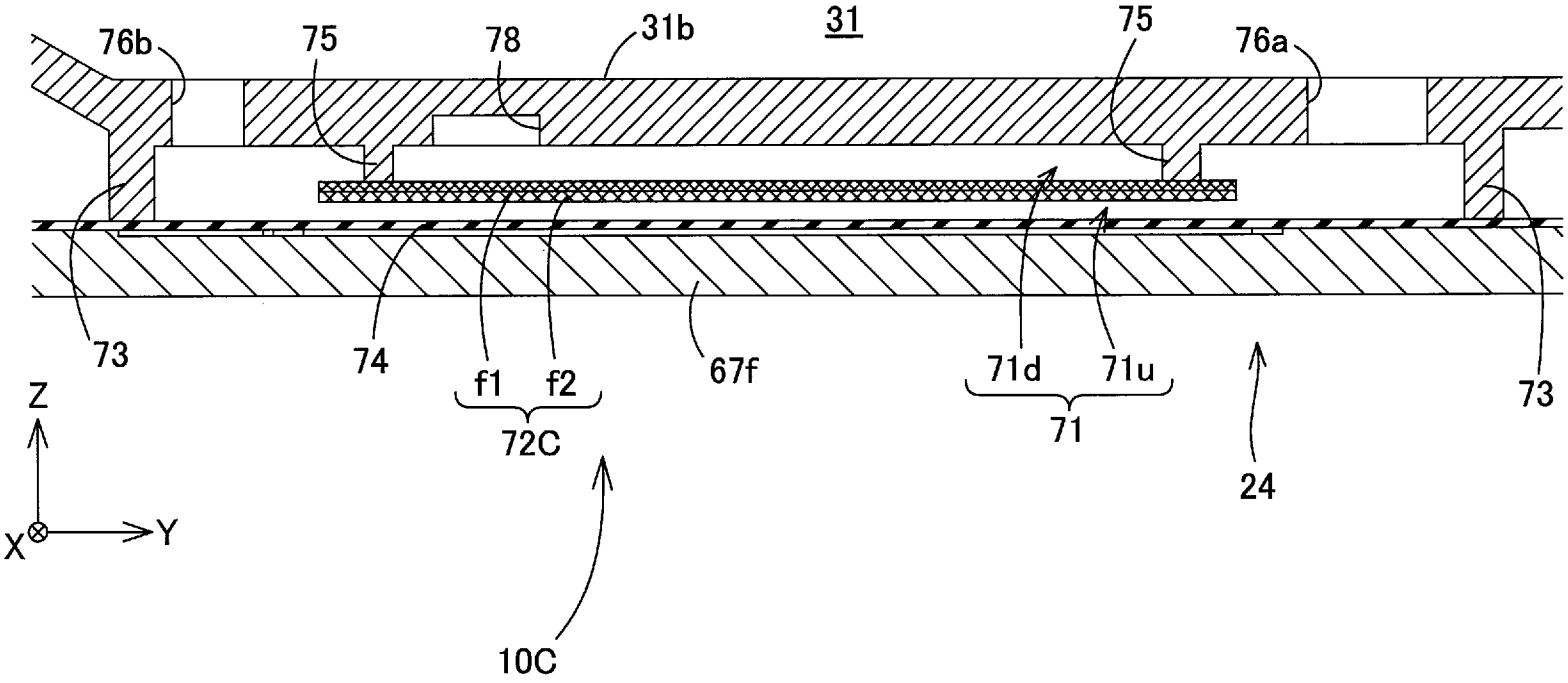
FIG. 30 is a schematic cross-sectional view of a filter chamber in a liquid container according to a third embodiment.

Referring to FIG. 30, the configuration of a liquid container 10C according to a third embodiment will be described. FIG. 30 is a schematic cross-sectional view of the filter chamber 71 provided in the liquid container 10C of the third embodiment taken along the Y direction. The configuration of the liquid container 10C in the third embodiment is almost identical to that of the liquid container 10A of the first embodiment except that the filter chamber 71 has a filter 72C instead of the filter 72 described above first embodiment.

The liquid container 10C of the third embodiment is loaded into the liquid-consuming device 500 described above first embodiment.

The filter 72C of the third embodiment has a multilayer structure in which two or more members are layered with differences in the density of fine pores through which the liquid passes. More specifically, the filter 72C has a two-layer structure in which a rough first filter layer f1 is arranged in the lower position, and a fine second filter layer f2 is arranged in the upper position.

According to the liquid container 10C of the third embodiment, the filter 72C is configured to remove efficiently foreign matter of various sizes and to suppress the clogging of the filter 72C. The filter 72C is not limited to a two-layer structure. The filter 72C may be configured such that a plurality of layers are stacked depending on the sizes of foreign matter to be removed.

As described above, according to the liquid container 10C of the third embodiment, the multi-layered filter 72C enhances the capability of removing foreign matter from the liquid. In addition, according to the liquid container 10C of the third embodiment, the same various advantageous effects as those of the liquid container 10A of the first embodiment are provided.

D. Fourth Embodiment

Figure 31A:
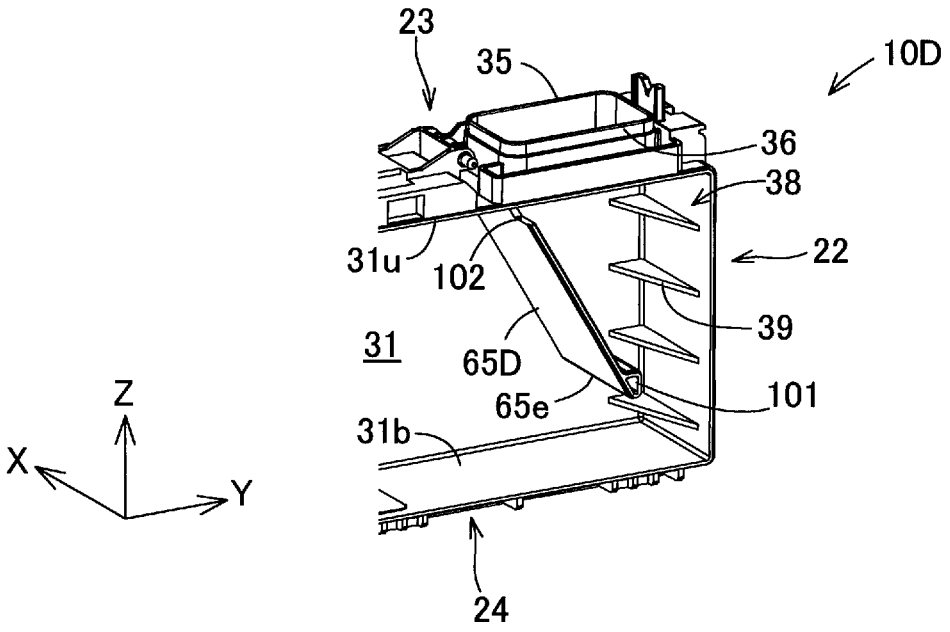
FIG. 31A is a schematic perspective view of an inner wall according to a fourth embodiment.
Figure 31B:
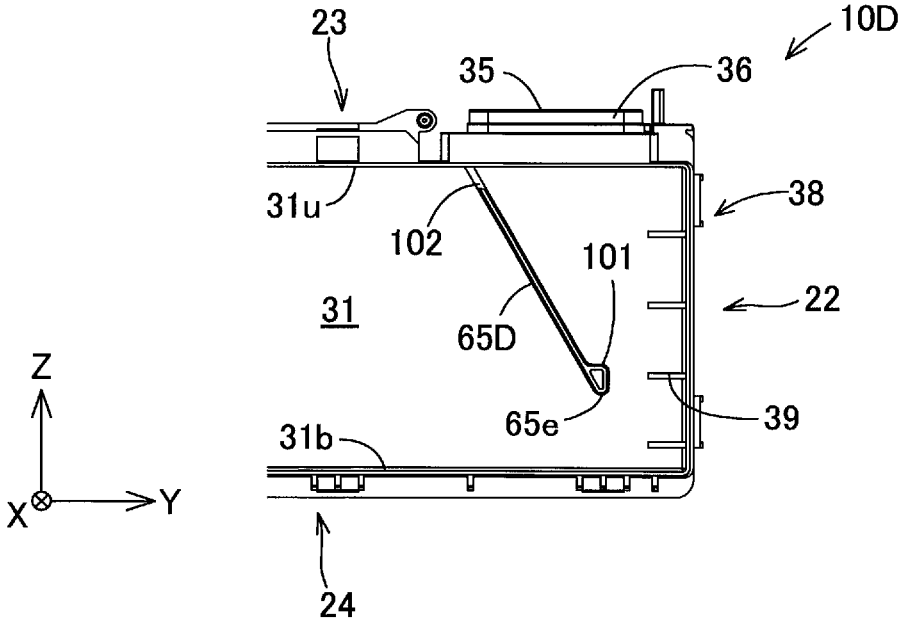
FIG. 31B is a schematic side view of the inner wall according to the fourth embodiment.

Referring to FIGS. 31A and 31B, the configuration of a liquid container 10D according to a fourth embodiment will be described. FIG. 31A is a schematic perspective view of an inner wall 65D provided in the containment chamber 31 of the liquid container 10D of the fourth embodiment. FIG. 31B is a schematic side view of the inner wall 65D provided in the containment chamber 31 of the liquid container 10D of the fourth embodiment as seen in the +X direction. The configuration of the liquid container 10D of the fourth embodiment is almost identical to that of the liquid container 10A of the first embodiment, except that the inner wall 65D different in arrangement angle is included instead of the inner wall 65 described above the first embodiment. The liquid container 10D of the fourth embodiment is loaded into the liquid-consuming device 500 described above the first embodiment.

The inner wall 65D of the fourth embodiment is almost identical in configuration to the inner wall 65 of the first embodiment except for the different arrangement angle. The inner wall 65D droops in an inclined state from the upper surface 31*u* such that the lower end 65*e* is positioned closer to the second wall part 22 than the upper end.

According to the liquid container 10D of the fourth embodiment, at the time of injection of the liquid from the liquid inlet 35, even if the injected liquid contains foreign matter, the inner wall 65D is configured to guide the foreign matter toward the second wall part 22. This prevents the foreign matter from reaching the filter 72 and suppresses the clogging of the filter 72. In addition, according to the liquid container 10D of the fourth embodiment, the same various advantageous effects as those of the liquid container 10A of the first embodiment are provided.

E. Fifth Embodiment

Figure 32A:
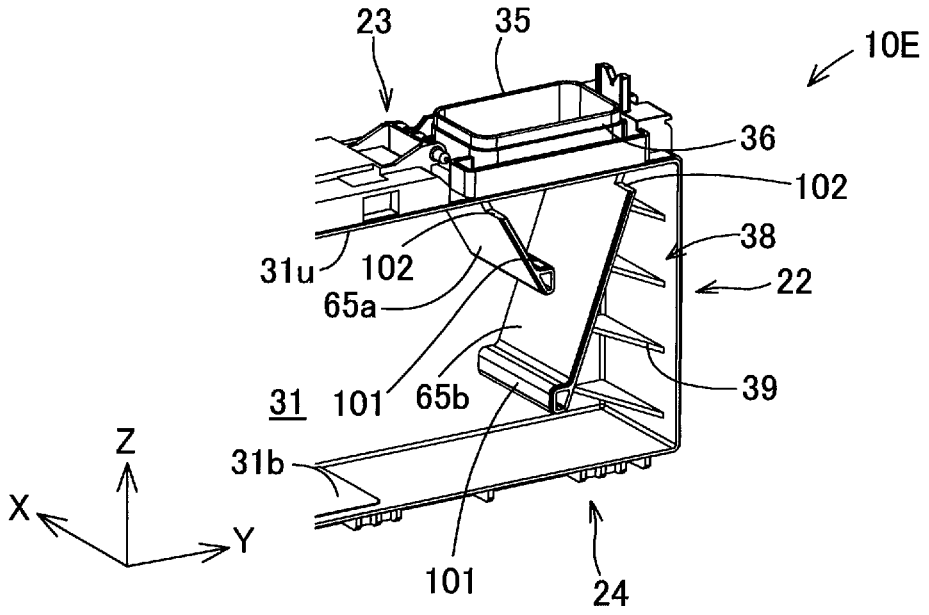
FIG. 32A is a schematic perspective view of an inner wall according to a fifth embodiment.
Figure 32B:
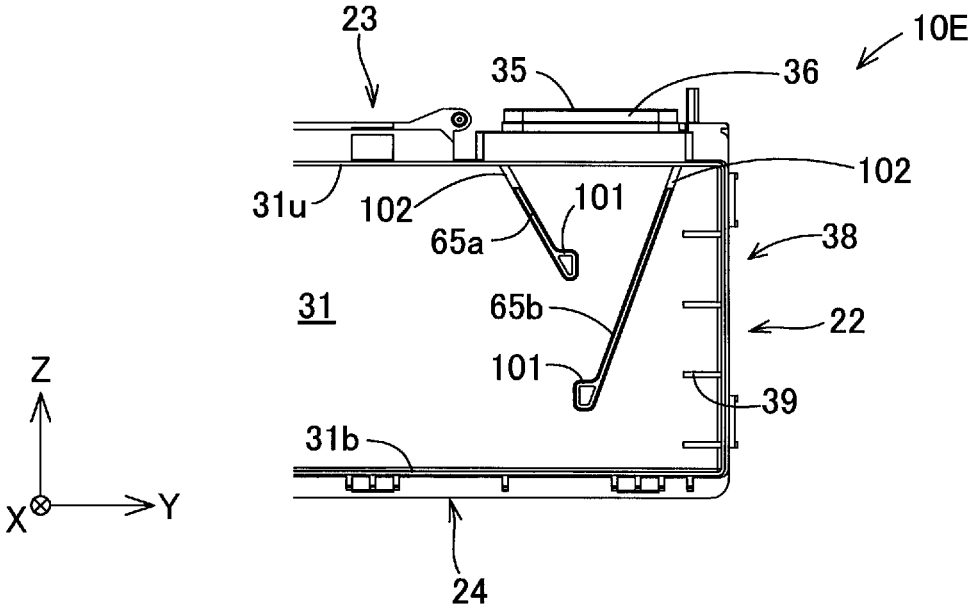
FIG. 32B is a schematic side view of the inner wall according to the fifth embodiment.

Referring to FIGS. 32A and 32B, the configuration of a liquid container 10E according to a fifth embodiment will be described. FIG. 32A is a schematic perspective view of inner walls 65*a* and 65*b* provided in the containment chamber 31 of the liquid container 10E of the fifth embodiment. FIG. 32B is a schematic side view of the inner walls 65*a* and 65*b* provided in the containment chamber 31 of the liquid container 10E of the fifth embodiment as seen in the +X direction. The configuration of the liquid container 10E of the fifth embodiment is almost identical to that of the liquid container 10A of the first embodiment, except that a pair of the inner walls 65*a* and 65*b* is included instead of the inner wall 65 described above first embodiment. The liquid container 10E of the fifth embodiment is loaded into the liquid-consuming device 500 described above first embodiment.

The pair of inner walls 65*a* and 65*b* of the fifth embodiment is configured in almost the same as the inner wall 65 of the first embodiment, except for the points described below. The first inner wall 65*a* is positioned on the −Y direction side of the liquid inlet 35, and the second inner wall 65*b* is positioned on the +Y direction side of the liquid inlet 35. The first inner wall 65*a* is declined in a direction toward the second inner wall 65*b*. The first inner wall 65*a* has a lower end that overlaps the opening area of the liquid inlet 35 in the Z direction and is separated from the second inner wall 65*b* in the −Y direction. The lower end of the first inner wall 65*a* is positioned above the lower end of the second inner wall 65*b*.

The second inner wall 65*b* is declined in a direction distant from the second wall part 22. The second inner wall 65*b* has the lower end that overlaps the opening area of the liquid inlet 35 in the Z direction. The lower end 65*e* of the second inner wall 65*b* has the end convex portion 101 protruding in the −Y direction. The end convex portion 101 of the second inner wall 65*b* is formed by increasing locally the thickness of the second inner wall 65*b* in the −Y direction.

In the liquid container 10E, the liquid is poured by the user from the liquid inlet 35 and guided toward the second inner wall 65*b* along the surface of the first inner wall 65*a* on the liquid inlet 35 side, and then moved toward the bottom surface 31*b* of the containment chamber 31 along the surface of the second inner wall 65*b* on the liquid inlet 35 side. In this way, the liquid poured from the liquid inlet 35 is injected into the containment chamber 31 in the flowing directions changed by the two inner walls 65*a* and 65*b*. Accordingly, the momentum of the liquid is diminished in two stages by the two inner walls 65*a* and 65*b* to further suppress the foaming of the liquid in the containment chamber 31.

In addition, the two inner walls 65*a* and 65*b* are configured to catch the foreign matter mixed in the poured liquid at the upper ends of the end convex portions 101 provided therein. Accordingly, it leads to prevent the foreign matter in the liquid from reaching the filter 72 and suppress the clogging of the filter 72.

In the liquid container 10E, the second inner wall 65*b* is positioned closer to the second wall part 22 than the liquid inlet 35. The configuration suppresses transfer of ruffles in the liquid surface caused by the liquid poured from the liquid inlet 35 to the liquid surface facing the visual recognition portion 38 of the second wall part 22. Accordingly, it leads to prevent a situation where the liquid amount in the containment chamber 31 is unclearly checked via the visual recognition portion 38 at the time of injection of the liquid from the liquid inlet 35.

In the liquid container 10E, the two inner walls 65*a* and 65*b* enhance the strength of the opening housing member 60. The two inner walls 65*a* and 65*b* also enhance the joint strength of the container lid member 62 to the opening housing member 60. In addition, according to the liquid container 10E of the fifth embodiment, the same various advantageous effects as those of the liquid container 10A of the first embodiment are provided.

F. Sixth Embodiment

Figure 33:
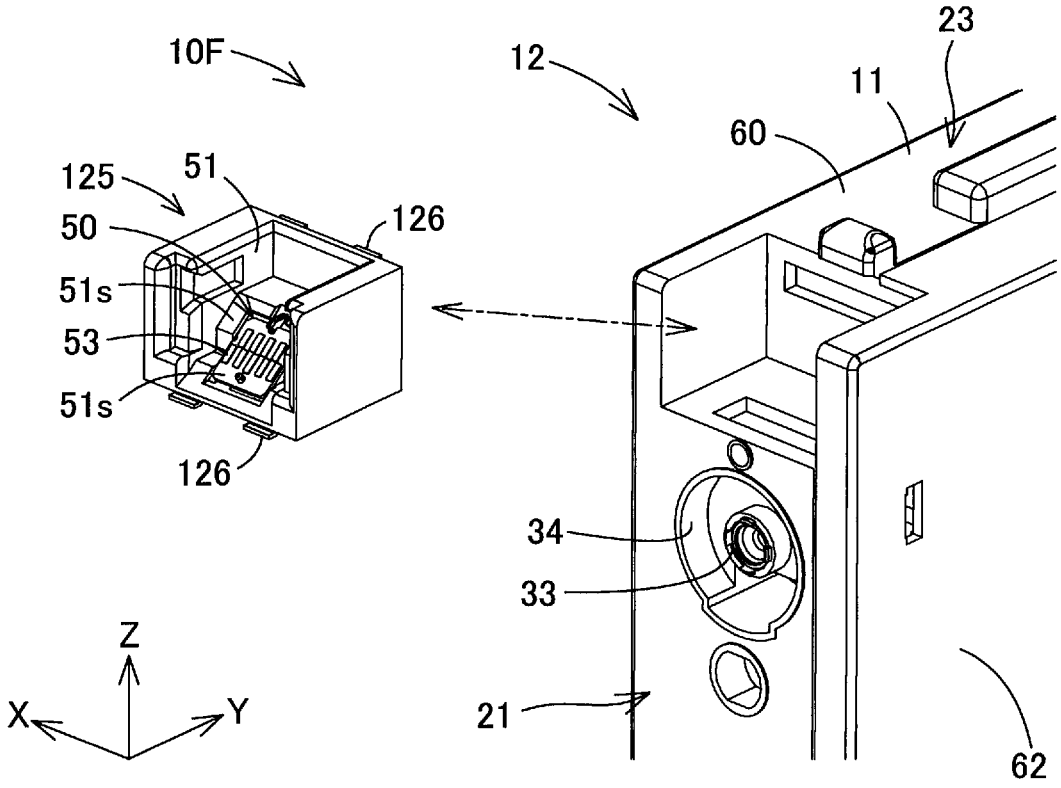
FIG. 33 is a schematic perspective view of a region of a liquid container on a first end side according to a sixth embodiment.

Referring to FIG. 33, the configuration of a liquid container 10F according to a sixth embodiment will be described. FIG. 33 is a schematic perspective view of a region of the liquid container 10F of the sixth embodiment on the first end 12 side. The configuration of the liquid container 10F of the sixth embodiment is almost identical to the configuration of the liquid container 10A of the first embodiment, except that the electrical connection portion 50 is configured in an attachable and detachable manner. The liquid container 10F of the sixth embodiment is loaded into the liquid-consuming device 500 described above first embodiment.

In the liquid container 10F, part of the corner between the first wall part 21 and the third wall part 23 including the concave portion 51 in which the electrical connection portion 50 is arranged is formed as a member separated from the opening housing member 60. The member constitutes a connector unit 125 in which the electrical connection portion 50 is arranged. The connector unit 125 has an engagement portion 126 that engages with the opening housing member 60 and is configured to be detachably attached to the opening housing member 60.

According to the liquid container 10F, it leads to suppress the adhesion of the liquid to the electrical connection portion 50 by separating the connector unit 125 from the container main body 11 at the time of maintenance of the liquid container 10F. In addition, when the liquid container 10F is fallen unexpectedly, the connector unit 125 is separated from the container main body 11 of the liquid container 10F to scatter the impact force of the falling and suppress the breakage of the liquid container 10F. Besides, according to the liquid container 10F of the sixth embodiment, the same various advantageous effects as those of the liquid container 10A of the first embodiment are provided.

G. Seventh Embodiment

Figure 34:
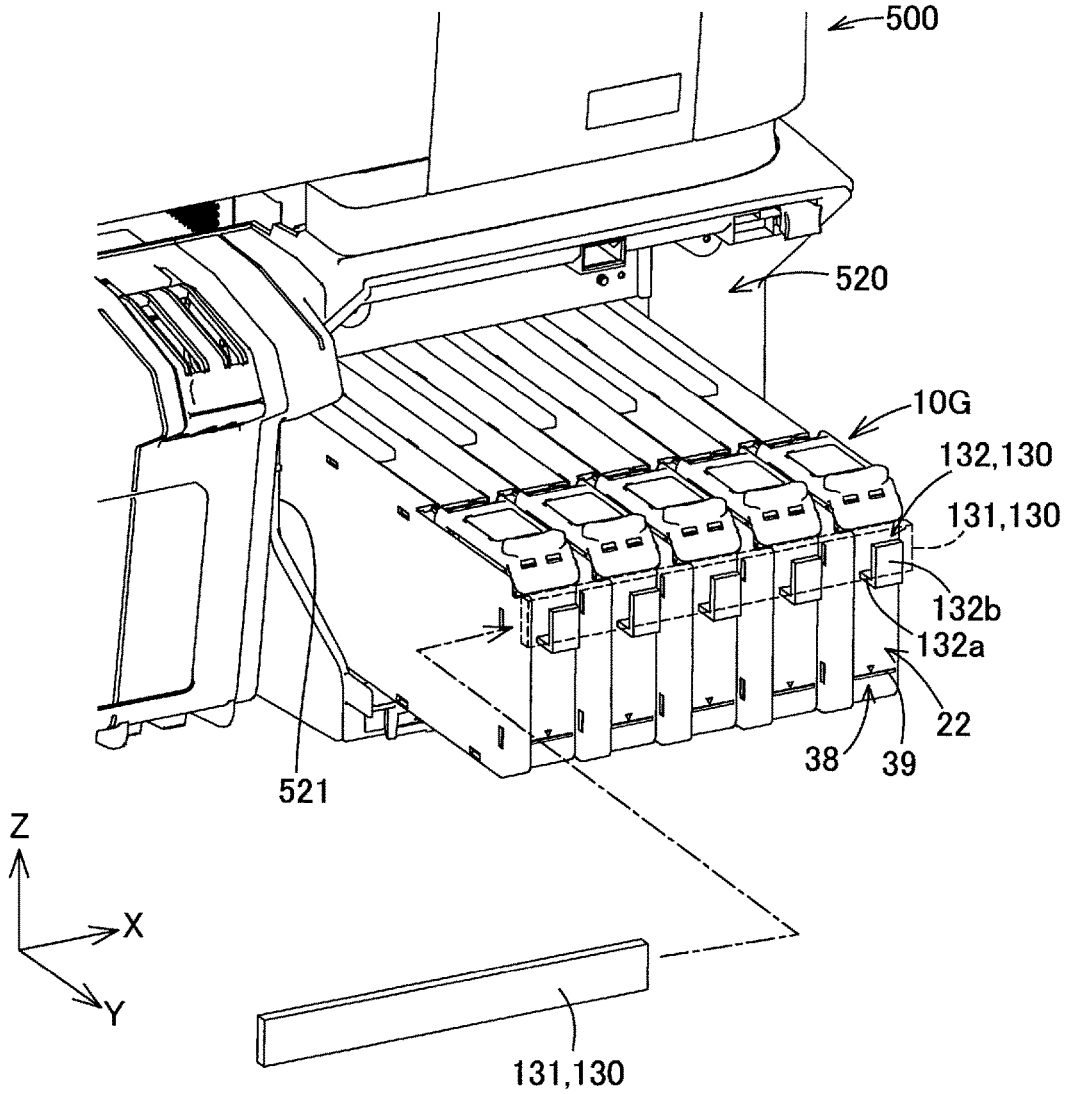
FIG. 34 is a schematic perspective view of loaded liquid containers according to a seventh embodiment.

Referring to FIG. 34A, a configuration of a liquid container 10G according to a seventh embodiment will be described. FIG. 34 is a schematic perspective view of the liquid container 10G of the seventh embodiment loaded in the liquid supply portion 520 of the liquid-consuming device 500. The configuration of the liquid container 10G of the seventh embodiment is almost identical to the configuration of the liquid container 10A of the first embodiment, except that a coupling portion 130 is provided to couple a plurality of liquid containers 10G in the loaded state.

The liquid container 10G of the seventh embodiment is attached to the liquid-consuming device 500 described above in relation to the first embodiment. In the liquid-consuming device 500, as described above the first embodiment, the plurality of liquid containers 10G are loaded in parallel in a state of being aligned in the X direction crossing the insertion direction, that is, the direction from the upper wall surface 23*s* to the bottom wall surface 24*s* of the liquid container 10G.

The coupling portion 130 is formed from a coupling bar 131 and a bar support portion 132. The coupling bar 131 has a length that is equal to or larger than the X direction width of the arrangement area of the liquid containers 10G in the liquid-consuming device 500. The coupling bar 131 is formed as a plate-like member as illustrated in the drawing. The coupling bar 131 may be formed as a bar-like member, not a plate-like member.

The bar support portion 132 is provided in the first region 15 of the liquid container 10G. The bar support portion 132 is configured to receive and support the coupling bar 131 when the liquid container 10G is in the loaded state. The bar support portion 132 is formed as a hook-like region protruding from the second wall part 22, and has a base end 132*a* that extends from the second wall part 22 in the +Y direction and a front end 132*b* that extends from the base end 132*a* in the +Z direction. The coupling bar 131 is arranged on the base end 132*a* and supported by sandwiching between the front end 132*b* and the second wall part 22. The bar support portion 132 is desirably provided outside the formation area of the scale marks 39 in the visual recognition portion 38.

In the state in which all the liquid containers 10G are loaded by the user in the liquid-consuming device 500, the coupling bar 131 is arranged to hang across the bar support portions 132 of the liquid containers 10G in the X direction. Accordingly, in the liquid-consuming device 500, the liquid containers 10G in the loaded state are coupled together.

As above, the liquid container 10G is provided with the coupling portion 130 to couple itself and another liquid container 10G loaded in the liquid-consuming device 500 at the second end 13 on the side of the second wall part 22 as rear-end wall part in the first region 15. This prevents only some of the liquid containers 10G from being drawn out of the liquid-consuming device 500 during driving of the liquid-consuming device 500. In addition, it leads to prevent the user from starting to drive the liquid-consuming device 500 in a state where some of the liquid containers 10G are not yet loaded. Beside, according to the liquid container 10G in the seventh embodiment, the same various advantageous effects as those of the liquid container 10A of the first embodiment are provided.

H. Eighth Embodiment

Figure 35:
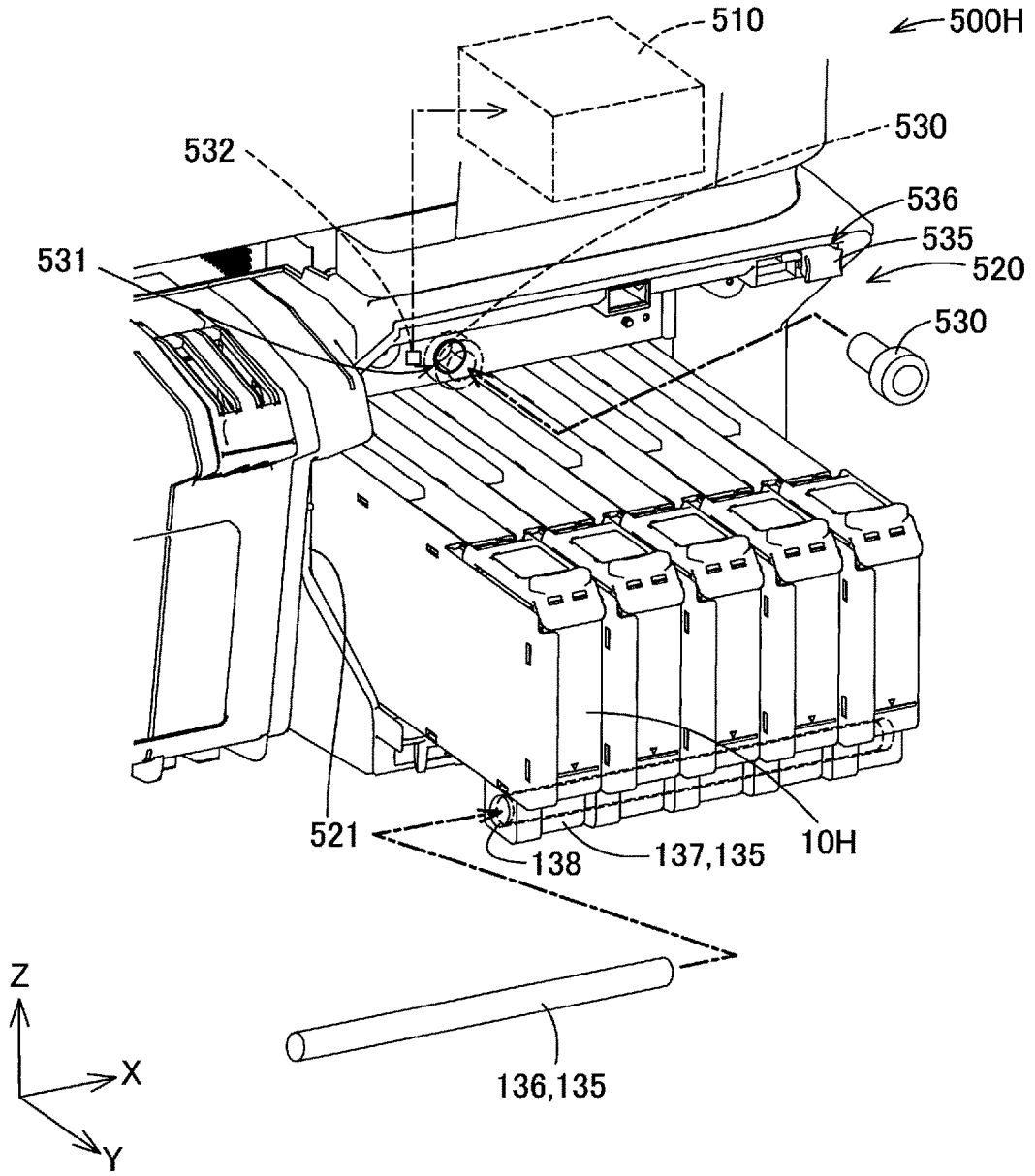
FIG. 35 is a schematic perspective view of coupling liquid containers according to an eighth embodiment.
Figure 36:
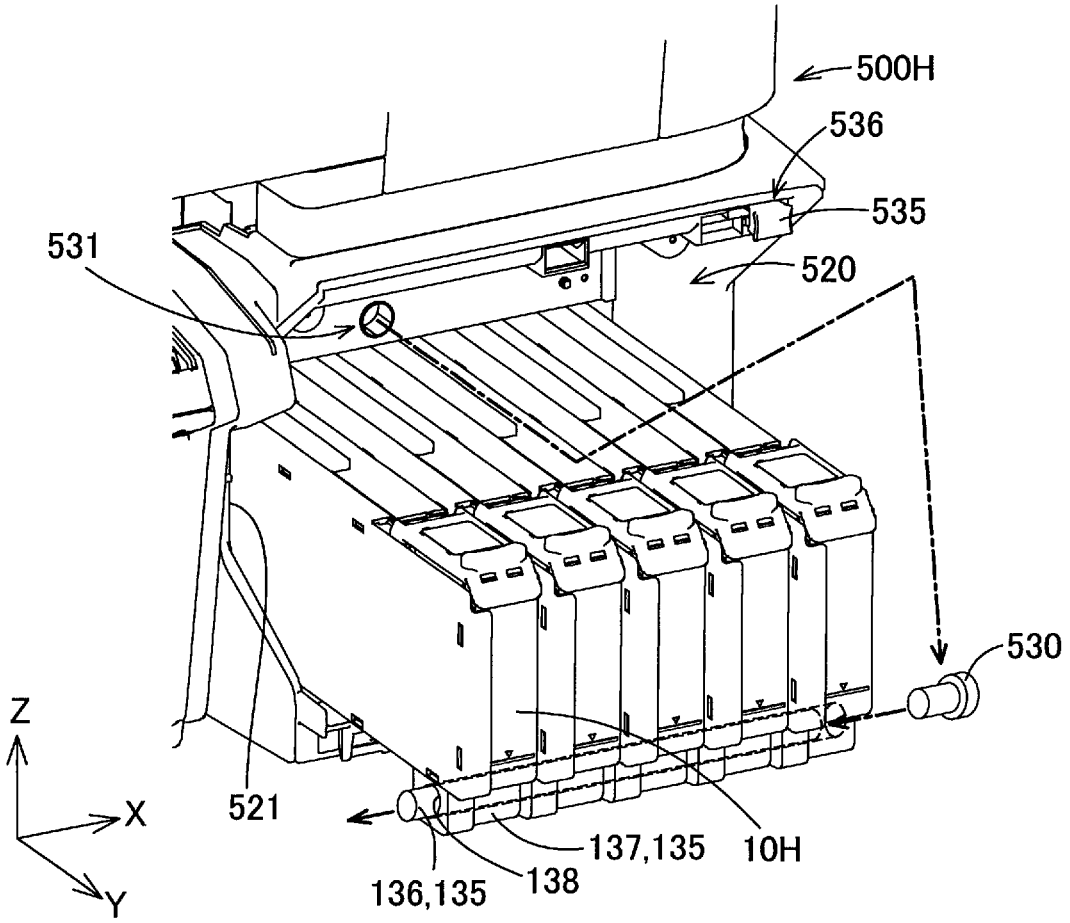
FIG. 36 is a schematic perspective view of decoupling the liquid containers according to the eighth embodiment.

Referring to FIGS. 35 and 36, the configuration of a liquid container 10H according to an eighth embodiment will be described. FIG. 35 is a schematic perspective view of coupling the liquid containers 10G of the eighth embodiment. FIG. 36 is a schematic perspective view of decoupling the liquid containers 10G of the eighth embodiment. The configuration of the liquid container 10H of the eighth embodiment is almost identical to the configuration of the liquid container 10G of the seventh embodiment, except that the coupling portion 135 is different in structure from the coupling portion 130 of the seventh embodiment.

The liquid container 10H of the eighth embodiment is loaded into a liquid-consuming device 500H of the eighth embodiment. The liquid-consuming device 500H is almost identical in configuration to the liquid-consuming device 500 of the first embodiment, except for the points described below. See FIG. 35. The liquid-consuming device 500H includes a key member 530 and a key member attachment portion 531 to which the key member 530 is detachably attached.

The key member attachment portion 531 is provided as a hole portion in the liquid-consuming device 500H that accepts the insertion of the key member 530. The key member attachment portion 531 is provided in the vicinity of the container insertion opening 521. The key member attachment portion 531 has a key detection portion 532 that detects the insertion of the key member 530. The key detection portion 532 is formed from a sensor that detects optically the key member 530 inserted into the key member attachment portion 531. The key detection portion 532 may be formed from a switch that changes the electrical conduction state by insertion or extraction of the key member 530 into or from the key member attachment portion 531.

The controller 510 of the liquid-consuming device 500H uses the result of detection by the key detection portion 532 to determine whether the key member 530 is attached to or detached from the liquid-consuming device 500H. When the key member 530 is attached to the liquid-consuming device 500H, the controller 510 enables the driving of the liquid-consuming device 500H. Meanwhile, when the key member 530 is detached from the liquid-consuming device 500H, the controller 510 disallows the driving of the liquid-consuming device 500H.

The coupling portion 135 of the eighth embodiment is formed from a coupling bar 136 and a bar support portion 137. The coupling bar 136 of the eighth embodiment has a length that is smaller than the width of the arrangement area of the liquid containers 10G in the liquid-consuming device 500 as seen in the X direction. The coupling bar 136 may be formed as a bar-like member as illustrated in the drawing. The coupling bar 136 may be formed not as a bar-like member but as a plate-like member as the coupling bar 131 of the seventh embodiment.

The bar support portion 137 of the eighth embodiment protrudes downward from the fourth wall part 24 in the first region 15 of the liquid container 10H. The bar support portion 137 is provided with a through hole 138 penetrating in the X direction. The through hole 138 has a diameter that allows the insertion of the coupling bar 136. The opening end of the through hole 138 has an opening shape that allows the insertion of part of the key member 530.

As shown in FIG. 35, in the liquid-consuming device 500H of the eighth embodiment, a plurality of liquid containers 10H are loaded in parallel in a state of being aligned in the X direction crossing the insertion direction as the liquid-consuming device 500 of the first embodiment. When all the liquid containers 10H are loaded by the user into the liquid-consuming device 500H, the coupling bar 136 is inserted into the through holes 138 in the bar support portions 137 of the liquid containers 10H. Accordingly, in the liquid-consuming device 500H, the liquid containers 10H in the loaded state are coupled together. In the coupling state, the coupling bars 136 are entirely stored in the through holes 138 of the bar support portions 137.

See FIG. 36. To decouple the liquid containers 10H coupled by the coupling portions 135, the user uses the key member 530. The user extracts the key member 530 from the key member attachment portion 531, inserts part of the key member 530 into the through hole 138 in the bar support portion 137, and protrudes part of the coupling bar 136 from the side opposite to the insertion of the key member 530. Accordingly, the user is allowed to extract the coupling bar 136 from the through hole 138 in the bar support portion 137 to decouple the liquid containers 10H.

In another embodiment, the liquid-consuming device 500H may have another key member 535 and another key member attachment portion 536 that have the same functions as those of the foregoing ones instead of, or in addition to the key member 530 and the key member attachment portion 531. The key member attachment portion 536 may be provided above the container insertion opening 521 on the +X direction side as illustrated in FIG. 35. The key member 536 has a key detection portion that detects attachment or detachment of the corresponding key member 535. The key detection portion is not illustrated in figures. The key member 535 is usable for decoupling the liquid containers 10H as the key member 530. In the case where the liquid-consuming device 500H has the two key members 530 and 535, the controller 510 disallows the driving of the liquid-consuming device 500H when at least one of the key members 530 and 535 is detached from the key member attachment portion 531 or 536.

As above, according to the liquid container 10H of the eighth embodiment, the coupling by the coupling portions 135 is undone by detaching the key members 530 and 536 from the liquid-consuming device 500H. Therefore, when the user is undoing the coupling by the coupling portions 135, the controller 510 disallows the driving of the liquid-consuming device 500H. Accordingly, it leads to prevent the liquid-consuming device 500H from being driven accidentally when the liquid container 10H is removed from the liquid-consuming device 500H. Besides, according to the liquid container 10H of the eighth embodiment, the same various advantageous effects as those of the liquid container 10G of the seventh embodiment and the liquid container 10A of the first embodiment are provided.

I. Other Embodiments

The various configurations described above in relation to the foregoing embodiments may be modified in such manners as described below. All the other embodiments described below are regarded as examples of aspects for carrying out the present disclosure.

I1. Other Embodiments Relating to the Filter

1. In the liquid containers 10A to 10H of the foregoing embodiments, the filter 72 or 72C may not be arranged in the filter chamber 71. The filter 72 or 72C may be arranged in the outlet flow path 78, for example.

2. In the liquid containers 10A to 10H of the foregoing embodiments, the filters 72 and 72C may not be almost parallelogram but may be trapezoidal, for example, in outer peripheral shape as seen in the thickness direction. The filters 72 and 72C may not be formed from a film-like member with fine pores. The filters 72 and 72C may be formed from a cylindrical or rectangular porous member, for example.

3. In the liquid containers 10A to 10H of the foregoing embodiments, the filter 72 or 72C may not be placed such that the liquid passes through the filter 72 or 72C in the direction opposite to the direction of gravity. The filter 72 or 72C may be placed such that the liquid passes through the filter 72 or 72C in the horizontal direction, for example. The filter 72 or 72C may be placed in the filter chamber 71 with an inclination to the horizontal direction in the loaded state. Accordingly, it is achieved to guide and collect the foreign matter and air bubbles removed by the filter 72 or 72C along the inclined surface of the filter 72 or 72C.

4. In the liquid containers 10A to 10H of the foregoing embodiments, the filter chamber 71 may not be provided under the containment chamber 31. The filter chamber 71 may be provided above the bottom surface 31*b* of the containment chamber 31, for example. For example, the filter chamber 71 may be provided inside the sixth wall part 26. Either the first communication opening 76*a* or the second communication opening 76*b* communicating with the filter chamber 71 may be omitted.

5. In the liquid containers 10A to 10H of the foregoing embodiments, the bottom surface of the filter chamber 71 may be provided with a rib or a concave-convex structure to suppress arrival of foreign matter at the filter 72. In the liquid containers 10A to 10H of the foregoing embodiments, a sensor portion may be provided downstream of the filter chamber 71 to detect the shortage of the amount of the liquid in the containment chamber 31. The sensor portion may be formed from a valve body that is displaced to open or close in accordance with the amount of the liquid in the containment chamber 31.

I2. Other Embodiments Relating to the Visual Recognition Portion

1. In the liquid containers 10A to 10H of the foregoing embodiments, only one inner scale mark 39*i* may be provided. The inner scale mark 39*i* may be only the lower-limit scale mark 39L or only an upper-limit scale mark indicating the upper limit of the amount of the liquid contained in the containment chamber 31.

2. In the liquid containers 10A to 10H of the foregoing embodiments, the inner scale marks 39*i* may not be provided as ribs at the corner between the sixth wall part 26 and the second wall part 22. The inner scale marks 39*i* may be coupled to at least one of the sixth wall part 26 and the second wall part 22. The ribs constituting the inner scale marks 39*i* may not be almost triangular in shape but may have another shape. The ribs constituting the inner scale marks 39*i* may be almost square in shape. The inner scale marks 39*i* may be formed from convex and concave portions in the inner wall surface 24*i* of the second wall part 22, seals stuck to the inner wall surface 24*i*, or ink applied to the inner wall surface 24*i*.

3. In the liquid containers 10A to 10H of the foregoing embodiments, the inner scale marks 39*i* may be formed as ribs that are inclined downward in at least one of the −X direction and the −Y direction. The configuration causes the liquid on the upper surfaces of the ribs to be guided to the bottom surface 31*b* of the containment chamber 31 by the gravity, thereby preventing the liquid from remaining on the upper surfaces of the ribs.

4. In the liquid containers 10A to 10H of the foregoing embodiments, the outer scale mark 390 may be formed from a concave portion in the outer wall surface 220 of the second wall part 22, a seal stuck to the outer wall surface 22*o*, or ink applied to the outer wall surface 22*o*. When the outer scale mark 390 is formed as a concave portion in the outer wall surface 22*o*, the concave portion is able to receive the liquid adhering to the outer wall surface 22*o* and moving downward, as in the case where the outer scale mark 390 is formed as a convex portion in the outer wall surface 22*o*. Therefore, it leads to prevent the liquid from reaching the handhold portion 40. The outer scale mark 390 may be provided in the container lid member 62. The outer scale mark 390 may include an upper-limit scale mark.

5. In the liquid containers 10A to 10H of the foregoing embodiments, the scale marks 39 may not have a linear shape extending along the X direction. The scale marks 39 may be formed in various shapes such as almost hemispherical concave-convex shape, circular shape, and triangular shape, for example.

I3. Other Embodiments Relating to the Air Introduction Portion

1. In the liquid containers 10A to 10H of the foregoing embodiments, the air introduction portion 110 may not be provided above the containment chamber 31. The air introduction portion 110 may be provided inside the sixth wall part 26 at the central position in the Z direction in the containment chamber 31, for example. The containment chamber air opening 111 may not be provided at the central region in the longitudinal direction in the containment chamber 31. The containment chamber air opening 111 may be provided at a position closer to the second wall part 22 than the first wall part 21, for example.

2. In the liquid containers 10A to 10H of the foregoing embodiments, the containment chamber air opening 111 may be provided at a position closer to the path division wall 116 than the end of the first air path portion 121 on the +Y direction side. The container air opening 112 may be connected to the second air path portion 122, at a position closer to the path division wall 116 than the end of the second air path portion 122 on the −Y direction side.

3. In the foregoing liquid containers 10A to 10H, the path division wall 116 of the air introduction portion 110 may be omitted. The air communication portion 117 may not be provided at the upper end of the path division wall 116. The air communication portion 117 may be provided in the center of the path division wall 116, for example.

I4. Other Embodiments Relating to the Handhold Portion

In the liquid containers 10A to 10H of the foregoing embodiments, the handhold portion 40 may not be provided as a concave portion in the bottom wall surface 24*s* of the fourth wall part 24. The handhold portion 40 may be provided as a convex portion to be easily hand-held by the user, for example. The handhold portion 40 may be formed as a handle attached to the container main body 11. The handle may be storable in the inside of the container main body 11. The handhold portion 40 may be provided as a region higher in friction coefficient than the other regions of the bottom wall surface 24*s* so that the handhold portion 40 is unlikely to slip from the user's hand, for example. The handhold portion 40 may be formed by installing a plate-like rubber member on the bottom wall surface 24*s*. The handhold portion 40 may be provided as a grained area of the bottom wall surface 24*s*. The handhold portion 40 may be provided as a region that is softer than the other regions of the bottom wall surface 24*s* to offer a favorable texture, for example. A structure for the user to recognize tactilely the position of the handhold portion 40 may be provided around the handhold portion 40. The structure may be formed as a convex portion or a concave portion surrounding the handhold portion 40 or a convex portion or a concave portion provided in part of the periphery of the handhold portion 40, for example. Providing the structure also suppresses the movement of the liquid toward the handhold portion 40.

I5. Other Embodiments Relating to the Rail Portion

1. In the liquid containers 10A to 10H of the foregoing embodiments, at least one of the rail portions 41 and 42 may be omitted. The rail portions 41 and 42 may be divided into a plurality of sections in the Y direction.

2. In the liquid containers 10A to 10H of the foregoing embodiments, the rail portions 41 and 42 may not be provided in the central regions in the X direction in the upper wall surface 23*s* and the bottom wall surface 24*s*. The rail portions 41 and 42 may be positioned closer to the fifth wall part 25 and the sixth wall part 26 on the upper wall surface 23*s* and the bottom wall surface 24*s*.

3. In the liquid containers 10A to 10H of the foregoing embodiments, the container lid member 62 may be positioned with respect to the opening housing member 60 by abutting with the rail portions 41 and 42 in regions other than the end surfaces 67*t* of the peripheral walls 67. The container lid member 62 may be positioned with respect to the opening housing member 60 by abutting with the rail portions 41 and 42 by convex portions provided separately from the peripheral walls 67 and extending in the X direction.

I6. Other Embodiments Relating to the Inner Wall

1. In the liquid containers 10A to 10H of the foregoing embodiments, the surfaces of the inner walls 65, 65D, 65*a*, and 65*b* may be provided with a concave-convex structure for controlling the flow of the liquid or a concave-convex structure for catching foreign matter included in the liquid.

2. In the liquid containers 10A to 10H of the foregoing embodiments, the inner walls 65, 65D, 65*a*, and 65*b* are provided as flat plate-like walls. The inner walls 65, 65D, 65*a*, and 65*b* are not limited to a flat plate-like shape. The inner walls 65, 65D, 65*a*, and 65*b* may be provided as walls with a curved surface or a bent portion.

3. In the liquid containers 10A to 10H of the foregoing embodiments, the inner walls 65, 65D, 65*a*, and 65*b* extend downwardly under the liquid inlet 35. Alternatively, the inner walls 65, 65D, 65*a*, and 65*b* may be positioned separated from the liquid inlet 35 in the Y direction.

4. In the liquid containers 10A to 10H of the foregoing embodiments, the inner walls 65, 65D, 65*a*, and 65*b* may not have the end convex portion 101. The end convex portion 101 may not project from the wall surface of the inner wall 65 to the +Y direction side but may project to the −Y direction side. The end convex portion 101 may project from the wall surface of the inner wall 65 to both the +Y direction side and the −Y direction side.

5. The communication portion 102 may not be provided at the upper end of the inner wall 65, 65D, 65*a*, or 65*b*, or may be provided as a through hole penetrating the inner wall 65, 65D, 65*a*, or 65*b* at a region other than the upper end of the inner wall 65, 65D, 65*a*, or 65*b*. The communication portion 102 may be formed as a slit-like clearance between the upper end of the inner walls 65, 65D, 65*a*, or 65*b* and the upper surface 31*u* of the containment chamber 31.

6. In the liquid containers 10A to 10H of the foregoing embodiments, the inner wall 65, 65D, 65*a*, or 65*b* may not be coupled to the inner wall surface 26*s* of the sixth wall part 26 or may not be welded to the film member 63. The inner wall 65, 65D, 65*a*, or 65*b* may not be coupled to the upper surface 31*u* of the containment chamber 31. The inner wall 65, 65D, 65*a*, or 65*b* may extend downwardly along the Z direction toward the bottom surface 31*b* from a position separated from the upper surface 31*u* of the containment chamber 31 on the upper surface 31*u* side.

7. In the liquid containers 10A to 10H of the foregoing embodiments, the inside of the containment chamber 31 may be provided with a wall for controlling the flow of the liquid, other than the inner walls 65, 65D, 65*a*, and 65*b*. In the liquid containers 10A to 10H of the foregoing embodiments, the inner walls 65, 65D, 65*a*, and 65*b* may be omitted.

I7. Other Embodiments Relating to the Container Main Body

1. In the liquid containers 10A to 10H of the foregoing embodiments, the film member 63 to be welded to the opening housing member 60 may be omitted. In this case, for example, a seal portion may be provided between the opening housing member 60 and the container lid member 62 to secure sealing property of the containment chamber 31.

2. In the liquid containers 10A to 10H of the foregoing embodiments, the container main body 11 may have a shape other than an almost rectangular parallelepiped. For example, the container main body 11 may have an outer peripheral contour that is almost elliptical as seen in the X direction. The reinforcement walls 64 of the containment chamber 31 may be omitted. The containment chamber 31 may be provided with reinforcement ribs different in structure from the reinforcement walls 64.

I8. Other Embodiments Relating to the Lid Member

1. In the liquid containers 10A to 10H of the foregoing embodiments, the lid member 85 is configured to rotate around the rotation axis RX which is along the X direction. Alternatively, the lid member 85 may be configured to rotate around a rotation axis RX which is along the Y direction or the Z direction. The lid member 85 may not be rotatably coupled to the container main body 11. The lid member 85 may be coupled to the container main body 11 by a string-like member or may be separated from the container main body 11.

2. In the liquid containers 10A to 10H of the foregoing embodiments, the seal member 88 of the lid member 85, the outer surface convex portion 90, the sealing surface-side concave portion 91, the projections 95, and the stopper portion 89 supporting the lid member 85 may be omitted. In the liquid containers 10A to 10H of the foregoing embodiments, the lid member 85 may be omitted.

I9. Other Embodiments Relating to the Liquid-Consuming Device

1. In the foregoing embodiments, the liquid containers 10A to 10H may be inserted and loaded into the liquid-consuming device 500 or 500H in a direction crossing the direction of gravity other than the −Y direction. The liquid containers 10A to 10H may be inserted into the liquid-consuming device 500 or 500H in the +Y direction, the ±X direction, or an oblique direction with respect to a horizontal plane, for example.

2. In the foregoing embodiments, the liquid containers 10A to 10H may be loaded in parallel into the liquid-consuming device 500 or 500H in a state of being aligned in a direction crossing the insertion direction other than the X direction. The liquid containers 10A to 10H may be loaded into the liquid-consuming device 500 or 500H in a state of being aligned in the Z direction, for example.

3. In the foregoing embodiments except for the seventh and eighth embodiments, the liquid-consuming device 500 may not be configured such that the plurality of liquid containers 10A to 10H are loadable. The liquid-consuming device 500 may be configured such that only single one of the liquid containers 10A to 1° F. is loadable, for example.

4. In the foregoing embodiments, the plurality of liquid containers 10A to 10H identical in configuration are loaded into the liquid-consuming device 500 or 500H. Alternatively, a differently configured liquid container may be loaded into the liquid-consuming device 500 or 500H together with the liquid containers 10A to 10H. For example, in addition to the liquid containers 10A to 10H with the liquid inlet 35, a single-use liquid container with a pre-contained liquid and without the liquid inlet 35 may be loaded into the liquid-consuming device 500 or 500H.

5. The configurations of the liquid containers 10A to 10H of the foregoing embodiments may be applied to liquid containers to be loaded into liquid-consuming devices other than ink-jet printers. For example, the configurations of the liquid containers 10A to 10H may be applied to liquid containers to be loaded into cleaning devices consuming liquid detergents.

I10. Others

1. In the liquid containers 10A to 10H of the foregoing embodiments, among the three concave portions 55*a*, 55*b*, and 55*c* of the first wall part 21, the second concave portion 55*b* serves as a positioning portion into which the rod 525 is inserted as shown in FIG. 17. In the liquid containers 10A to 10H of the foregoing embodiments, at least one of the first concave portion 55*a* and the third concave portion 55*c* of the first wall part 21 may serve as a positioning portion into which a projection similar to the rod 525 is inserted, like the second concave portion 55*b*. The second concave portion 55*b* may not have the function of positioning, and the rod 525 may not be inserted into the second concave portion 55*b*.

2. In the liquid containers 10A to 10H of the foregoing embodiments, the filters 72 and 72C, the handhold portion 40, the rail portions 41 and 42, the peripheral wall parts 67 and 68, and the air introduction portion 110 may be omitted. In the liquid containers 10A to 10H of the foregoing embodiments, the electrical connection portion 50, the concave portions 55 for positioning, the liquid-receiving portion 80, the convex wall portion 82, the first support concave portion 82*r*, and the second support concave portion 98 may be omitted.

The present disclosure is not limited to the foregoing embodiments, other embodiments, examples, and modification examples but may be implemented in various configurations without deviating from the gist of the present disclosure. For example, the technical features of the embodiments corresponding to the technical features of the aspects described in the summary of the disclosure, other embodiments, examples, and modification examples may be replaced or combined as appropriate to solve some or all of the foregoing problems or achieve some or all of the foregoing advantages. Not only the technical features described here as not being essential but also the technical features not described here as being essential may be eliminated as appropriate.

What is claimed is:

1. A liquid container contains a liquid to be supplied to a liquid-consuming device consuming the liquid and is inserted and loaded into the liquid-consuming device in an insertion direction crossing a direction of gravity, comprising:

a container main body that includes a containment chamber containing the liquid and has a plurality of wall parts including a front-end wall part that is positioned on the insertion direction with respect to the containment chamber, a rear-end wall part that is opposite to the front-end wall part with the containment chamber therebetween in the insertion direction and faces the containment chamber, and an upper-surface wall part that crosses the front-end wall part and the rear-end wall part and is positioned above the containment chamber in a loaded state where the liquid container is loaded in the liquid-consuming device;

a liquid outlet that is connected to the liquid-consuming device in the loaded state to flow out the liquid from the containment chamber to the liquid-consuming device;

a liquid inlet that is provided on the upper-surface wall part at a position closer to the rear-end wall part than the front-end wall part and communicates with the containment chamber to accept injection of the liquid from outside of the container main body into the containment chamber; and a visual recognition portion that is provided on the rear-end wall part and is see-through so that a position of a liquid surface of the liquid contained in the containment chamber is visually recognizable from the outside of the container main body, wherein the rear-end wall part has at least part of scale marks as indexes of an amount of the liquid contained in the containment chamber on an outer wall surface outside the containment chamber in the visual recognition portion and an inner wall surface inside the containment chamber in the visual recognition portion.

2. The liquid container according to claim 1, wherein a liquid-receiving portion receiving the liquid spilling out of the liquid inlet is provided on an outer wall surface of the upper-surface wall part as a concave portion around the liquid inlet.

3. The liquid container according to claim 2, wherein the liquid-receiving portion has a liquid-receiving portion division wall dividing a space in the liquid-receiving portion into a plurality of sections.

4. The liquid container according to claim 1, further comprising a lid member that is rotatably coupled to the upper-surface wall part and rotates relative to the upper-surface wall part to open or close the liquid inlet, wherein the lid member has a sealing surface that takes a state of covering the liquid inlet to close the liquid inlet and a state of separating from the liquid inlet to open the liquid inlet.

5. The liquid container according to claim 4, wherein the upper-surface wall part has an inlet peripheral wall portion surrounding a periphery of the liquid inlet and projecting upward, and the sealing surface has a seal member to abut with an upper end surface of the inlet peripheral wall portion to seal the liquid inlet.

6. The liquid container according to claim 4, wherein the upper-surface wall part has a stopper portion to support the lid member in an inclined state with respect to the upper-surface wall part such that the liquid inlet is kept open.

7. The liquid container according to claim 4, wherein the sealing surface has a projection protruding from the sealing surface at an end on the upper-surface wall part, the projection has a groove extended along a protrusion direction of the projection, the groove has a bottom on a rotation axis side of the lid member, and while the lid member is rotated toward the liquid inlet, the groove enters a state where the liquid-receiving portion is positioned ahead of the groove in the protrusion direction.

8. The liquid container according to claim 1, wherein the upper-surface wall part has a convex wall portion protruding upwardly between the liquid inlet and the rear-end wall part.

9. The liquid container according to claim 8, wherein the lid member has:

a sealing surface-side concave portion provided on the sealing surface to receive the convex wall portion when the lid member closes the liquid inlet; and an outer surface convex portion where a user hangs finger to open or close the lid member, the outer surface convex portion is provided on an outer surface opposite to the sealing surface, and contains the sealing surface-side concave portion inside.

10. The liquid container according to claim 8, comprising:

a first support concave portion provided at an upper end of the convex wall portion to receive and support part of a liquid injection instrument for use in injecting the liquid into the liquid inlet; and a second support concave portion provided at a corner between the rear-end wall part and the upper-surface wall part to receive and support part of the liquid injection instrument.

11. The liquid container according to claim 1, wherein the containment chamber has an inner wall drooping from an upper surface to a bottom surface of the containment chamber, the inner wall is provided on the insertion direction side of the liquid inlet in the containment chamber, and the inner wall has a lower end positioned between the upper surface and the bottom surface of the containment chamber.

12. The liquid container according to claim 11, wherein the inner wall has two ends in a direction crossing both the insertion direction and a direction from the upper surface to the bottom surface of the containment chamber, the two ends of the inner wall are coupled to a inner wall surface of the containment chamber, and the lower end of the inner wall has an end convex portion projecting from a wall surface of the inner wall.

13. The liquid container according to claim 11, wherein the inner wall has an upper end coupled to the upper surface, and the upper end of the inner wall has a communication portion communicating two adjacent areas of the containment chamber divided by the inner wall therebetween.

14. The liquid container according to claim 1, wherein the rear-end wall part has a plurality of ribs on the inner wall surface, the plurality of ribs constitutes the scale marks and is aligned vertically in the loaded state.

15. The liquid container according to claim 1, wherein the scale marks include a lower-limit scale mark indicating a lower limit of the amount of the liquid contained in the containment chamber, the lower-limit scale mark is provided on both the outside wall surface and the inside wall surface of the the rear-end wall part.

16. The liquid container according to claim 1, wherein the container main body has a bottom-surface wall part crossing both the front-end wall part and the rear-end wall part, the bottom-surface wall part is opposed to the upper-surface wall part with the containment chamber therebetween, and the bottom-surface wall part has a handhold portion on which a user places hand at the time of loading or unloading the liquid container into or from the liquid-consuming device.

17. The liquid container according to claim 1, wherein the liquid-consuming device is configured to be loaded with a plurality of the liquid containers so that the plurality of the liquid containers are aligned in a direction crossing the insertion direction, and each of the liquid containers has a coupling portion at an end on the rear-end wall part, the coupling portion is configured to couple the liquid container in the loaded state and another liquid container loaded in the liquid-consuming device.

18. The liquid container according to claim 17, wherein the liquid-consuming device includes a key member that, when being attached to the liquid-consuming device, is enabled to drive the liquid-consuming device, and when being detached from the liquid-consuming device, is disabled to drive the liquid-consuming device, and the coupling portion is configured to release a coupling state of the liquid containers by detaching the key member from the liquid-consuming device.

* * * * *